US012742335B2

(12) United States Patent
Zeng et al.

(10) Patent No.: US 12,742,335 B2
(45) Date of Patent: Sep. 22, 2026

(54) INFLATABLE POOL HAVING THERMAL INSULATION STRUCTURE

(71) Applicant: BESTWAY INFLATABLES & MATERIAL CORP., Shanghai (CN)

(72) Inventors: Xianglin Zeng, Shanghai (CN); Yunzhe Ban, Shanghai (CN); Qingshui Song, Shanghai (CN); Chenggen Liu, Shanghai (CN)

(73) Assignee: BESTWAY INFLATABLES & MATERIAL CORP., Shanghai (CN)

( * ) Notice: Subject to any disclaimer, the term of this patent is extended or adjusted under 35 U.S.C. 154(b) by 260 days.

(21) Appl. No.: 18/518,010

(22) Filed: Nov. 22, 2023

(65) Prior Publication Data

US 2024/0287825 A1 Aug. 29, 2024

(30) Foreign Application Priority Data

Feb. 24, 2023 (CN) ..... 202320314775.0
Sep. 28, 2023 (EP) ..... 23200627

(51) Int. Cl.
*E04H 4/00* (2006.01)
*E04H 4/10* (2006.01)

(52) U.S. Cl.
CPC ..... *E04H 4/0025* (2013.01); *E04H 4/103* (2013.01)

(58) Field of Classification Search
CPC ..... E04H 4/0025; E04H 4/103; E04H 4/00; E04H 4/0043; E04H 4/005
USPC ..... 4/506, 498, 499
See application file for complete search history.

(56) References Cited

U.S. PATENT DOCUMENTS 4,538,311 A * 9/1985 Hall ..... E04H 4/0025 4/584
5,619,759 A * 4/1997 Hansen ..... E04H 4/10 D23/303
5,924,144 A * 7/1999 Peterson ..... E04H 4/0025 4/488
2009/0158517 A1* 6/2009 Herd ..... E04H 4/103 4/499
2019/0161986 A1 5/2019 Huang et al.
2021/0108431 A1 4/2021 Huang et al.

FOREIGN PATENT DOCUMENTS

CN 207647246 7/2018

OTHER PUBLICATIONS

First Review Opinion Notice dated Jun. 21, 2023 (Jun. 21, 2023), issued on related Chinese patent application 202320314775.0 by the Patent Office of the State Intellectual Property Office.
Extended European Search Report regarding corresponding EP App. No. 23200627.0; dated Mar. 12, 2024.

* cited by examiner

*Primary Examiner* — David J Walczak
(74) *Attorney, Agent, or Firm* — Dickinson Wright PLLC

(57) ABSTRACT

An inflatable pool includes a thermal insulation structure. The inflatable pool has a bottom wall and an inflatable side wall, the inflatable side wall and the bottom wall jointly defining a water cavity. The inflatable side wall includes an inflatable chamber and a side wall thermal insulation structure arranged in the inflatable chamber. Further included is a pool cover having a similar structure.

12 Claims, 46 Drawing Sheets

INFLATABLE POOL HAVING THERMAL INSULATION STRUCTURE

CROSS-REFERENCE TO RELATED APPLICATION

This Application claims priority from Chinese Application CN202320314775.0, filed Feb. 24, 2023 in China, and from European Application EP23200627.0, filed Sep. 28, 20233, the disclosures of which are incorporated herein by reference in their entirety.

BACKGROUND

1. Field

Example embodiments relate to inflatable pools, and more particularly, to an inflatable pool having a thermal insulation structure.

2. Description of Related Art

An inflatable pool is a recreation product used both indoors and outdoors in open spaces. Inflatable pools are widely popular because of their convenient installation and ease of storage. More and more users expect to be able to experience the fun of an inflatable pool in the cold season or in cold regions, so it is important to be able to provide heating and thermal insulation for water in the inflatable pool. If an inflatable pool having a heating function has poor thermal insulation, the heater would need to repeatedly provide heating so as to maintain water at a proper temperature, which may waste energy. Existing thermal insulation measures are mainly implemented by providing a thermal insulation outer cover on the an outer side of a pool body in a sleeving manner, which increases the difficulty for a user to install and store the inflatable pool and is high in cost.

Therefore, the problem arises of how to conveniently and efficiently increase the insulation performance of an inflatable pool.

SUMMARY

Example embodiments may address at least the above problems and/or disadvantages and other disadvantages not described above. Also, example embodiments are not required to overcome the disadvantages described above, and may not overcome any of the problems described above.

According to an aspect of an example embodiment, an inflatable pool comprises: a bottom wall and an inflatable side wall; wherein the inflatable side wall and the bottom wall jointly define therein a water holding space; wherein the inflatable side wall comprises an inflatable chamber and a side wall thermal insulation structure disposed within the inflatable chamber.

The side wall thermal insulation structure may comprise at least one of: a side wall thermal insulation pad disposed within the inflatable chamber; a side wall thermal insulation coating on an inner surface of the inflatable chamber; a spacing sheet extending in a circumferential direction of the inflatable chamber and positioned to divide the inflatable chamber into at least two annular chambers, for example an outer annular chamber and an inner annular chamber; and a side wall thermal insulation filler filled within the inflatable chamber.

A side wall thermal insulation pad may or may not be directly connected to an inner side wall of the inflatable chamber. When the side wall thermal insulation pad is not connected, it may be held in a wrapping sheet which is connected to an inner side wall of the inflatable chamber or is connected to an element inside the inflatable chamber, for example in a shape-fitting manner. A direct connection may be realized by mechanical, physical or chemical means. The side wall thermal insulation pad may be fixed within the inflatable chamber by one of bonding, sewing, and welding. An example means of bonding may be gluing. A coating may refer to a sprayable film or foam applied to the inner side wall material. The coating may have a thermal radiation reflection property to reflect thermal radiation back to the inside of the inflatable chamber. The side wall thermal insulating sheet may be a sheet which improves thermal insulation. The thermal insulating sheet may also be bonded, sewed, and/or welded to a part inside the inflatable chamber, for example, provided in a circumferential direction and spaced apart from an inner side wall and an outer side wall of the inflatable chamber.

The side wall thermal insulation structure may comprise at least one of: a side wall thermal insulation pad comprising at least one of fiber wadding, foam, sponge, mineral wool, cellulose, fleece and an aerogel or any other suitable insulation material; and a side wall thermal insulation filler comprising at least one of down, floc fiber, foam, sponge, and an aerogel or any other suitable insulation material.

The side wall thermal insulation pad may be fixed within the inflatable chamber by one of bonding, sewing, and welding.

The inflatable side wall may comprise an upper side wall, a lower side wall, an outer enclosing side wall connected to the upper side wall and the lower side wall, an inner enclosing side wall connected to the upper side wall and the lower side wall, such that the upper side wall, the lower side wall, the outer enclosing side wall, and the inner inclosing side wall jointly define the inflatable chamber; and a plurality of side wall tensioning members arranged at intervals within the inflatable chamber in the circumferential direction of the inflatable chamber.

The side wall tensioning members provide support between the outer enclosing side wall and the inner enclosing side wall. Thereby, the outer enclosing side wall and the inner enclosing side wall may not move relatively to each other and the inflatable side wall gets its desired shape. The side wall tensioning members may be made of a sheet material or multiple parallel threads. The plurality of thermal insulation sections may all be of the same size.

Each of the plurality of side wall tensioning members may be connected to the outer enclosing side wall and the inner enclosing side wall; wherein the side wall thermal insulation pad may comprise a plurality of thermal insulation sections arranged at intervals in the circumferential direction of the inflatable side wall, each of the plurality of thermal insulation sections being arranged between two adjacent ones of the plurality of side wall tensioning members, or an integral piece extending in the circumferential direction of the inflatable side wall. The integral piece comprises a plurality of pad openings, each of the plurality of pad openings configured for a corresponding one of the plurality of side wall tensioning members to pass through.

The spacing or gap between two thermal insulation sections may be equal to the thickness of the side wall tensioning member. The spacing or gap may be smaller than the thickness of the side wall tensioning member or may be zero to exert force on the side wall tensioning members. Further, the thickness of the plurality of thermal insulation sections may vary and may be thicker in the vicinity of the connection points to neighboring thermal insulation sections. The same thickness variation may be provided near the lower side wall and the upper side wall. Similarly, the thickness of the integral piece may vary and may, e.g., be thicker in the vicinity of the pad openings, to provide additional support for the side wall tensioning members. Additionally, the thermal insulation sections may touch or may not touch each other.

The inflatable side wall may further comprise a wrapping sheet and a side wall thermal insulation pad arranged in the inflatable chamber, wherein the wrapping sheet is connected to a one of the outer enclosing side wall and the inner enclosing side wall to jointly define an accommodating chamber between the wrapping sheet and the outer enclosing side wall or the inner enclosing side wall, wherein the side wall thermal insulation pad is disposed within the accommodating chamber, and wherein each of the plurality of side wall tensioning members is connected to the wrapping sheet and another one of the outer enclosing side wall and the inner enclosing side wall.

This accommodating chamber defines a space into which the thermal insulation pad may be inserted. The accommodating chamber may be formed on any of the inner side walls of the inflatable chamber.

The spacing sheet may comprise an aperture, through which the outer annular chamber and the inner annular chamber are in communication with each other. Thereby, the pool can be inflated through a low number of valves, for example, only one valve. Alternatively, the spacing sheet may separate the inflatable side wall into several fully independent chambers, which have their own valve.

The spacing sheet may comprise a top edge connected to the upper side wall and a bottom edge connected to the lower side wall, wherein the plurality of side wall tensioning members comprise: a plurality of first side wall tensioning members arranged in the inner annular chamber, each of the plurality of first side wall tensioning members connected to the inner enclosing side wall and the spacing sheet, and a plurality of second side wall tensioning members arranged in the outer annular chamber, each of the plurality of second side wall tensioning members connected to the spacing sheet and the outer enclosing side wall.

The plurality of first side wall tensioning members may be welded to the spacing sheet forming a first plurality of weld seams, and the plurality of second side wall tensioning members may be welded to the spacing sheet forming a second plurality of weld seams, wherein the second plurality of weld seams are staggered with the first plurality of weld seams.

According to an aspect of another example embodiment, the inflatable pool may further comprise a pool cover detachably connected to the inflatable side wall, the pool cover comprising an inflatable liner defining an inflatable cavity therein.

The pool cover may further comprise a cover body comprising an outer layer, an inner layer, and a thermal insulation interlayer arranged between the outer layer and the inner layer, wherein the inflatable liner is arranged adjacent to the inner layer of the cover body.

The pool cover may be used for the inflatable pool according to the this example embodiment, but also on other pools. In The inflatable liner may comprise a liner thermal insulation structure arranged in the inflatable cavity, the liner thermal insulation structure comprising at least one of: a) a liner thermal insulation pad; b) a liner thermal insulation coating an inner surface of the inflatable cavity; and c) a liner thermal insulation filler filled within the inflatable cavity.

The liner thermal insulation structure may comprise the liner thermal insulation pad, and the liner thermal insulation pad may be attached to the inner surface of the inflatable cavity by means of one of bonding, sewing, and welding.

The inflatable liner may further comprise a top wall, a bottom wall connected to the top wall, such that the inflatable cavity is defined between the top wall and the bottom wall; and a plurality of liner tensioning members arranged at intervals in the inflatable cavity.

The liner thermal insulation structure may comprise the liner thermal insulation pad; wherein each of the liner tensioning members is connected to the top wall of the inflatable liner and the bottom wall of the inflatable liner; wherein the liner thermal insulation structure comprises the liner thermal insulation pad arranged on at least one of the top wall and the bottom wall; and the liner thermal insulation pad may comprise one of: a plurality of thermal insulation segments arranged at intervals, each of the thermal insulation segments arranged between two adjacent ones of the liner tensioning members; and an integral piece comprising a plurality of pad openings, each of the plurality of pad openings configured for a corresponding one of the plurality of liner tensioning member to pass through.

The inflatable liner may further comprise: an attachment sheet connected to the top wall or the bottom wall thereby defining an accommodating cavity between the attachment sheet and the one of the top wall and the bottom wall; and a liner thermal insulation pad disposed in the accommodating cavity; wherein each of the plurality of liner tensioning members is connected to the attachment sheet and another one of the top wall and the bottom wall.

According to an aspect of another example embodiment, an inflatable pool is provided comprising a bottom wall and an inflatable side wall; wherein the inflatable side wall and the bottom wall jointly define therein a water holding space; wherein the inflatable side wall comprises: an inflatable chamber, and at least one side wall thermal insulation pad disposed within the inflatable chamber, wherein the at least one side wall thermal insulation pad is attached to an inner side wall of the inflatable chamber.

A plurality of side wall thermal insulation pads may be provided, each side wall thermal insulation pad being attached to a different inner side wall of the inflatable chamber.

The inflatable side wall may comprise: an upper side wall, a lower side wall, an outer enclosing side wall connected to the upper side wall and the lower side wall, an inner enclosing side wall connected to the upper side wall and the lower side wall, such that the upper side wall, the lower side wall, the outer enclosing side wall, and the inner inclosing side wall jointly define the inflatable chamber; and a plurality of side wall tensioning members arranged at intervals within the inflatable chamber in the circumferential direction of the inflatable chamber.

A thermal insulation pad may be attached to at least one of the inner side of the outer enclosing side wall, the inner side of the inner enclosing side wall, the inner side of the upper side wall, and the inner side of the lower side wall.

The height of the thermal insulation pad may be greater than the height of the tensioning members.

The side wall thermal insulation pad may extend across 60-98% of the height and/or width of the inflatable side wall it is attached to, for example, across 85-95% of the height and/or width of the inflatable side wall it is attached to.

The thermal insulation pad is may be formed as an integral piece covering the circumference, for example, the full circumference of the inner side of the side wall it is attached to.

The thermal insulation pad may comprise a plurality of pad openings configured for one of the side wall tensioning members to pass through, the pad openings being formed, for example, uniformly spaced around the circumference of the thermal insulation pad.

The width and height of the pad openings may correspond to the width and height of the side wall tensioning members, respectively and/or the pad openings may be sized to provide a form-fit for the side wall tensioning members passing therethrough.

The side wall tensioning members may be directly attached to the thermal insulation pad.

The thermal insulation pad may comprise a plurality of thermal insulation sections arranged at intervals in the circumferential direction of the inflatable side wall, a side wall tensioning member being provided between two neighboring thermal insulation sections or being directly attached to a thermal insulation section.

Neighboring thermal insulation sections may be provided with a gap between each other, wherein the gap: has a width equal to the thickness of a tensioning member such that the thermal insulation sections touch the respective tensioning member passing through the gap, or is smaller than the thickness of a tensioning member to exert a force on the respective tensioning member passing through the gap, the gap being, for example, zero.

The thermal insulation sections may at least partly cover those parts of the tensioning members being attached to the side wall to which the thermal insulation sections are attached to.

The height of a thermal insulation section may be, for example, greater than the height of a tensioning members, for example, the height of each thermal insulation section being greater than the height of each tensioning members.

The thermal insulation pad may be spaced apart from the inner enclosing side wall and the outer enclosing side wall.

The thermal insulation pad may be fixed to the upper side wall and the lower side wall of the inflatable chamber or is fixed to the thermal insulation members.

The thermal insulation pad may extend across the entire height of the inflatable chamber.

According to an aspect of another example embodiment, an inflatable pool is provided comprising a bottom wall and an inflatable side wall; wherein the inflatable side wall and the bottom wall jointly define therein a water holding space; wherein the inflatable side wall comprises an inflatable chamber, at least one side wall thermal insulation pad disposed within the inflatable chamber, and a plurality of side wall tensioning members arranged at intervals within the inflatable chamber in the circumferential direction of the inflatable chamber, wherein the side wall thermal insulation pad is fixed to the tensioning members and not fixed to side walls of the inflatable chamber.

The inflatable side wall may comprise: an upper side wall, a lower side wall, an outer enclosing side wall connected to the upper side wall and the lower side wall, an inner enclosing side wall connected to the upper side wall and the lower side wall, such that the upper side wall, the lower side wall, the outer enclosing side wall, and the inner inclosing sheet jointly define the inflatable chamber. The height of the thermal insulation pad may be greater than the height of the tensioning members.

The thermal insulation pad may be formed as an integral piece.

The thermal insulation pad may comprise a plurality of pad openings each configured for one of the side wall tensioning members to pass through, the pad openings being, for example, formed uniformly spaced around the circumference of the thermal insulation pad.

The width and height of the pad openings may correspond to the width and height of the side wall tensioning members, respectively.

The thermal insulation pad may comprise a plurality of thermal insulation sections arranged at intervals in the circumferential direction of the inflatable side wall, each thermal insulation section being fixed to the neighboring side wall tensioning members. The height of each thermal insulation section may be greater than the height of each tensioning members.

The thermal insulation pad may be provided in or around the middle of the inflatable chamber.

The thermal insulation pad may have a layered structure comprising a thermal radiation reflection layer.

The thermal radiation reflection layer may comprise a metal layer or metal foil, for example an aluminum foil.

The thermal radiation reflection layer may be arranged to reflect thermal radiation back into the water holding space and/or the inflatable chamber.

The thermal radiation reflection layer may form an outer side layer of the thermal insulation pad facing away from a side wall to which the thermal insulation pad is attached to. The thermal radiation reflection layer may be an inner layer of the layered structure.

According to an aspect of another example embodiment, an inflatable pool is provided comprising: a bottom wall and an inflatable side wall; wherein the inflatable side wall and the bottom wall jointly define therein a water holding space; wherein the inflatable side wall comprises: an inflatable chamber, at least one wrapping sheet having an accommodating chamber, the wrapping sheet being attached to an inner side wall of the inflatable chamber, and a side wall thermal insulation pad, wherein the side wall thermal insulation pad is disposed within the accommodating chamber of the at least one wrapping sheet.

The inflatable side wall may comprise: an upper side wall, a lower side wall, an outer enclosing side wall connected to the upper side wall and the lower side wall, an inner enclosing side wall connected to the upper side wall and the lower side wall, such that the upper side wall, the lower side wall, the outer enclosing side wall, and the inner inclosing sheet jointly define the inflatable chamber; and a plurality of side wall tensioning members arranged at intervals within the inflatable chamber in the circumferential direction of the inflatable chamber.

The wrapping sheet may be connected to at least one of the outer enclosing side wall and the inner enclosing side wall to jointly define the accommodating chamber between the wrapping sheet and the one of the outer enclosing side wall and the inner enclosing side wall, wherein each of the plurality of side wall tensioning members is connected to the wrapping sheet and another one of the outer enclosing side wall and the inner enclosing side wall. The height of the wrapping sheet is greater than the height of the tensioning members.

The side wall thermal insulation pad may extend across 60-98% of the height or width of the inflatable side wall the wrapping sheet is attached to, for example, across 85-95% of the height or width of the inflatable side wall the wrapping sheet is attached to.

The thermal insulation pad may be formed as an integral piece covering the circumference, for example, the full circumference of the inner side of the side wall the wrapping sheet is connected to.

Either a plurality of wrapping sheets each comprising an accommodating chamber or a wrapping sheet comprising a plurality of accommodating chambers may be provided, wherein the thermal insulation pad comprises a plurality of thermal insulation sections each being disposed inside a corresponding accommodating chamber arranged at intervals in the circumferential direction of the inflatable side wall.

According to an aspect of another example embodiment, an inflatable pool is provided comprising: a bottom wall and an inflatable side wall; wherein the inflatable side wall and the bottom wall jointly define therein a water holding space; wherein the inflatable side wall comprises: an inflatable chamber, and at least one spacing sheet inside the inflatable chamber and extending in a circumferential direction of the inflatable chamber and positioned to divide the inflatable chamber into a plurality of annular chambers.

The inflatable side wall may comprise: an upper side wall, a lower side wall, an outer enclosing side wall connected to the upper side wall and the lower side wall, an inner enclosing side wall connected to the upper side wall and the lower side wall, such that the upper side wall, the lower side wall, the outer enclosing side wall, and the inner inclosing sheet jointly define the inflatable chamber; and a plurality of side wall tensioning members arranged at intervals within the inflatable chamber in the circumferential direction of the inflatable chamber.

Each of the spacing sheets may be spaced apart from the outer enclosing side wall and the inner enclosing side wall. A top edge and a bottom edge of a spacing sheet may be respectively connected to the upper side wall and the lower side wall.

The plurality of side wall tensioning members may comprise: a plurality of first side wall tensioning members arranged in an inner annular chamber, each of the plurality of first side wall tensioning members connected to the inner enclosing side wall and the side wall spacing sheet and a plurality of second side wall tensioning members arranged in an outer annular chamber, each of the plurality of second side wall tensioning members connected to the side wall spacing sheet and the outer enclosing side wall.

The plurality of first side wall tensioning members may be welded to the side wall spacing sheet forming a first plurality of weld seams, and wherein the plurality of second side wall tensioning members may be welded to the spacing sheet forming a second plurality of weld seams, wherein the second plurality of weld seams are staggered with the first plurality of weld seams.

The outer enclosing side wall, the inner enclosing side wall, the upper side wall, the lower side wall, the spacing sheet, the plurality of first side wall tensioning members and the plurality of second side wall tensioning members may be made of at least one of polyvinyl chloride (PVC), polyurethane (PU), a laminated (PVC) mesh material, a laminated PU mesh material, and a thermoplastic polyurethane elastomer rubber (TPU) composite material.

According to an aspect of another example embodiment, an inflatable pool is provided comprising: a bottom wall and an inflatable side wall; wherein the inflatable side wall and the bottom wall jointly define therein a water holding space; wherein the inflatable side wall comprises: an inflatable chamber, and a side wall thermal insulation coating on an inner surface of the inflatable chamber.

The coating may be a sprayable film or foam applied to the inner side wall of the inflatable chamber. The coating may have a thermal radiation reflection property to reflect thermal radiation back to the inside of the inflatable chamber, for example, the coating forming a thermal radiation reflecting film configured to reflect thermal radiation back into the inflatable chamber and/or the water holding space S.

According to an aspect of another example embodiment, an inflatable pool is provided comprising: a bottom wall and an inflatable side wall; wherein the inflatable side wall and the bottom wall jointly define therein a water holding space; wherein the inflatable side wall comprises: an inflatable chamber, and a side wall thermal insulation filler filled within the inflatable chamber.

The side wall thermal insulation filler may comprise at least one of down, floc fiber, foam, sponge, and an aerogel.

The inflatable pool may further comprise a pool cover detachably connected to the inflatable side wall, the pool cover comprising an inflatable liner defining an inflatable cavity therein.

The pool cover may further comprise a cover body comprising an outer layer, an inner layer, a thermal insulation interlayer arranged between the outer layer and the inner layer, wherein the inflatable liner is arranged adjacent to the inner layer of the cover body.

The inflatable liner comprises a liner thermal insulation structure arranged in the inflatable cavity, the liner thermal insulation structure comprising at least one of: a thermal insulation pad corresponding to a thermal insulation pad of the pool as described above; a thermal insulation coating on an inner surface of the inflatable cavity corresponding to a thermal insulation coating of the pool as described before; and a thermal insulation filler filled within the inflatable cavity corresponding to a thermal insulation filler of the pool as described above.

The width or thickness of the tensioning members throughout this disclosure may range from 0.1-1 mm, for example between 0.2-0.5 mm

BRIEF DESCRIPTION OF THE DRAWINGS

The above and/or other aspects will become apparent and more readily appreciated from the following description of example embodiments, taken in conjunction with the accompanying drawings, in which.

DETAILED DESCRIPTION

Figure 1A:
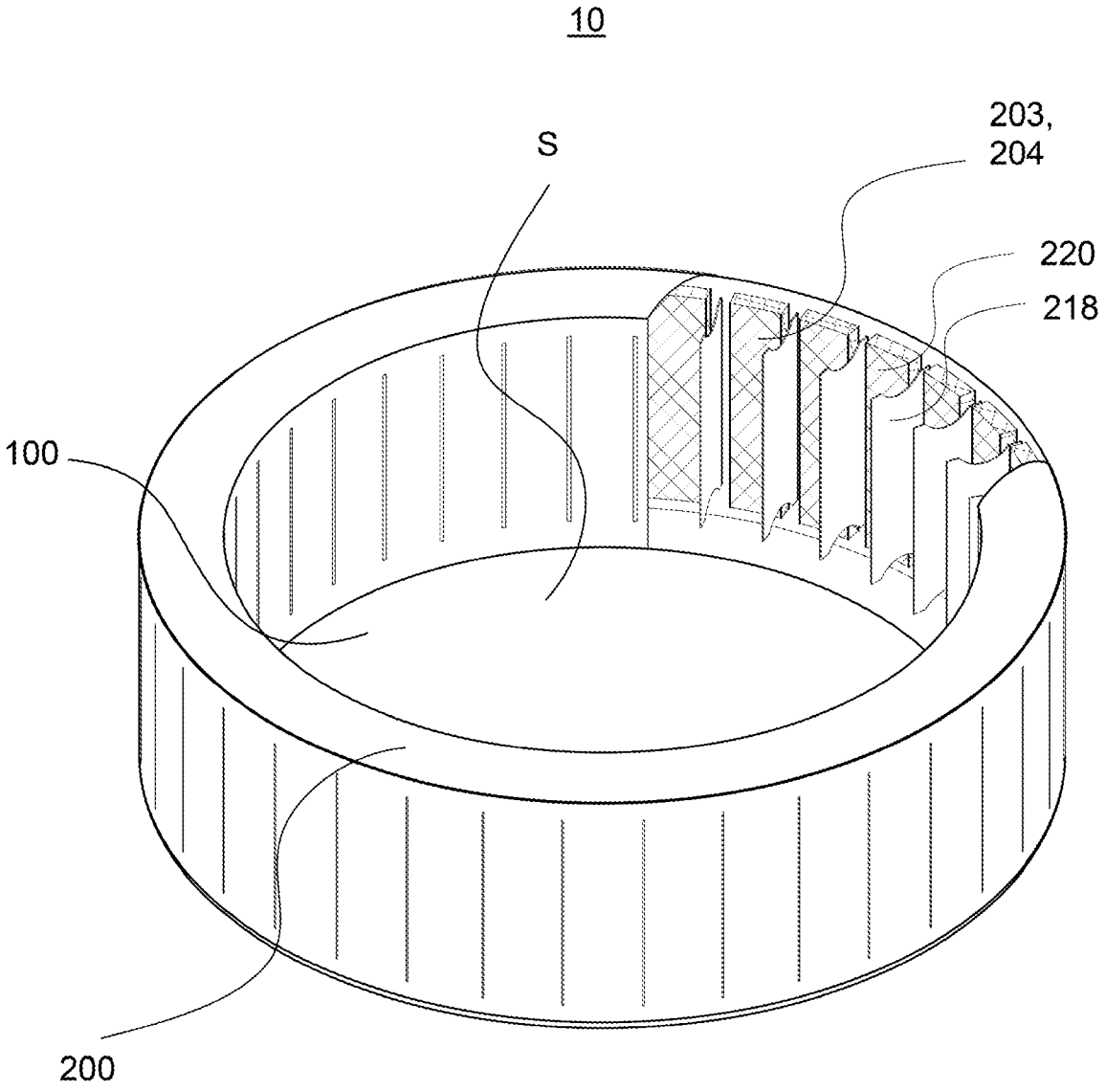
FIG. 1A is a schematic partial sectional view of an inflatable pool having a thermal insulation structure according to a first aspect of a first example embodiment.
Figure 1B:
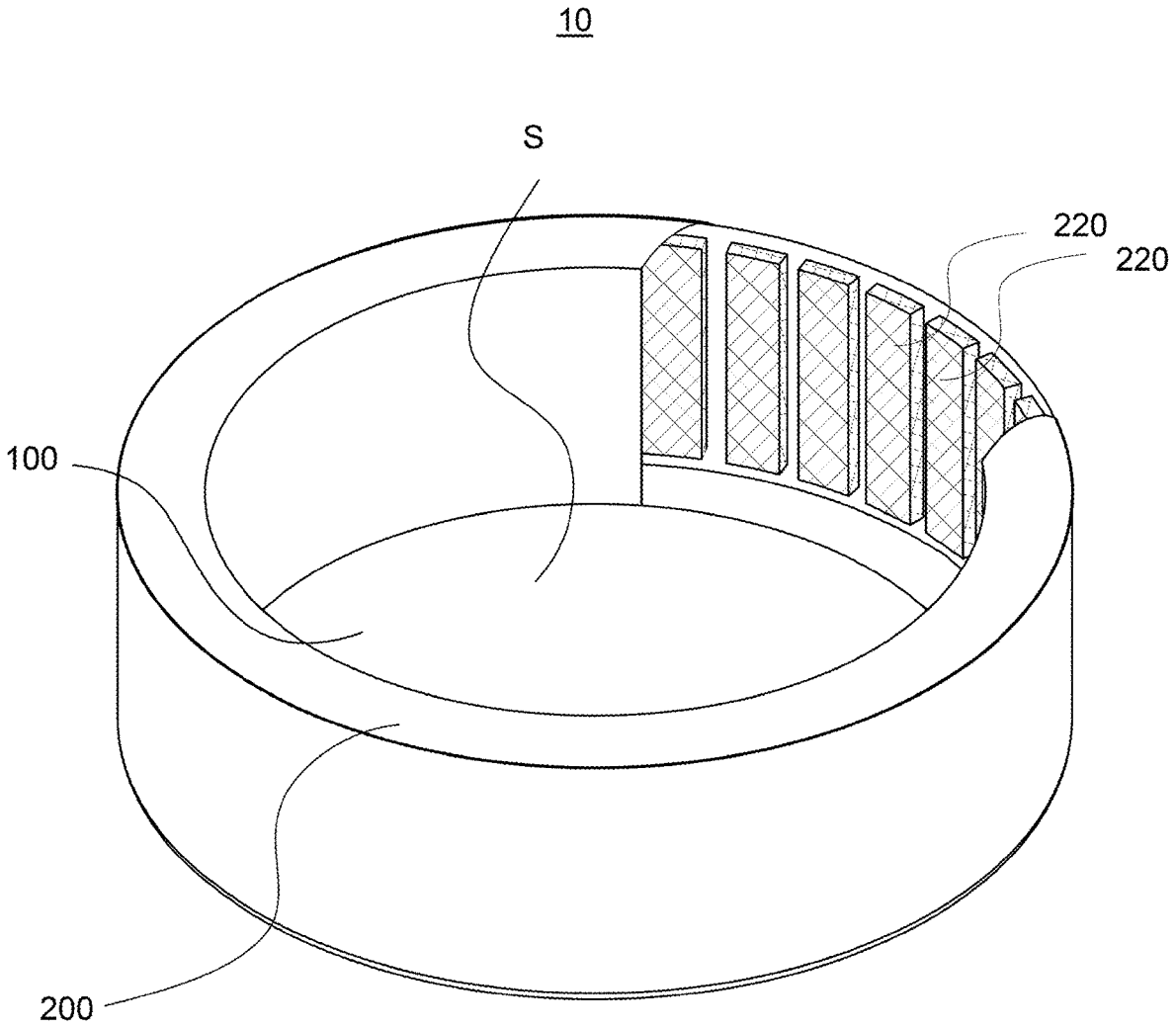
FIG. 1B shows the embodiment of FIG. 1A with the side wall tension members omitted.
Figure 1C:
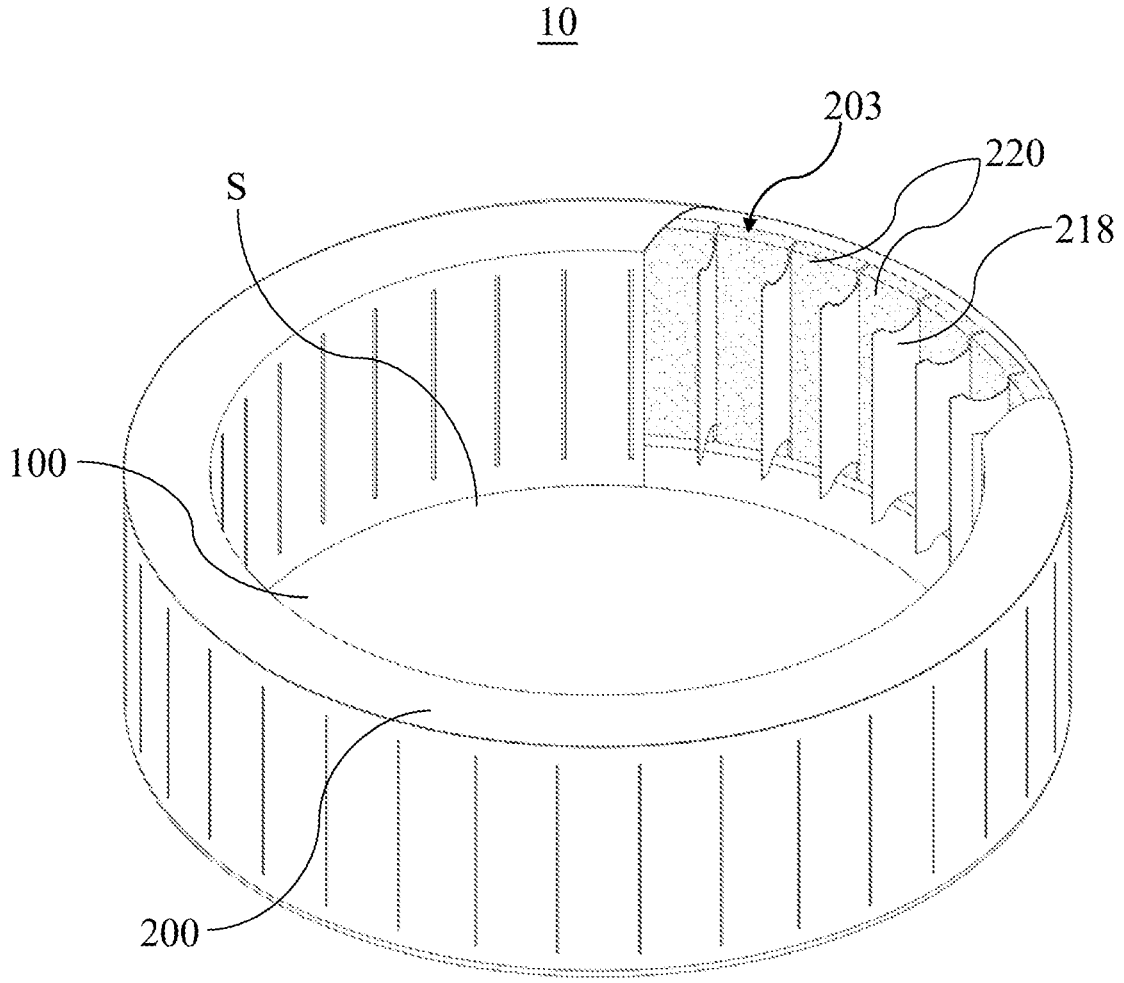
FIG. 1C shows the embodiment of FIG. 1A according to a different representation.

Reference will now be made in detail to example embodiments which are illustrated in the accompanying drawings, wherein like reference numerals refer to like elements throughout. In this regard, the example embodiments may have different forms and may not be construed as being limited to the descriptions set forth herein.

It will be understood that the terms "include," "including", "comprise, and/or "comprising," when used in this specification, specify the presence of stated features, integers, steps, operations, elements, and/or components, but do not preclude the presence or addition of one or more other features, integers, steps, operations, elements, components, and/or groups thereof.

It will be further understood that, although the terms "first," "second," "third," etc., may be used herein to describe various elements, components, regions, layers and/or sections, these elements, components, regions, layers and/or sections may not be limited by these terms. These terms are only used to distinguish one element, component, region, layer or section from another element, component, region, layer or section.

As used herein, the term "and/or" includes any and all combinations of one or more of the associated listed items. Expressions such as "at least one of," when preceding a list of elements, modify the entire list of elements and do not modify the individual elements of the list.

As used herein, the term "and/or" includes any and all combinations of one or more of the associated listed items. Expressions such as "at least one of," when preceding a list of elements, modify the entire list of elements and do not modify the individual elements of the list.

In this description, the expression of structural positions of various components, such as upper, lower, top, and bottom, are not absolute but relative. These expressions of orientation are appropriate when the various components are arranged as shown in the figures, but should change accordingly when the positions of the various components in the figures change. The axial direction of a tubular or annular component refers to a direction along the central axis of the component, the circumferential direction of the tubular or annular component refers to a direction along the circumference of the component, and the radial direction of the tubular or annular component refers to a direction passing through the central axis of the component and being perpendicular to the axial direction of the component.

An inflatable pool 10 according to an example embodiment, and as shown in FIGS. 1A to 2C, comprises a bottom wall 100 and an inflatable side wall 200, the inflatable side wall 200 and the bottom wall 100 jointly defining a water holding space S, and the inflatable side wall 200 comprising an inflatable chamber 202 (FIG. 2A) and a side wall thermal insulation structure 203 arranged in the inflatable chamber 202. Compared with a structure providing a thermal insulation outer cover outside an inflatable pool and on the outside of the inflatable chamber, in the inflatable pool 10, the thermal insulation structure is arranged inside of the inflatable chamber 202, which may enable convenient installation and storage.

Figure 14A:
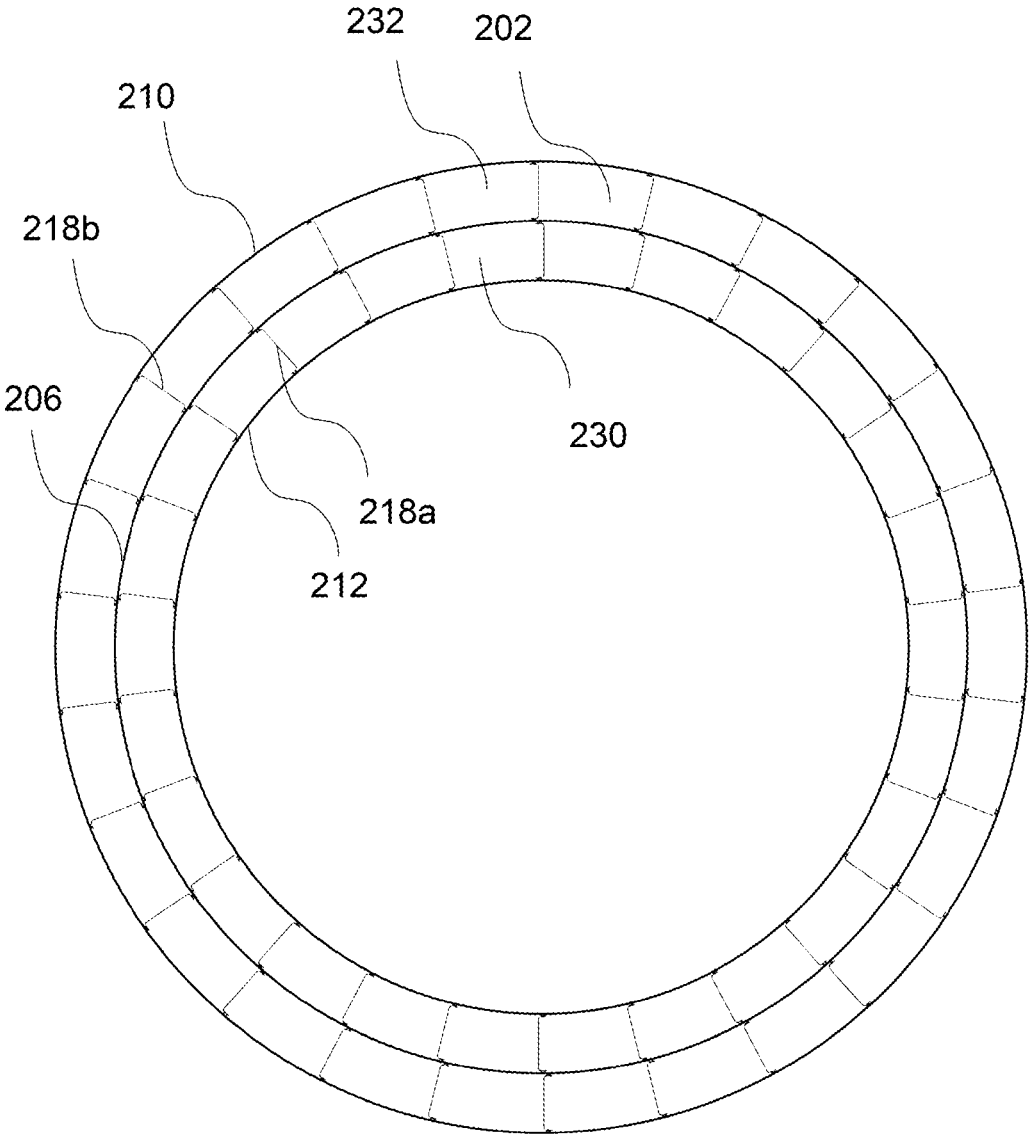
FIG. 14A is a schematic sectional top-view of the inflatable pool in FIG. 13.
Figure 14B:
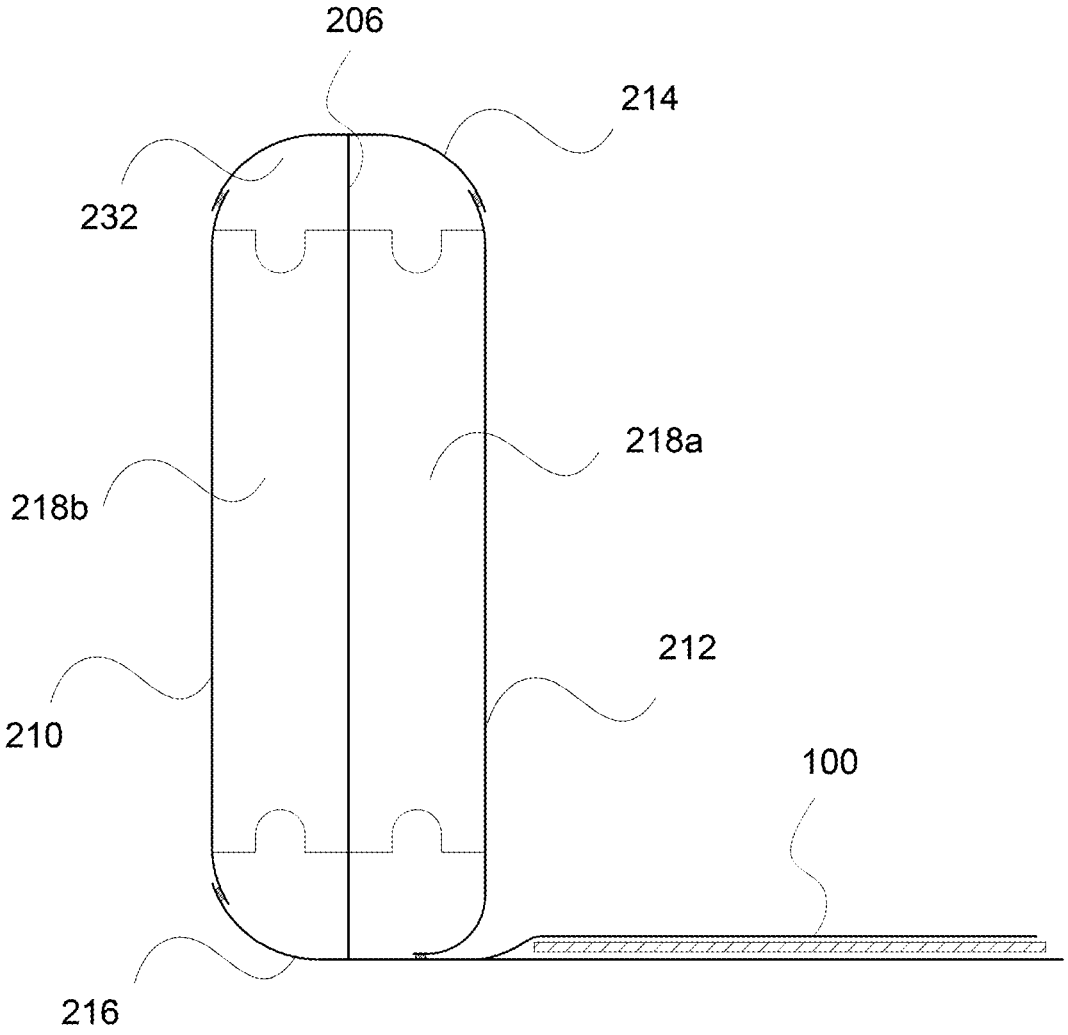
FIG. 14B is a schematic partial sectional side-view of the inflatable pool in FIG. 13.
Figure 15A:
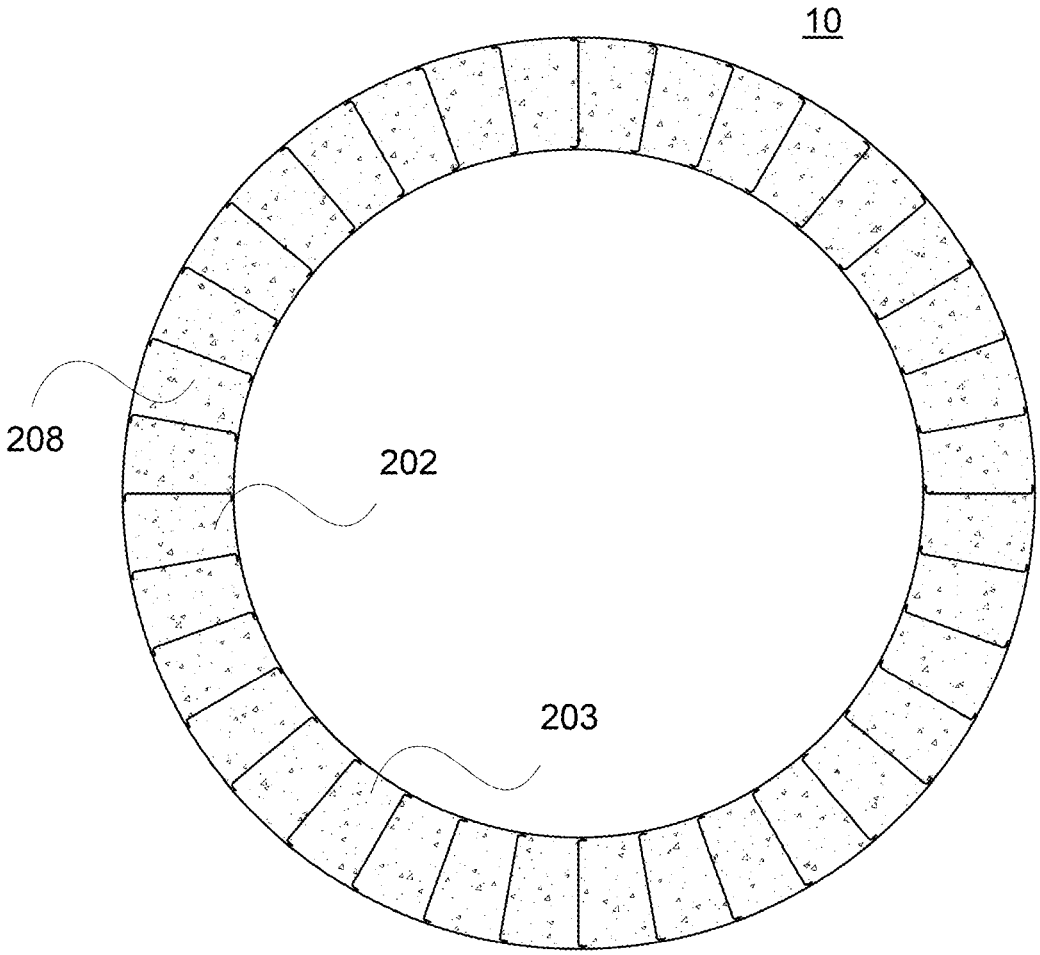
FIG. 15A is a schematic sectional top-view of an inflatable pool having a thermal insulation structure according to another example embodiment.
Figure 15B:
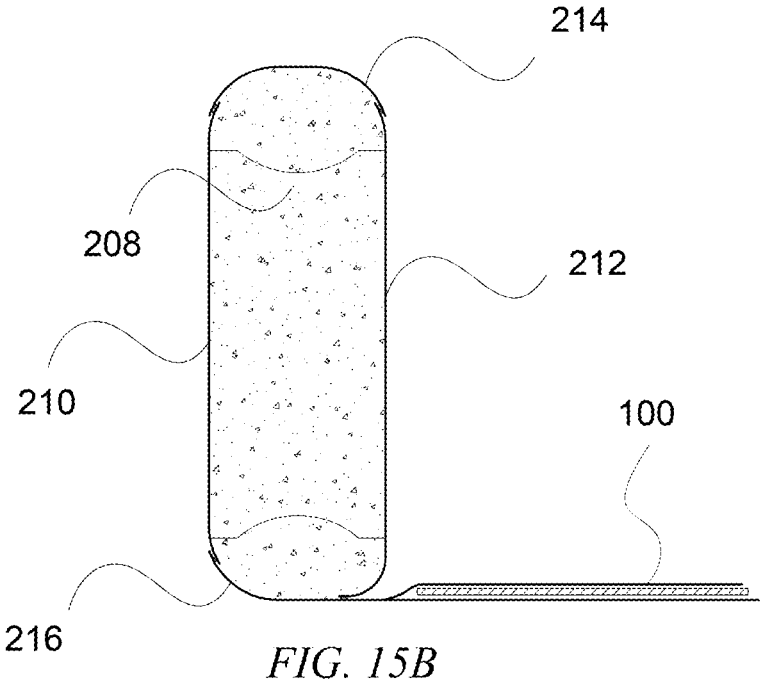
FIG. 15B is a schematic partial sectional side-view of the inflatable pool in FIG. 15A.

The side wall thermal insulation structure 203 comprises at least one of: a) a side wall thermal insulation pad 204 arranged in the inflatable chamber 202 (for example, see FIGS. 2A to 12); b) a side wall thermal insulation coating (not shown), with which an inner surface of the inflatable chamber 202 is coated; c) a spacing sheet 206, which extends in a circumferential direction of the inflatable chamber 202 to divide the inflatable chamber 202 into at least two annular chambers (for example, see FIGS. 13 to 14B); and d) a side wall thermal insulation filler 208 filled in the inflatable chamber 202 (for example, see FIGS. 15A and 15B). In other words, the side wall thermal insulation structure 203 may comprise any one of the side wall thermal insulation pad 204, the side wall thermal insulation coating, the spacing sheet 206 and the side wall thermal insulation filler 208 or a combination thereof. A non-limiting example of the side wall thermal insulation structure 203 is discussed below.

FIGS. 1A to 8C show an inflatable pool 10 having a thermal insulation structure according to a first example embodiment.

Figure 2A:
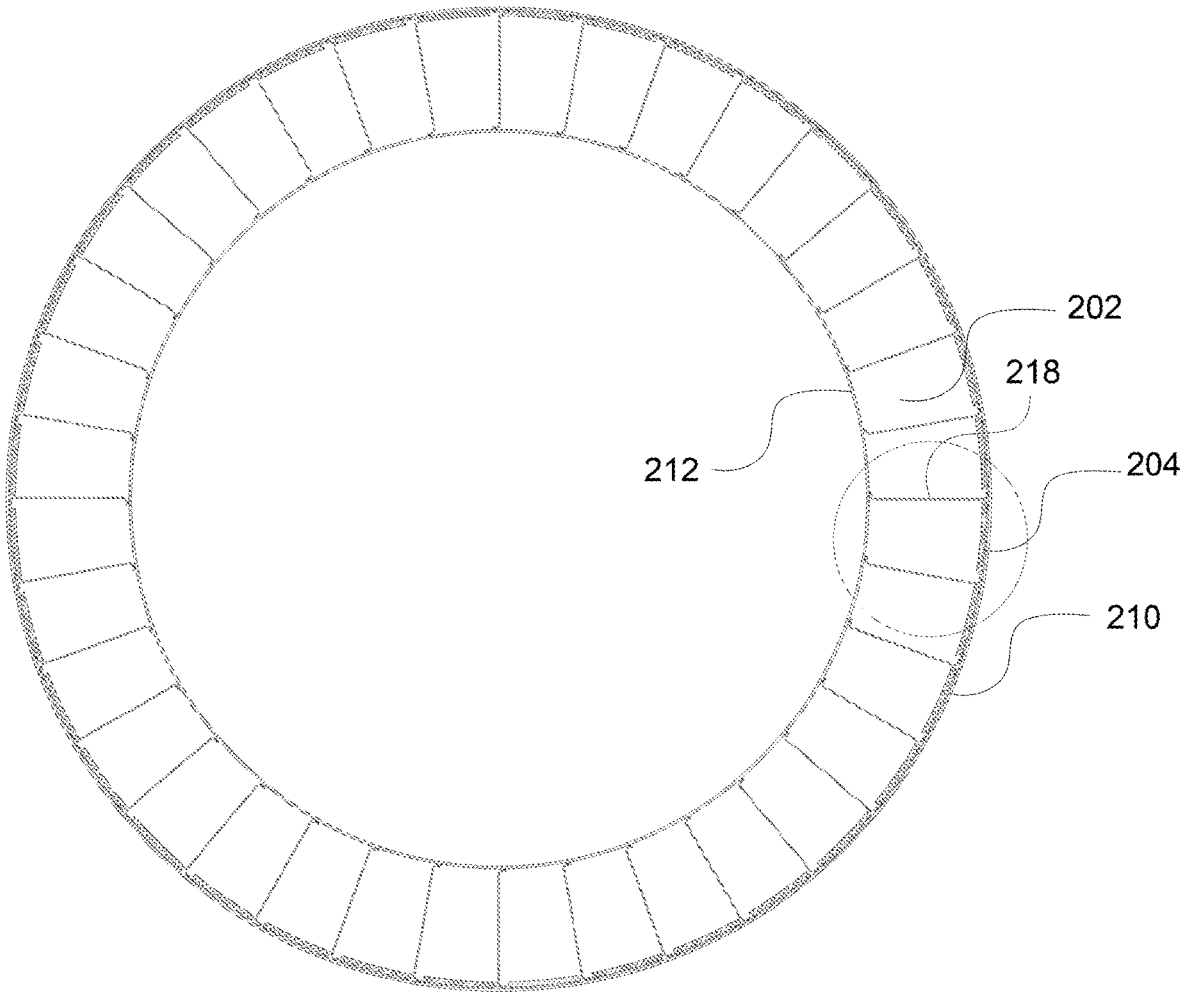
FIG. 2A is a schematic sectional top-view of the inflatable pool of FIG. 1A.
Figure 2B:
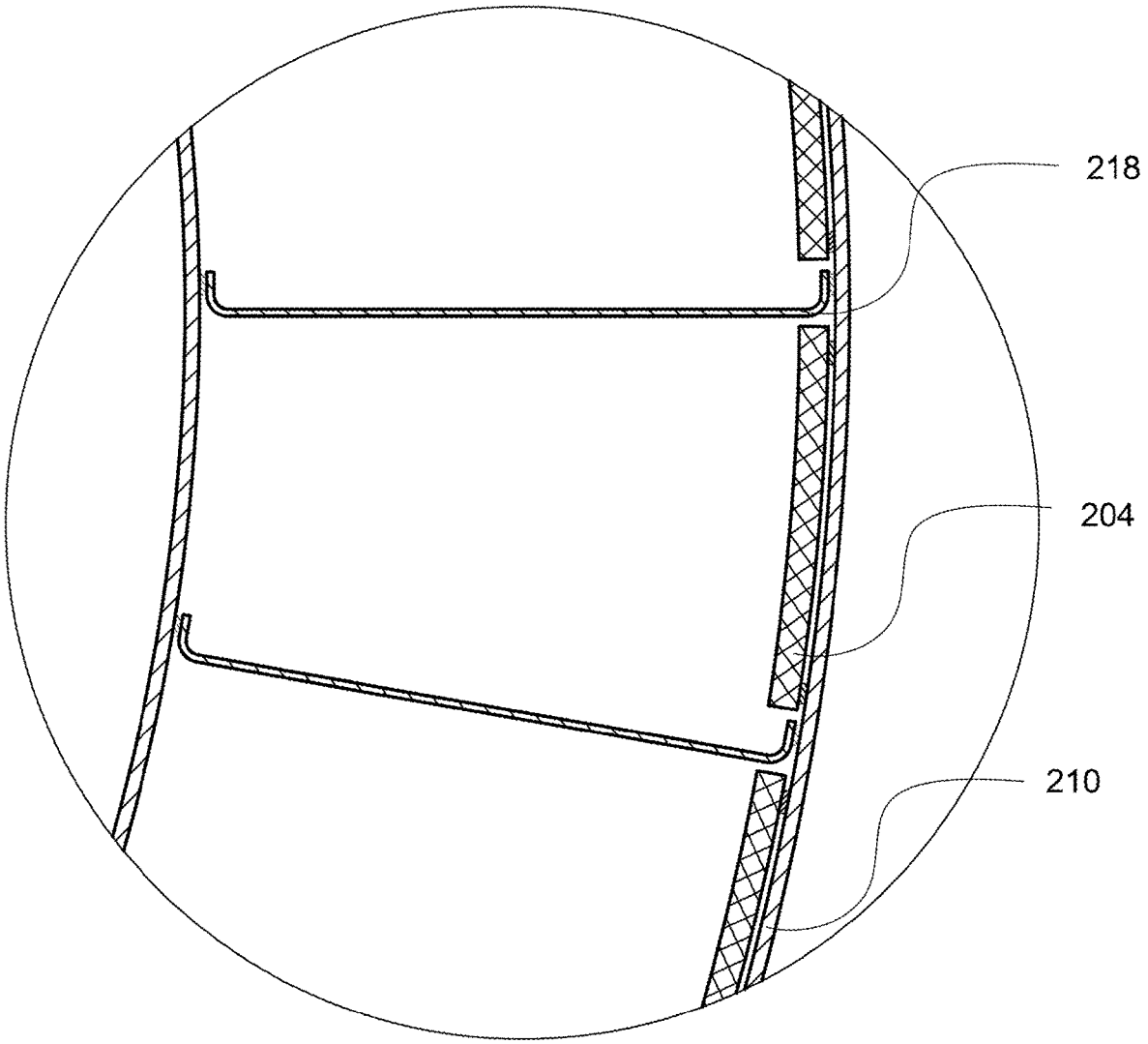
FIG. 2B is a schematic partial enlarged detailed view of the encircled portion of FIG. 2A.
Figure 2C:
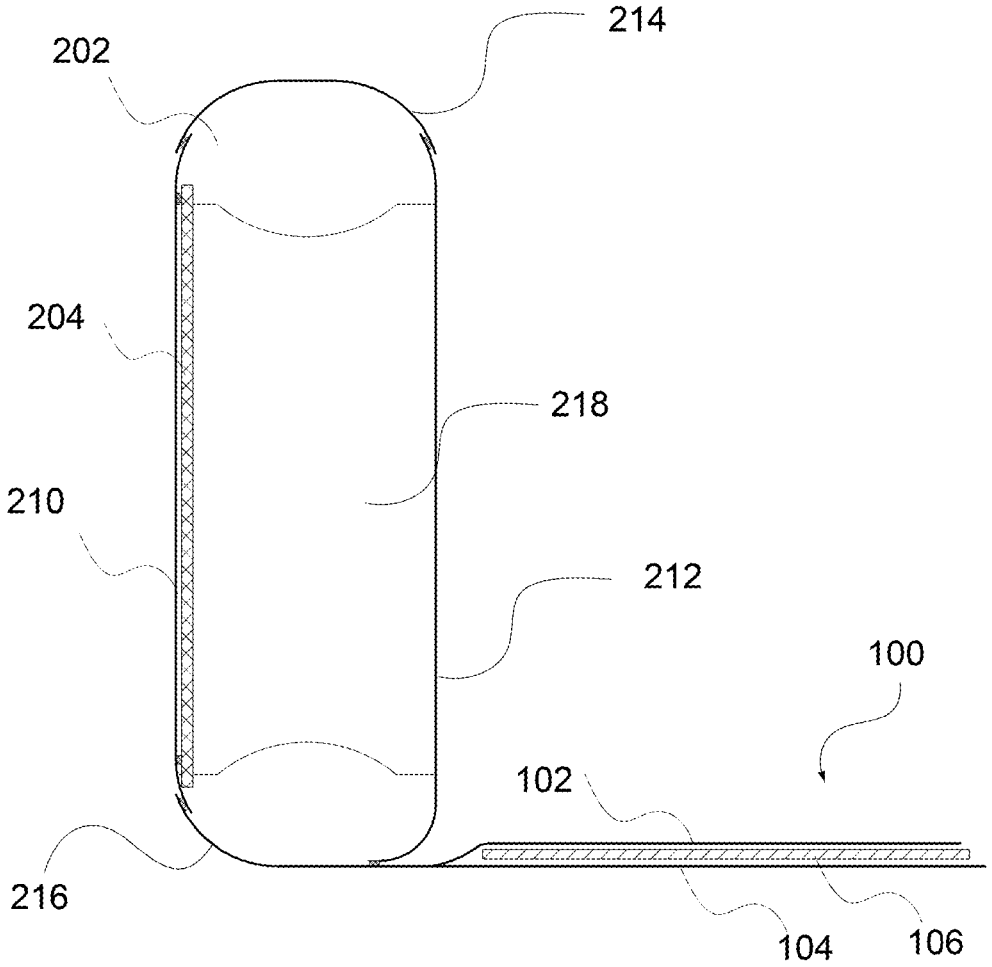
FIG. 2C is a schematic partial sectional side-view of the inflatable pool according to the first aspect of the first example embodiment.

An inflatable side wall 200 of the inflatable pool 10 as for instance shown in FIG. 2C may comprise an outer enclosing side wall 210, an inner enclosing side wall 212 opposite to the outer enclosing side wall 210 and facing the water holding space S, an upper side wall 214, a lower side wall 216 opposite to the upper side wall 214, and a plurality of side wall tensioning members 218. The side walls of the inflatable chamber may be formed of sheets. Top edges of the outer enclosing side wall or sheet 210 and the inner enclosing side wall or sheet 212 may be connected to the upper side wall or sheet 214, and bottom edges of the outer enclosing side wall or sheet 210 and the inner enclosing side wall or sheet 212 may be connected to the lower side wall or sheet 216, so as to jointly define the inflatable chamber 202. However, the inflatable chamber could alternately be formed in other ways. The plurality of side wall tensioning members 218 are arranged at intervals within the inflatable chamber 202 in the circumferential direction of the inflatable side wall 200. The side wall tensioning members 218 are provided to span the distance between the inner enclosing side wall 212 and the outer enclosing side wall 210 upon inflation. They may define the width of the inflatable chamber 202 in radial direction. Each side wall tensioning member 218 may be substantially sheet-shaped, may be formed by a single element, and two side edges of each side wall tensioning member 218 may respectively be connected to the outer enclosing side wall 210 and the inner enclosing side wall 212. Each side wall tensioning members 218 may have a C-shape as shown in FIG. 2B, but may alternately have a Z-shape, an S-shape or any other known shape of known side wall tensioning members 218. The connections between the outer enclosing side wall 210, the inner enclosing side wall 212, the upper side wall 214, the lower side wall 216, and the plurality of side wall tensioning members 218 may be achieved by means of welding, bonding (e.g. gluing), sewing, hanging, etc. The outer enclosing side wall 210, the inner enclosing side wall 212, the upper side wall 214, the lower side wall 216, and the plurality of side wall tensioning members 218 may be made of at least one of a weldable material, of PVC, PU, a laminated PVC mesh material, a laminated PU mesh material, and a TPU composite material or any other suitable materials. The inflatable side wall 200 and the bottom wall 100 jointly define the water holding space S.

In the example embodiment as shown, the lower side wall 216 of the inflatable side wall 200 is a peripheral portion of the bottom wall 100 of the inflatable pool 10. During manufacturing of the inflatable pool 10, the outer enclosing side wall 210, the inner enclosing side wall 212, the upper side wall 214, and the plurality of side wall tensioning members 218 may be connected to each other first, and then the bottom edges of the outer enclosing side wall 210 and the inner enclosing side wall 212 may be respectively connected to the peripheral portion of the bottom wall 100 to form the inflatable pool 10, such that the portion of the bottom wall 100 that is located between a seam between the outer enclosing side wall 210 and the bottom wall 100 and a seam between the inner enclosing side wall 212 and the bottom wall 100 forms the lower side wall 216 of the inflatable side wall 200. However, the disclosure is not limited thereto and the elements of the inflatable pool could be connected differently according to one or more example embodiments.

It can be understood that, in other example embodiments not shown, the lower side wall of the inflatable side wall 200 and the bottom wall may be respectively formed as two components. Optionally, the lower side wall 216 may alternately be formed of a thicker sheet-like material with improved mechanical resistance with respect to the underground, i.e. sharp objects such as stones. During manufacturing of the inflatable pool, the outer enclosing side wall, the inner enclosing side wall, the upper side wall, the lower side wall and the side wall tensioning members may be connected to each other first to form the inflatable side wall of the inflatable chamber, and then the lower side wall of the inflatable side wall is connected to the bottom wall to form the inflatable pool.

In the example embodiment as shown, the bottom wall 100 may have a multi-layer composite structure, and may comprise an upper bottom wall sheet 102, a lower bottom wall sheet 104, and a buffer layer 106 sandwiched between the upper bottom wall sheet 102 and the lower bottom wall sheet 104. The upper bottom wall sheet 102 and the lower bottom wall sheet 104 may be connected to each other by means of welding or bonding. The upper bottom wall sheet 102 and the lower bottom wall sheet 104 may be made of at least one of a weldable material, PVC, PU, a laminated PVC mesh material, a laminated PU mesh material and a TPU composite material or any other suitable materials. The buffer layer 106 may comprise floc polyester fiber, foam (e.g., polyethylene foam or polyurethane foam), and/or sponge, etc. The bottom wall 100 having the buffer layer 106 may provide a more comfortable touch for the user using the inflatable pool and may thus improve the user experience. Additionally, even if the lower bottom wall sheet 104 is damaged, the water holding space S does not leak water, because the upper bottom wall sheet 102, which is in connection with the water, is protected by the buffer layer 106 and the lower bottom wall sheet 104. Similarly, even if the upper bottom wall sheet 102 is damaged by an object from the inside of the pool, the water holding space S does not leak water, because the lower bottom wall sheet 104 still prevents leakage of water to the outside. The buffer layer 106 may be an insulation layer.

As shown in FIG. 1, and also shown in FIG. 2 to 8C, the side wall thermal insulation structure 203 may comprise a side wall thermal insulation pad 204 arranged within the inflatable chamber 202, and the side wall thermal insulation pad 204 is configured to allow each side wall tensioning member 218 to be directly connected to the outer enclosing side wall 210 and the inner enclosing side wall 212. This allows for the formation of a direct and strong connection of the side wall tensioning members 218 to the enclosing side walls 210, 212 while providing space for side wall thermal insulation structures 203. The side wall thermal insulation pad 204 as a side wall thermal insulation structure 203 may be attached to the inner surface of the inflatable chamber 202 and/or to the side wall tensioning member 218 by means of bonding, e.g. gluing, welding, sewing, hanging, etc. The inner surface of the inflatable chamber 202 comprises the surfaces, facing the inflatable chamber 202, of the outer enclosing side wall 210, the inner enclosing side wall 212, the upper side wall 214 and the lower side wall 216. The side wall thermal insulation pad 204 may comprise a thermal insulation material such as fiber wadding (e.g., polyester wadding and acrylic wadding), foam (e.g., polyethylene foam and polyurethane foam), sponge, mineral wool, cellulose, fleece and/or aerogel or other insulating materials. In the examples of the first embodiment, the side wall thermal insulation pad 204 may differ in the specific configuration and arrangement position, which will be further described below.

FIGS. 1A to 2C show the first example aspect of the first example embodiment. FIG. 1A is a schematic partial sectional view of an inflatable pool having a thermal insulation structure according to a first aspect of a first example embodiment. FIG. 1B shows the embodiment of FIG. 1A with the side wall tension members omitted. FIG. 1C shows the embodiment of FIG. 1A according to a different representation. FIG. 2A is a schematic sectional top-view of the inflatable pool of FIG. 1A. FIG. 2B is a schematic partial enlarged detailed view of the encircled portion of FIG. 2A. FIG. 2C is a schematic partial sectional side-view of the inflatable pool according to the first aspect of the first example embodiment in a different variant. In this first aspect, as visible in FIG. 1A, the side wall thermal insulation pad 204 is attached to the outer enclosing side wall 210 and comprises a plurality of thermal insulation sections 220 arranged at intervals in the circumferential direction of the inflatable side wall 200, wherein each thermal insulation section 220 is arranged between the two adjacent side wall tensioning members 218. FIG. 1B illustrates a view of the first aspect of the first embodiment, where the side wall tensioning members 218 are not shown and the regular arrangement of the thermal insulation sections 220 can be seen unobstructed. The plurality of thermal insulation sections 220 may be uniformly spaced apart from each other and are arranged around the circumference of the inner side wall of outer enclosing side wall 210, for example arranged around the full circumference, 360°. This arrangement may be provided with a different spacing between two neighboring thermal insulation sections 220, as shown in FIG. 1A and FIG. 1C. The structure of the thermal insulation sections 220 is FIG. 1C is differently depicted from that in FIG. 1A to demonstrate that the materials provided in FIG. 1A and FIG. 1C may be different. However, they may also be the same. The gap between thermal insulation sections 220 may be as small as possible. The smaller the gap, the better the insulation of the inflatable pool 100 may be. According to one or more example embodiments, the thermal insulation structures 220 are in direct contact with the tensioning members 218. The gap between the pads may be equal to the width of a tensioning member 218. The gap may also be smaller than the width of a tensioning member 218 or even zero such that the tensioning member 218 is compressed between the thermal insulation sections 220. The width of the gap may be 1.5 to 0.5 times the width or thickness of a tensioning member 218, for example, between 1.2 and 0.8 times the width or thickness of a tensioning member 218, or between 1.1 and 0.9 times the width or thickness of a tensioning member 218. In a non-limiting example, the width or thickness of the tensioning members 218 throughout this disclosure may range from 0.1-1 mm, for example between 0.2-0.5 mm. During manufacturing, first the tensioning members 218 may be attached to the outer enclosing side wall 210 before the thermal insulation sections 220 are attached to the outer enclosing side walls 210. FIG. 2B depicts an enlarged view of the gap between the two neighboring thermal insulation sections 220 and the arrangement of the tensioning members 218 therebetween. The tensioning members 218 in this example embodiment have a C-shape such that the tensioning members 218 have sections extending along a parallel to the inner side walls of the inflatable chamber to allow attachment, for example welding of these sections to the outer and inner enclosing side wall 210, 212 respectively. However, the shape of the tensioning members 218 is not limited thereto. The gap between the two neighboring side wall thermal insulation structures 220 shown in FIG. 2B is exaggerated to show the structure of the tensioning member 218 more clearly. According to one or more example embodiments, the thermal insulation sections 220 overlap with the sections of the tensioning member 218 attached to the outer enclosing side wall 210 and may be in direct contact with the part of a tensioning member 218 extending between the inner and the outer enclosing side walls 210, 212.

In the vertical direction of the inflatable pool 100, i.e. perpendicular to the bottom wall 100, the side wall thermal insulation pad 204 may extend across the whole height of the inflatable side wall 200, for example between 60-98% of the height of the inflatable side wall 200, or across 85-95% of the height of the inflatable side wall 200. The more the side wall is covered by a side wall thermal insulation structure 203, the better the insulation performance may be. Since the thermal insulation section 220 and the side wall tensioning structures 218 are separately provided, each thermal insulation section 220 may have the same height compared to each side wall tensioning structure 218. For example, they may have a larger height in order to increase the thermal insulation properties of the inflatable pool 100, as shown in the vertical cut of FIG. 2C. The thickness of the side wall insulation pad 204 ranges from 1-8 cm, for example between 2-6 cm.

Figure 3A:
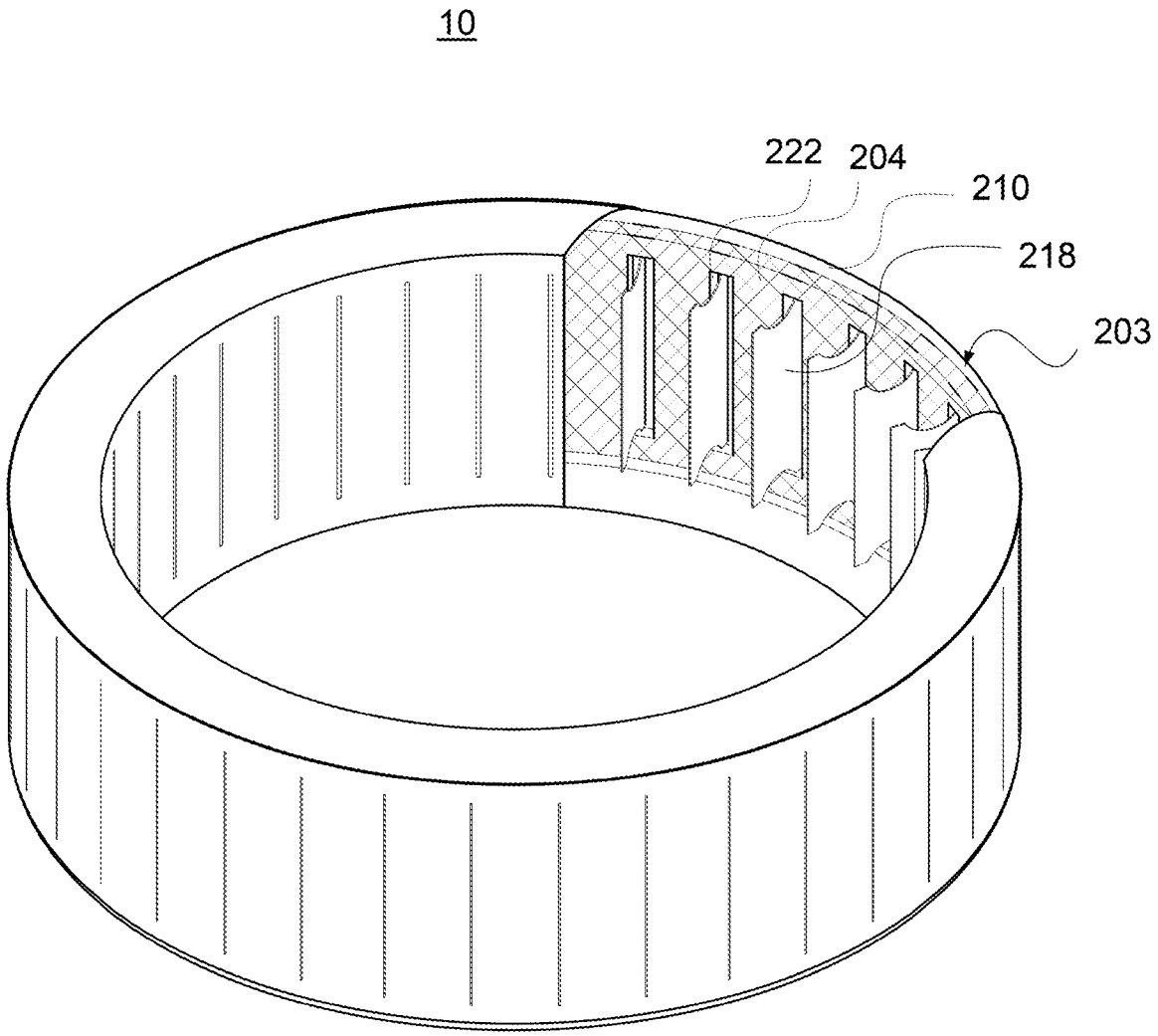
FIG. 3A is a schematic partial sectional view of an inflatable pool having a thermal insulation structure according to a second aspect of the first example embodiment.
Figure 3B:
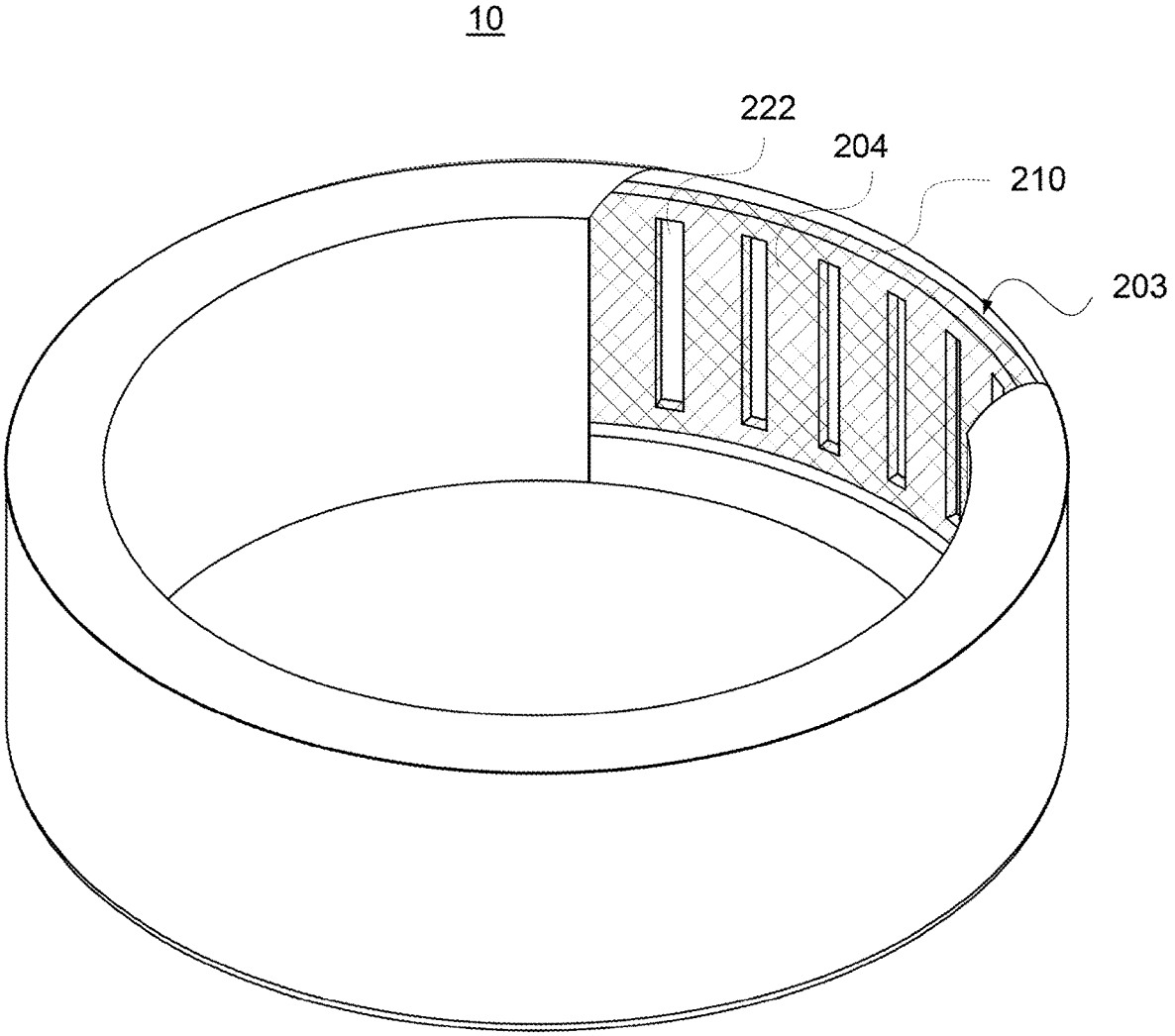
FIG. 3B shows the example embodiment of FIG. 3A with the side wall tension members omitted.
Figure 3C:
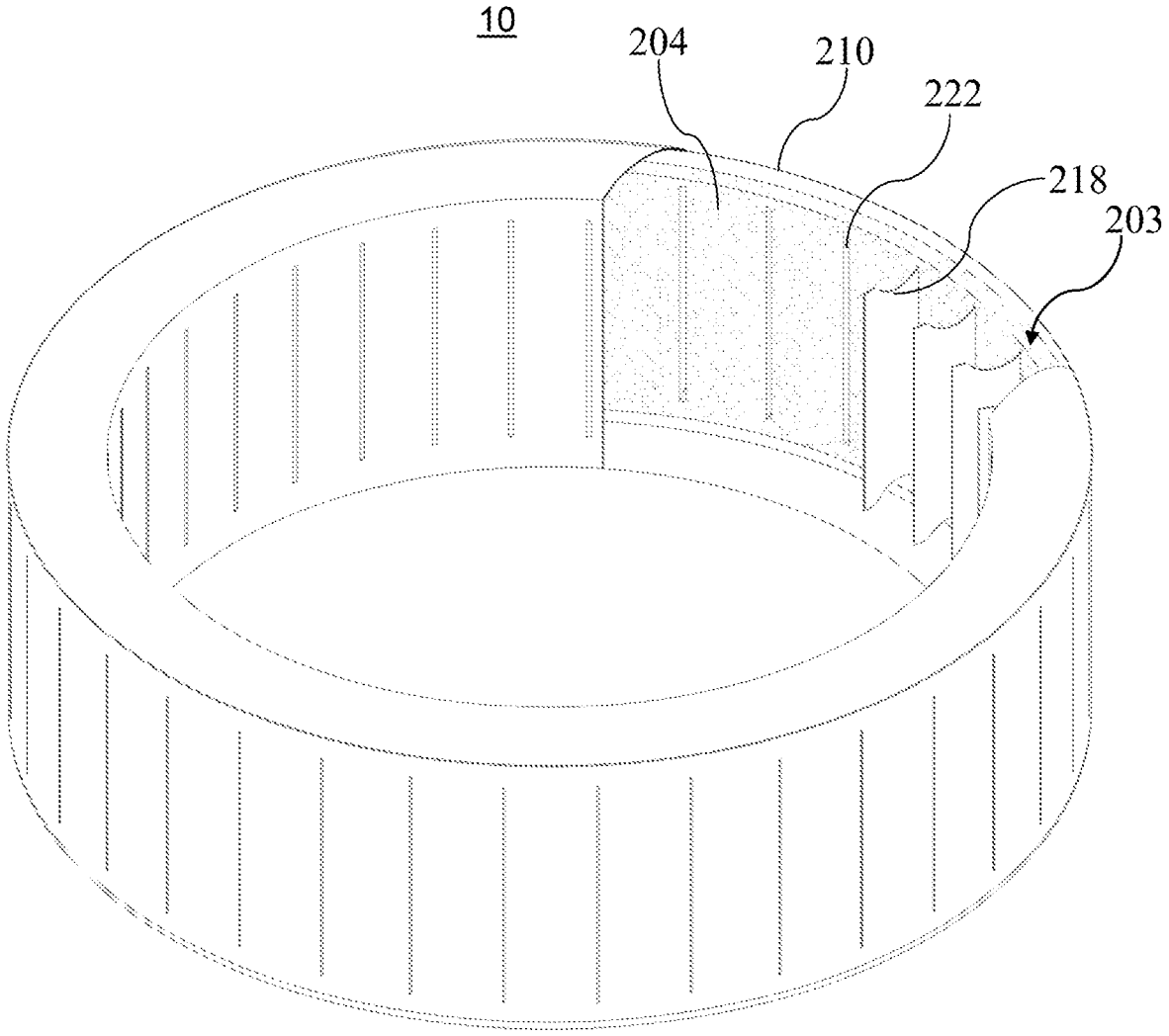
FIG. 3C shows the example embodiment of FIG. 3A according to another example aspect.

FIG. 3A is a schematic partial sectional view of an inflatable pool having a thermal insulation structure according to a second aspect of the first example embodiment. FIG. 3B shows the example embodiment of FIG. 3A with the side wall tension members omitted. FIG. 3C shows the example embodiment of FIG. 3A according to a different variant. Referring to FIG. 3A the second example aspect of the first example embodiment, the side wall thermal insulation pad 204 is attached to the outer enclosing side wall 210, and is formed as a single integral piece extending along the circumferential direction of the inflatable side wall 200, and the side wall thermal insulation pad 204 comprises a plurality of elongated pad openings 222. FIG. 3B shows the same inflatable pool 10 with the tensioning members 218 omitted to have a clearer view on the side wall thermal insulation pad 204 and its pad openings 222. Each pad opening 222 is sized and otherwise configured to enable the corresponding side wall tensioning member 218 to pass therethrough. As visible from FIG. 3A, the side wall tensioning member 218 passes through the pad opening 222, and has two ends thereof respectively connected to the inner enclosing side wall 212 and the outer enclosing side wall 210. The pad openings 222 may be formed uniformly spaced apart from each other along the circumference of the outer enclosing side wall 210. FIG. 3C shows a variant of FIG. 3A in which the width of the openings is smaller compared to FIG. 3A. Different materials may be provided for the pad 204 as discussed above. This is reflected by the different depiction of the side wall thermal insulation pad 204 in FIG. 3A and FIG. 3C. However, the materials may also be the same. According to this example aspect, that the side wall thermal insulation pad 204 may be a single element instead comprising a plurality of thermal insulation section 220 and the tensioning members 218 are located within opening of the side wall thermal insulation pad 204 instead of in a gap between two neighboring thermal insulation sections 220, while those features described above including dimensions, materials and their respective connections of the side wall thermal insulation pad 204, the inflation chamber 202, and the side wall tensioning members 218 may be the same. Those features described above with respect to for the gap between two neighboring thermal insulation sections 220 may apply to the dimension of the pad opening 222. For example, the size of the pad opening 222 may be as small as possible in order to provide optimal thermal insulation properties but sufficient to allow the side wall tensioning members 218 to pass through. The height of the pad openings 222 may be equal to the height of the tensioning member 218. The width of the pad openings 222 may range from 1.5 to 0.5 of the width or thickness of a tensioning member 218, for example between 1.2 and 0.8 times the width or thickness of a tensioning member, or between 1.1 and 0.9 times the width or thickness of a tensioning member. The width of the pad opening may range from 0.1-1 mm, for example from 0.2-0.5 mm.

Figure 4A:
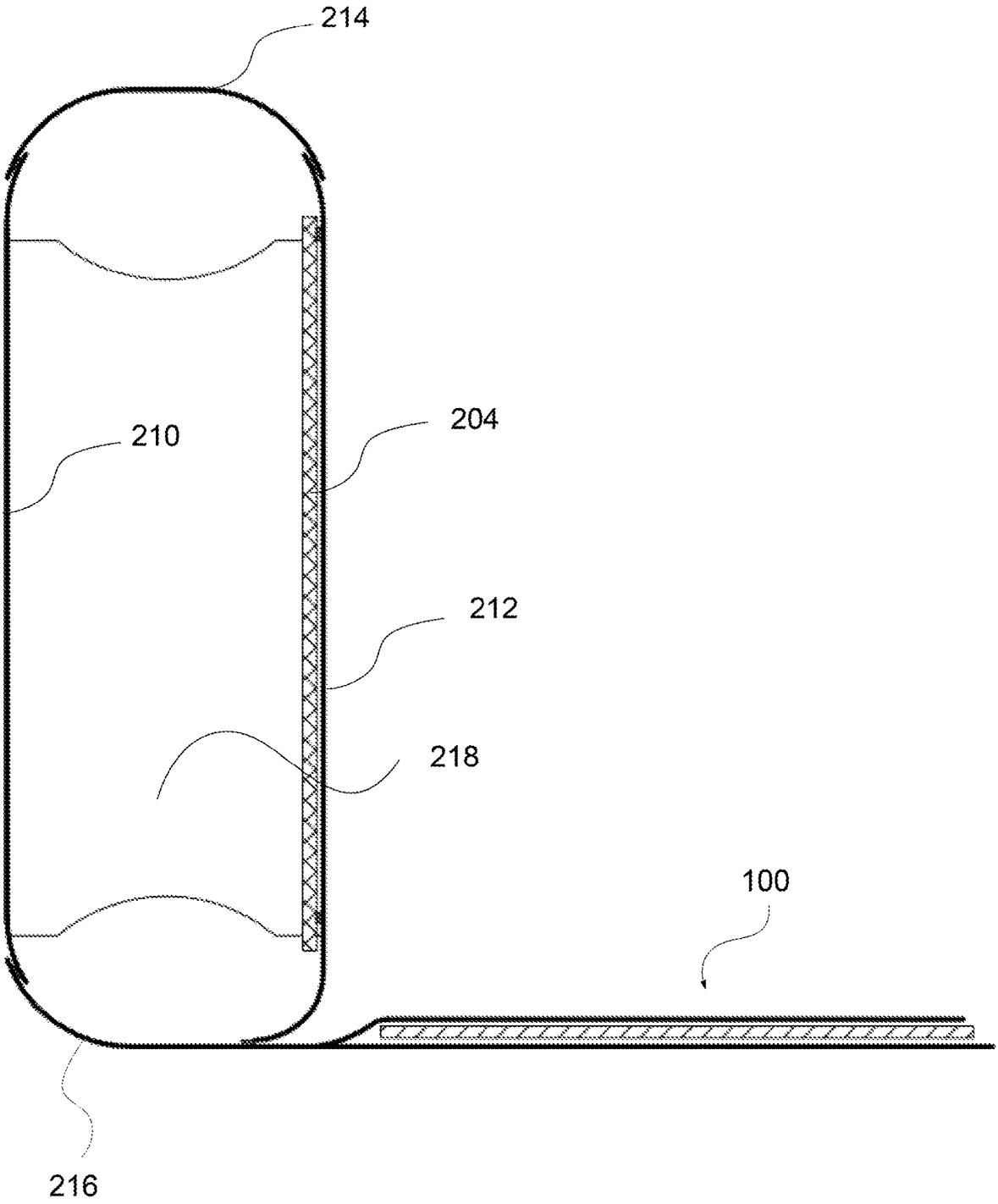
FIGS. 4A to 4D are respectively schematic partial sectional views of an inflatable pool having a thermal insulation structure according to various aspects of the first example embodiment.

FIGS. 4A to 4D are respectively schematic partial sectional views of an inflatable pool having a thermal insulation structure according to a third aspect, a fourth aspect, a fifth aspect and a sixth aspect of the first example embodiment. With respect to the previous example aspects, the side wall thermal insulation pad may be attached to different side walls of the inflatable chamber 202. Only this difference is explained below. All other features may remain the same and therefore the above descriptions of the first and second aspects of the first example embodiment still apply and are not repeated here. Referring to FIG. 4A, in the third example aspect of the first example embodiment, the side wall thermal insulation pad 204 is attached to the inner enclosing side wall 212. Optionally, as in the first aspect discussed previously, the side wall thermal insulation pad 204 attached to the inner enclosing side wall 212 may comprise a plurality of thermal insulation sections 220 arranged at intervals in the circumferential direction of the inflatable side wall 200, each thermal insulation section being arranged between two adjacent side wall tensioning members 218; or the side wall thermal insulation pad 204 attached to the inner enclosing side wall 212 may be an integral piece as in the second aspect discussed before, extend in the circumferential direction of the inflatable side wall 200, and comprise a plurality of openings, each of which is sized and otherwise configured to enable the corresponding side wall tensioning member 218 to pass therethrough.

Figure 4B:
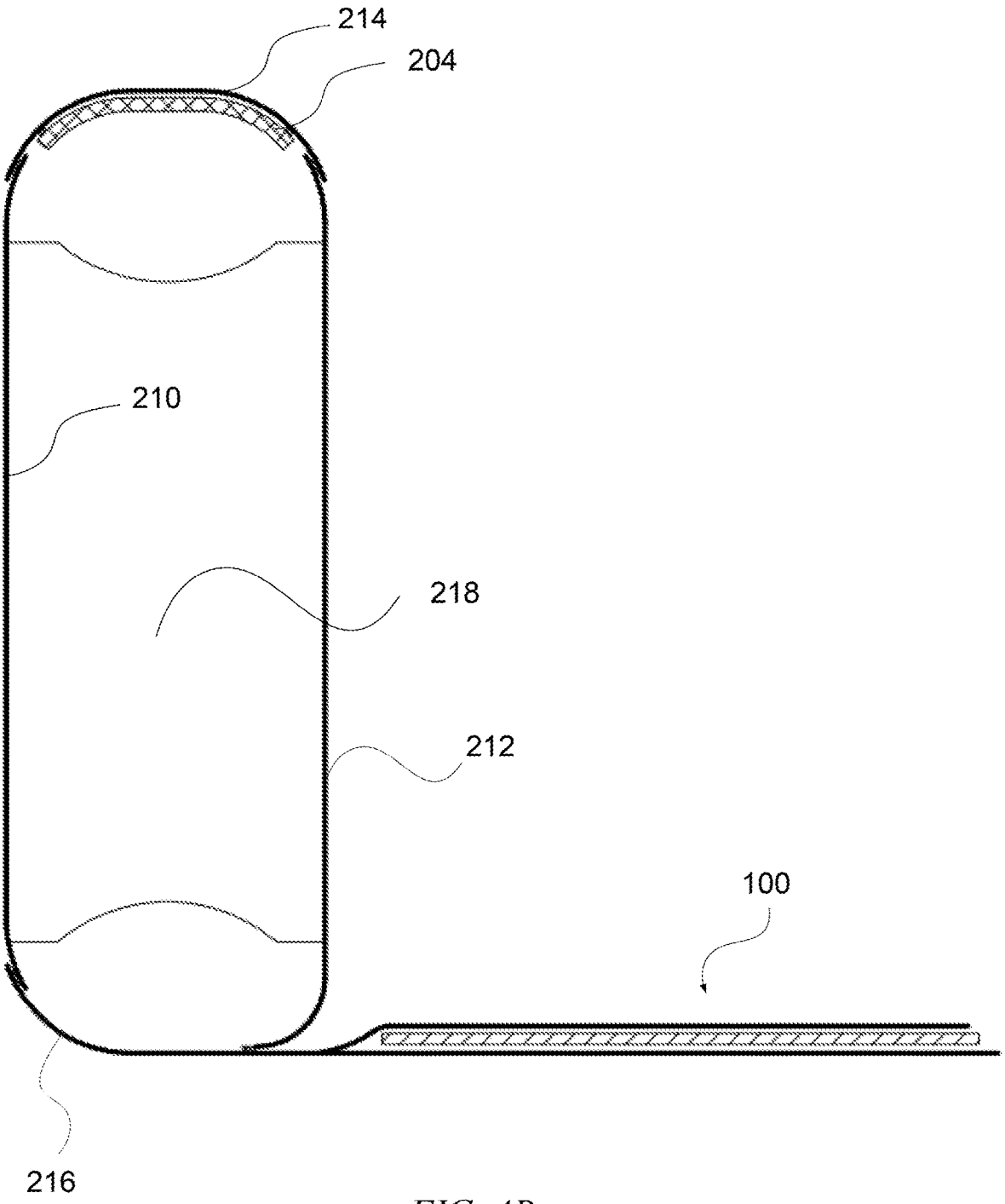
Figure 4C:
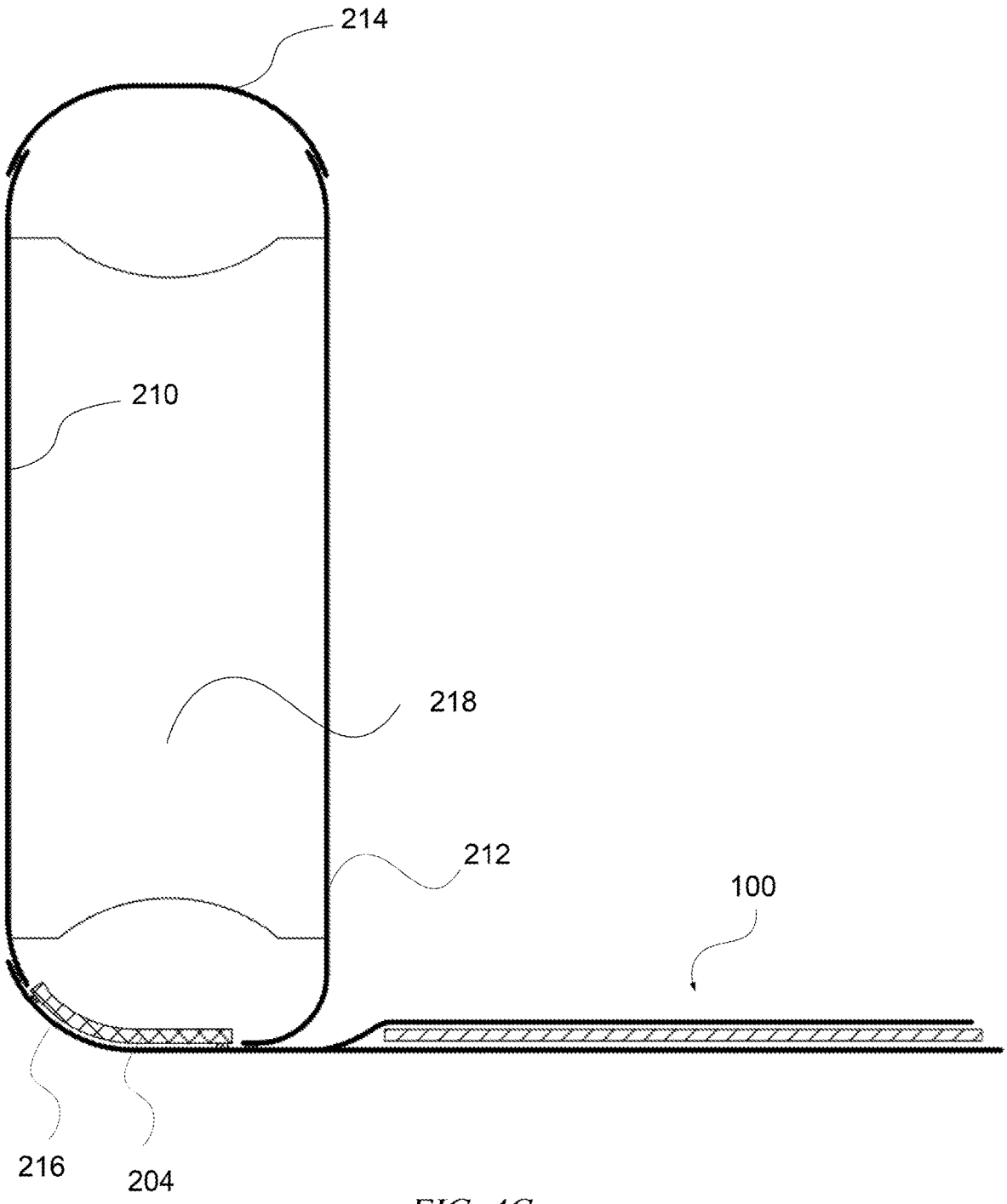
Figure 4D:
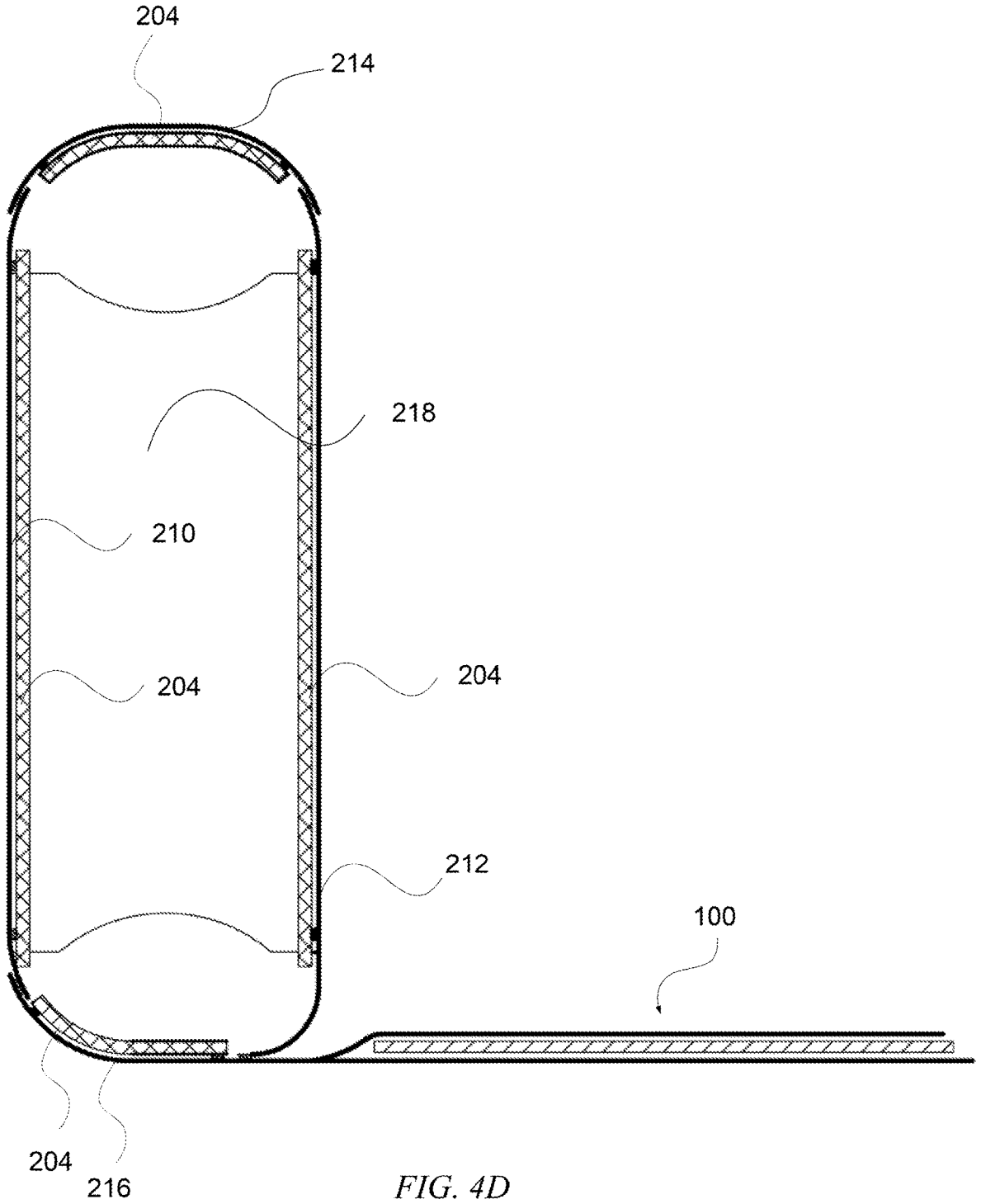

Referring to FIGS. 4B and 4C, in the fourth example aspect and the fifth example aspect of the first example embodiment, the side wall thermal insulation pad 204 is attached to the upper side wall 214 or the lower side wall 216. Optionally, the side wall thermal insulation pad 204 attached to the upper side wall 214 or the lower side wall 216 may be an integral piece as in the second aspect discussed above and extend in the circumferential direction of the inflatable side wall 200, or may comprise a plurality of thermal insulation sections as in the first aspect as discussed above arranged in the circumferential direction of the inflatable side wall 200. The difference to the first aspect is that tensioning members are not provided between two neighboring thermal insulation sections such that a gap between the thermal insulation sections is not required and may be omitted. Optionally, the foregoing examples of FIG. 4A-4C may be implemented in combination with each other as shown in FIG. 4D in the sixth aspect of the first example embodiment, that is, the side wall thermal insulation pad 204 may be arranged at least two inner side walls of the inflatable chamber 202, two or more of the outer enclosing side wall 210, the inner enclosing side wall 212, the upper side wall 214 and the lower side wall 216 of the inflatable side wall 202, and the side wall thermal insulation pad 204 at each position may have a structure of integral piece (second aspect as discussed above) or a structure formed by multiple thermal insulation sections joined together (first aspect as discussed above). For example, a side wall insulation pad 204 may be configured such that it is not provided in the sections in which the respective side walls of the inflatable chamber 202 overlap with each other. In this way, the side wall insulation pad 204 is limited from interfering with the seams formed between two overlapping side walls, which may be formed from sheet-like structures as explained previously.

Figure 5A:
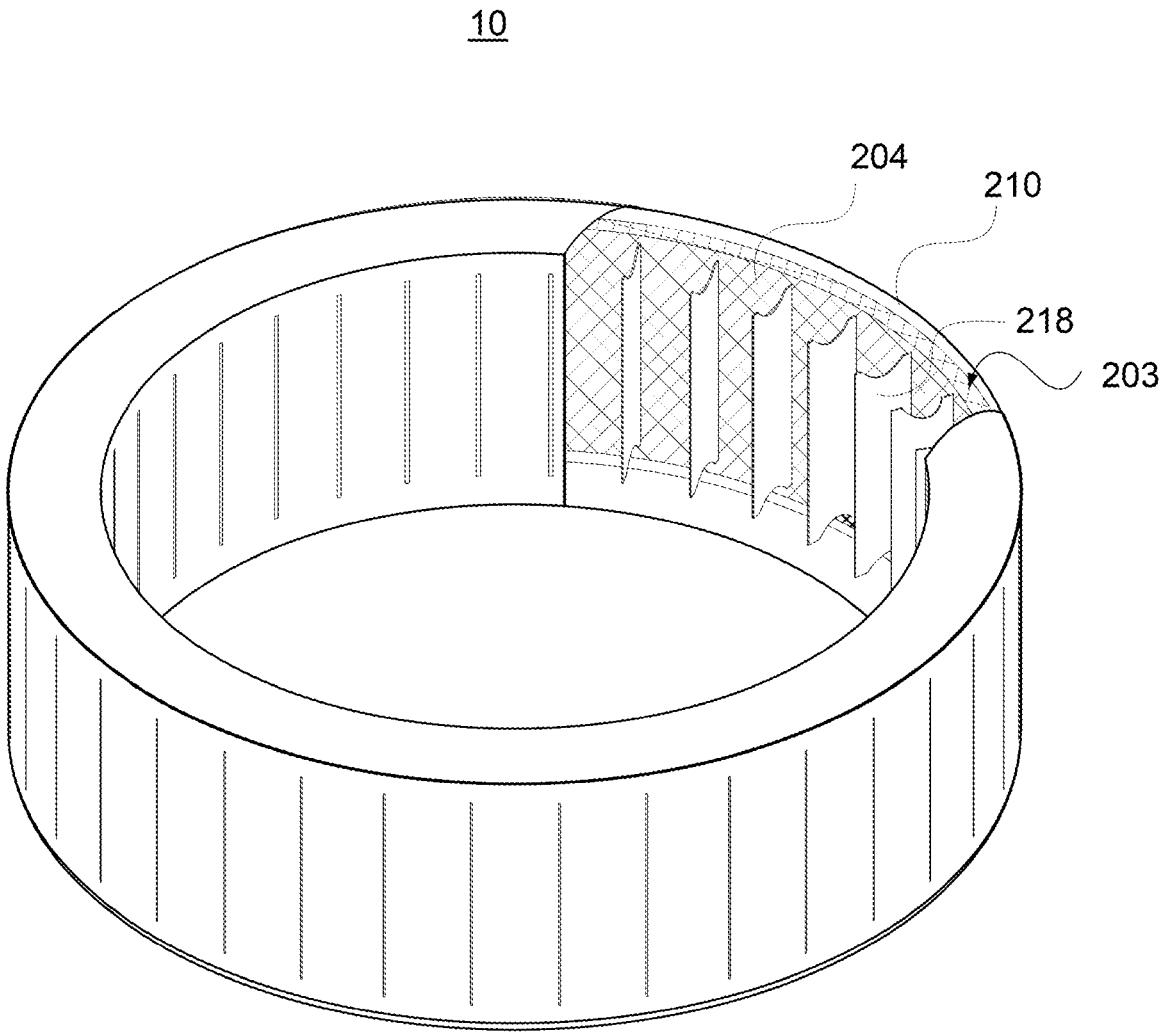
FIG. 5A is a schematic partial sectional view of an inflatable pool having a thermal insulation structure according to another aspect of the first example embodiment.
Figure 5B:
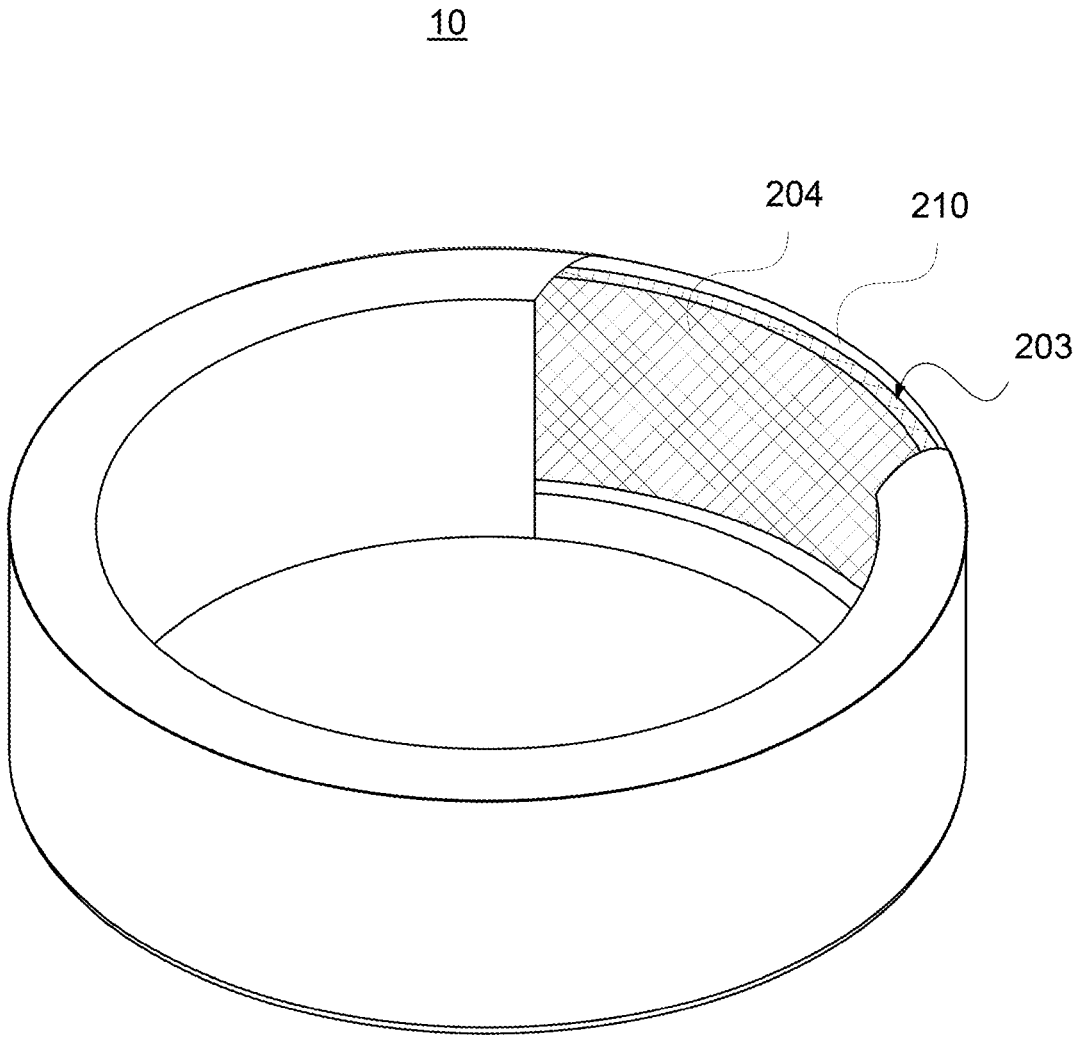
FIG. 5B shows the example embodiment of FIG. 5A with the side wall tension members omitted.
Figure 5C:
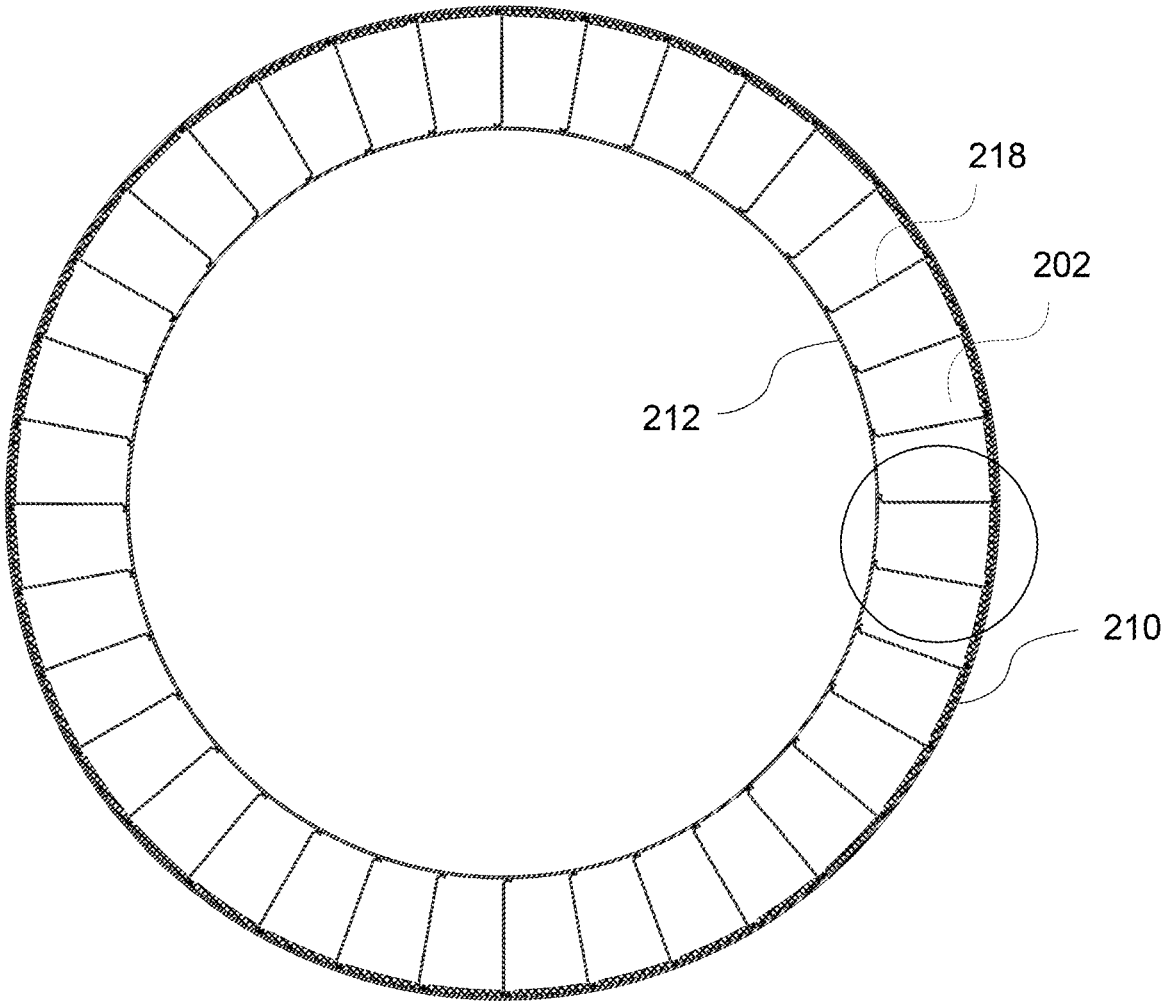
FIG. 5C is a schematic sectional top-view of the inflatable pool of FIG. 5A.
Figure 5D:
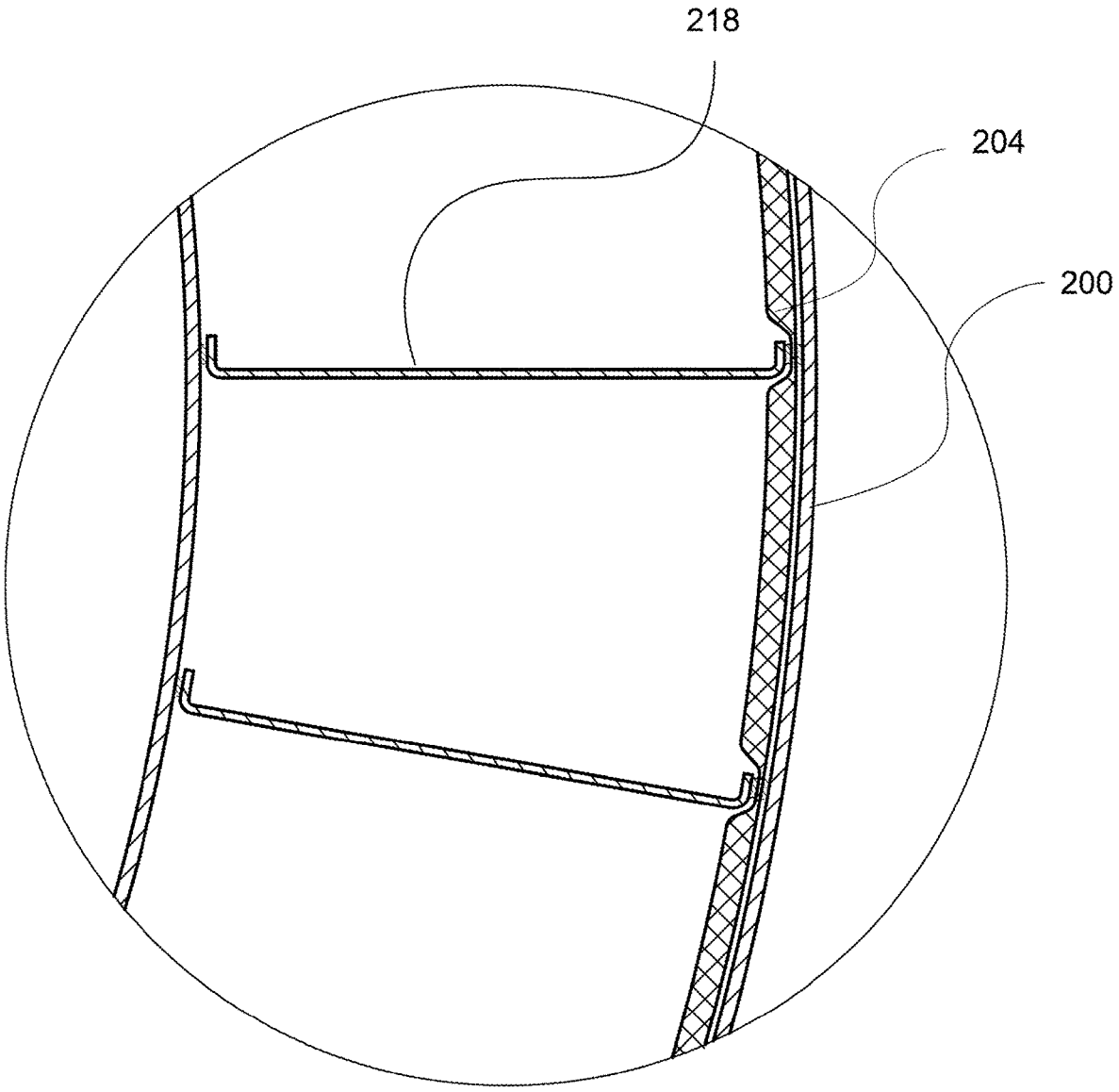
FIG. 5D is a schematic partial enlarged detailed view of the encircled portion of FIG. 5C.

FIG. 5A is a schematic partial sectional view of an inflatable pool having a thermal insulation structure according to a seventh aspect of the first example embodiment. FIG. 5B shows the embodiment of FIG. 5A with the side wall tension members omitted. FIG. 5C is a schematic sectional top-view of the inflatable pool of FIG. 5A. FIG. 5D is a schematic partial enlarged detailed view of the encircled portion of FIG. 5C. Referring to FIGS. 5A to 5D, the side wall thermal insulation pad 204 may be an integral piece but, when compared to FIGS. 3A to 3C, without pad openings 222. In the following, only the differences to the previous aspects are discussed while the disclosure for unchanged features of the other aspects remains valid and is not repeated here. In detail, FIG. 5A shows a seventh aspect of the first example embodiment with the side wall tensioning members 218 connected and the inner enclosing side wall 212 and to the thermal insulation pad 204, which itself is attached to the outer enclosing side wall 210. FIG. 5B illustrates the same example embodiment as FIG. 5A with the side wall tensioning members 218 removed in order to have a clearer view on the structure of the thermal insulation pad 204. The side wall thermal insulation pad 204 covers the circumference of the inner surface of the outer enclosing side wall 210, for example the full circumference, i.e. 360°. Instead of providing pad openings 222 for the side wall tensioning members 218, the side wall tensioning members 218 are directly connected to the inner surface of the thermal insulation pad 204, which is formed as an integral piece in the circumferential direction. For the connection at least one of bonding, sewing, and welding is applied. At least one layer of the thermal insulation pad to which the side wall tensioning members 218 are connected may be formed of a weldable material. The layered thermal insulation pad 204 further comprises the previously discussed thermal insulation materials. As shown in FIG. 5D, the width of the thermal insulation pad 204 at the connections to the side wall tensioning members 218 may be decreased such that the side wall tensioning members 218 could be attached to the thermal insulation pad 204 and the outer enclosing sheet 210 at the same time. However, the width of the thermal insulation pad 204 may also be constant such that the side wall tensioning members 218 are only directly connected to the thermal insulation pad 204.

In an example embodiment, only a few thermal insulation sections 220 are provided, e.g. two or four thermal insulation sections 220 arranged to extend around the circumference of the inner side of the outer enclosing side wall 220. In this example embodiment, some of the side wall tensioning members 218, e.g. in the example two or four, may be provided in gaps between neighboring thermal insulation sections 220, as previously described, while other side wall tensioning members 218 may be provided directly connected to inner surface of the side wall tensioning members 218 as described for the previous seventh example aspect.

Figure 6A:
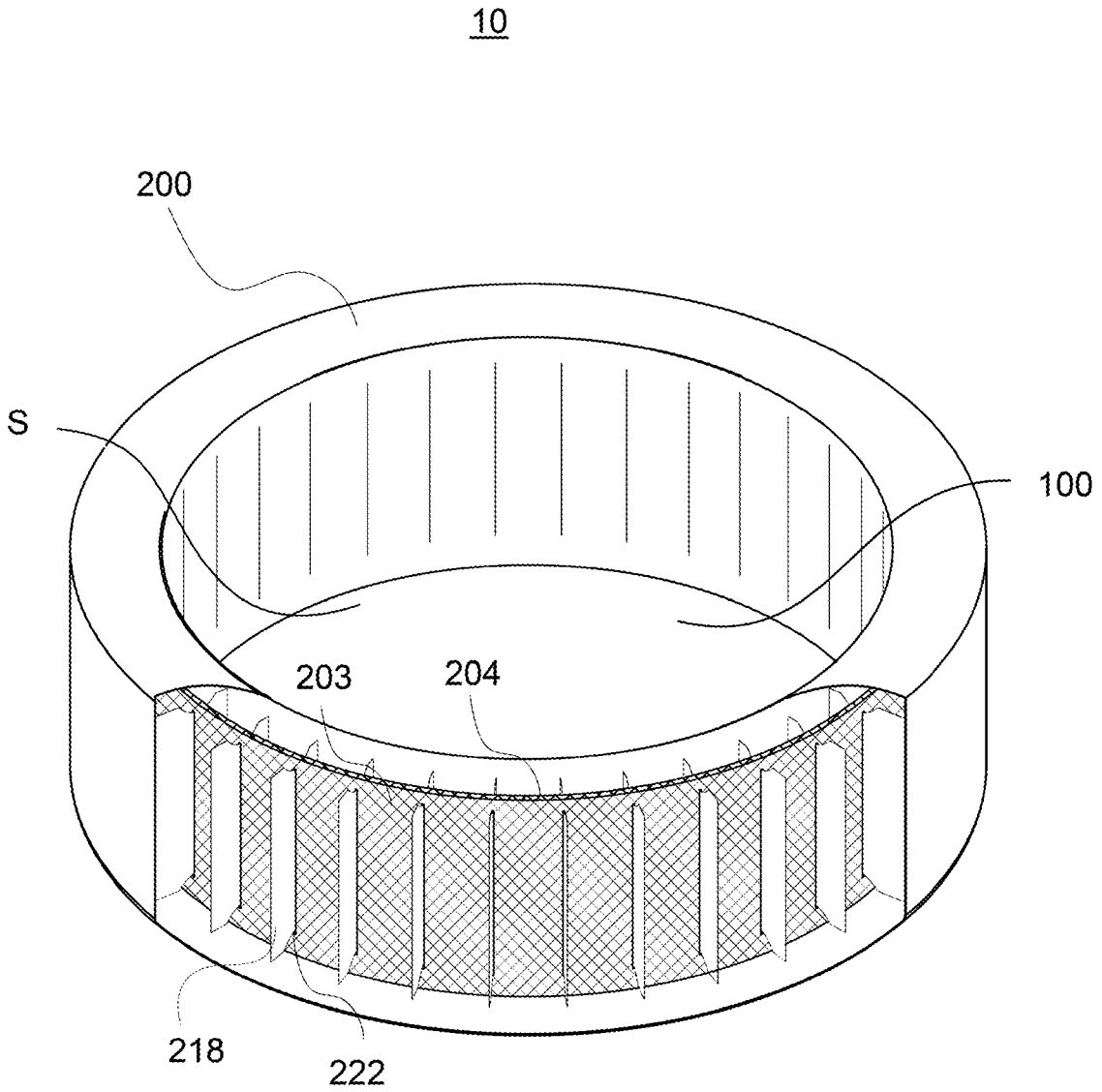
FIG. 6A is a schematic partial sectional view of an inflatable pool having a thermal insulation structure according to another aspect of the first example embodiment.
Figure 6B:
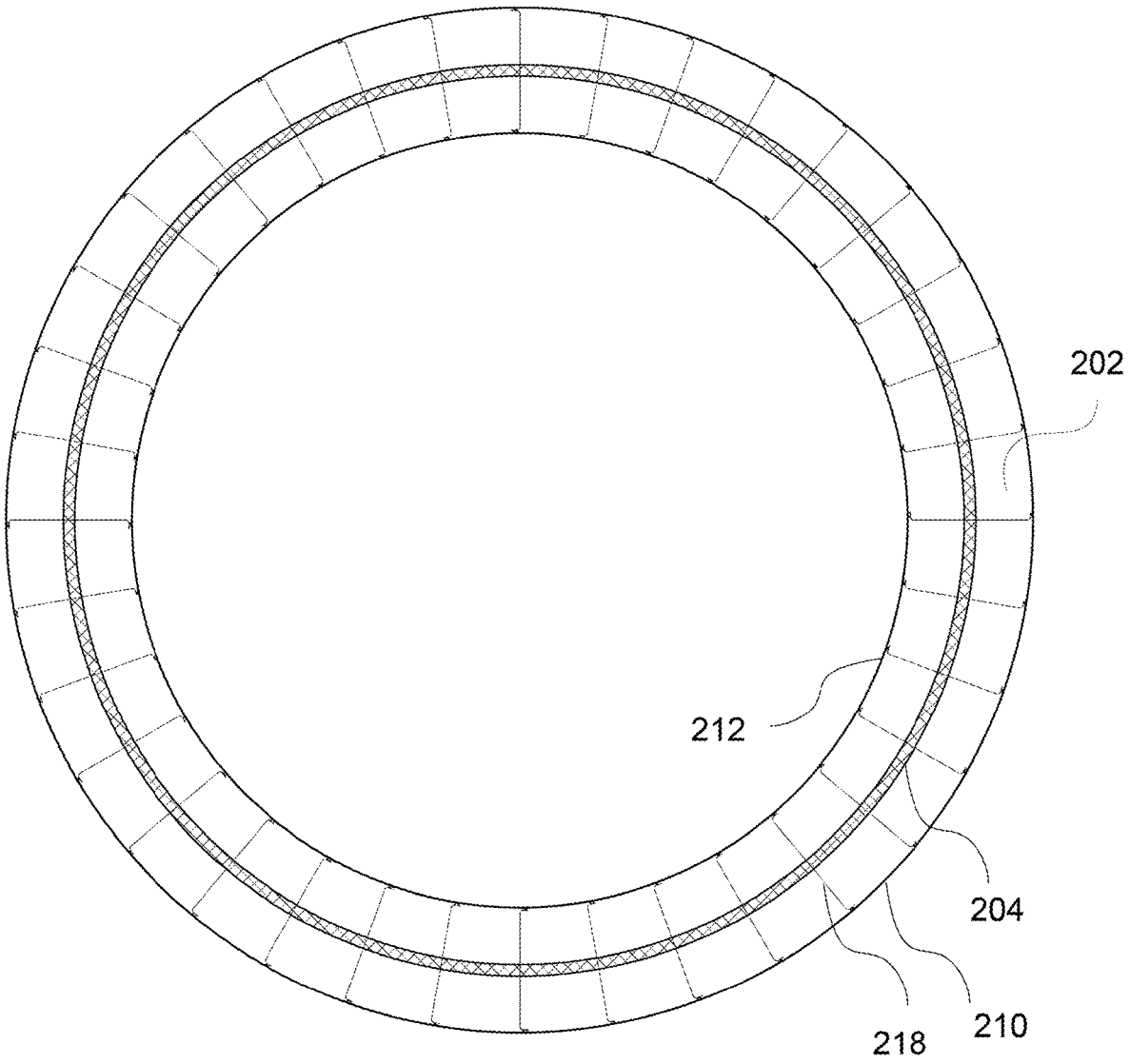
FIG. 6B is a schematic sectional top-view of the inflatable pool in FIG. 6A.
Figure 6C:
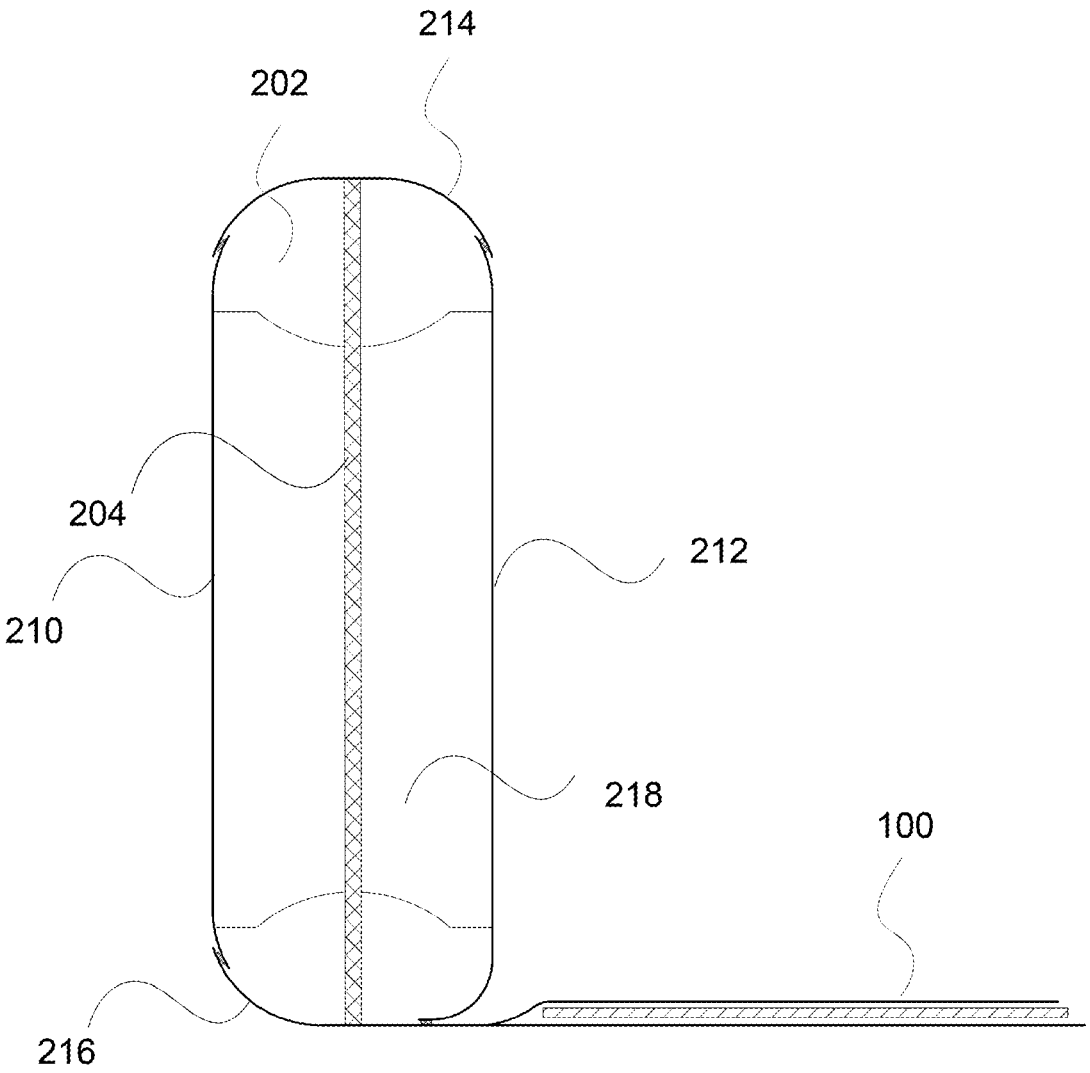
FIG. 6C is a schematic partial sectional side-view of the inflatable pool in FIG. 6A.

FIG. 6A is a schematic partial sectional view of an inflatable pool having a thermal insulation structure according to an eighth aspect of the first example embodiment. FIG. 6B is a schematic sectional top-view of the inflatable pool in FIG. 6A. FIG. 6C is a schematic partial sectional side-view of the inflatable pool in FIG. 6A. The eight aspect of the first example embodiment differs from the previous aspect in the that the thermal insulation pad 204 is spaced apart from the inner enclosing side wall 212 and the outer enclosing side wall 210. In the following, the differences to the previous aspects are discussed while the disclosure for unchanged features of the other aspects remains valid and is not repeated here. Referring to FIG. 6A, the difference of the eighth example aspect of the first example embodiment with respect to previous aspects is that the top edge and the bottom edge of the side wall thermal insulation pad 204 are respectively connected to the upper side wall 214 and the lower side wall 216 by means of, for example, welding or bonding or by any of the previously described fixation methods. The side wall thermal insulation pad 204 is an integral piece and extends in the circumferential direction of the inflatable side wall 200, and the side wall thermal insulation pad 204 comprises a plurality of elongated pad openings 222, each pad opening 222 being sized and otherwise configured to enable the corresponding side wall tensioning member 218 to pass therethrough. In the example embodiment as shown, the distance between the side wall thermal insulation pad 204 and the outer enclosing side wall 210 is substantially equal to the distance between the side wall thermal insulation pad 204 and the inner enclosing side wall 212. It can be understood that, in other example embodiments, the side wall thermal insulation pad 204 may also be arranged closer to the outer enclosing side wall 210 or closer to the inner enclosing side wall 212. For example, the thermal insulation pad 204 is located in a space around the middle section between the inner and the outer enclosing side wall 212, 210+/−10% of the spacing between the inner and the outer enclosing side wall 212, 210. As described previously, the height of the thermal insulation pad 204 is larger than the height of the side wall tensioning members 218 such that the side wall tensioning members 218 can pass through pad openings 222 formed within the thermal insulation pad 204. FIG. 6B shows a horizontal cut through the inflatable pool which demonstrates the formation of the thermal insulation pad 204 in the middle of the inflatable chamber 202 instead of at the respective inner or outer borders of the inflatable chamber 202. FIG. 6C is a vertical cut through the inflatable chamber 202 showing that the thermal insulation pad 204 is provided within the inflatable chamber but spaced apart from the outer and inner enclosing side walls 210, 212 and attached to the upper and lower side walls 214, 216.

Figure 7A:
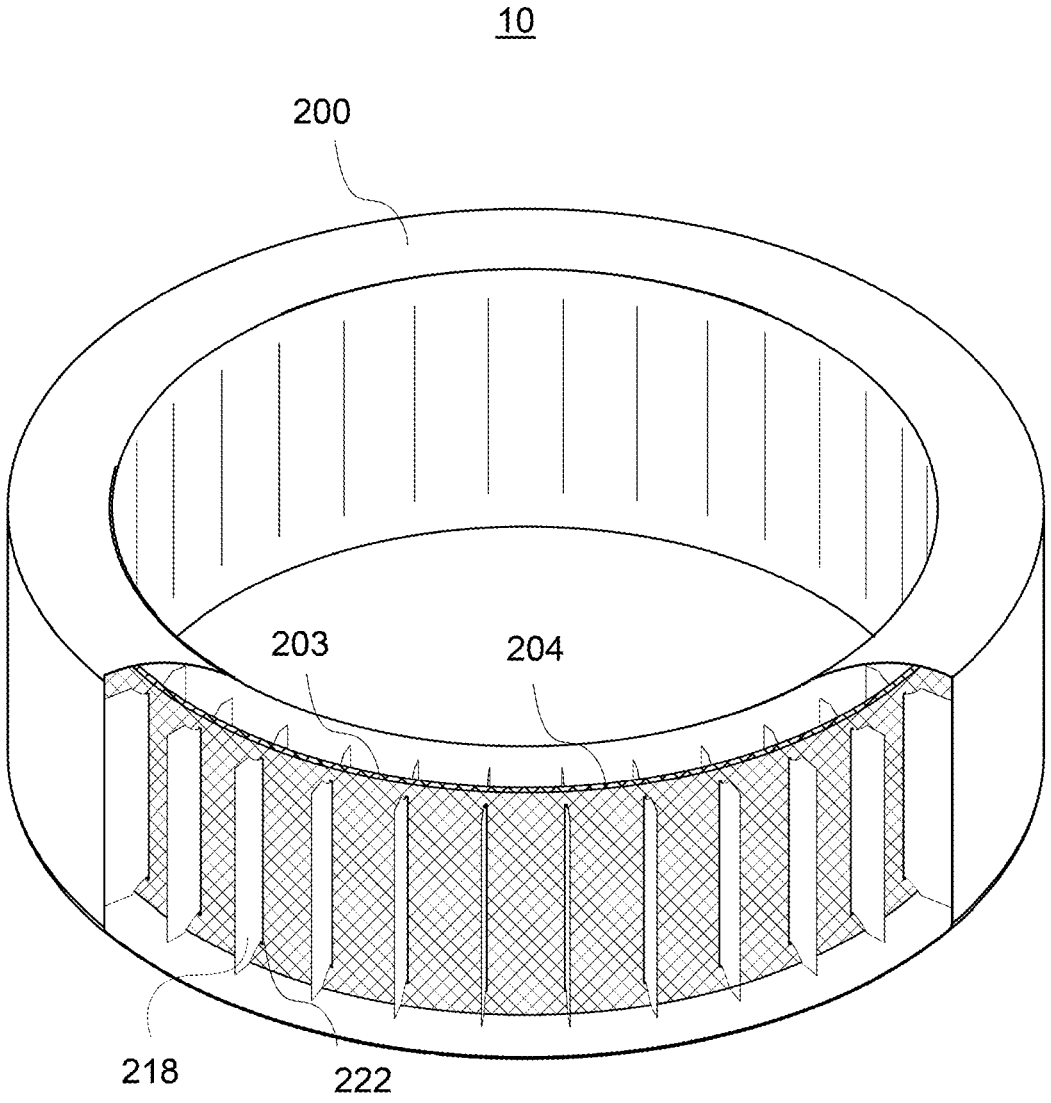
FIG. 7A is a schematic partial sectional view of an inflatable pool having a thermal insulation structure according to another aspect of the first example embodiment.
Figure 7B:
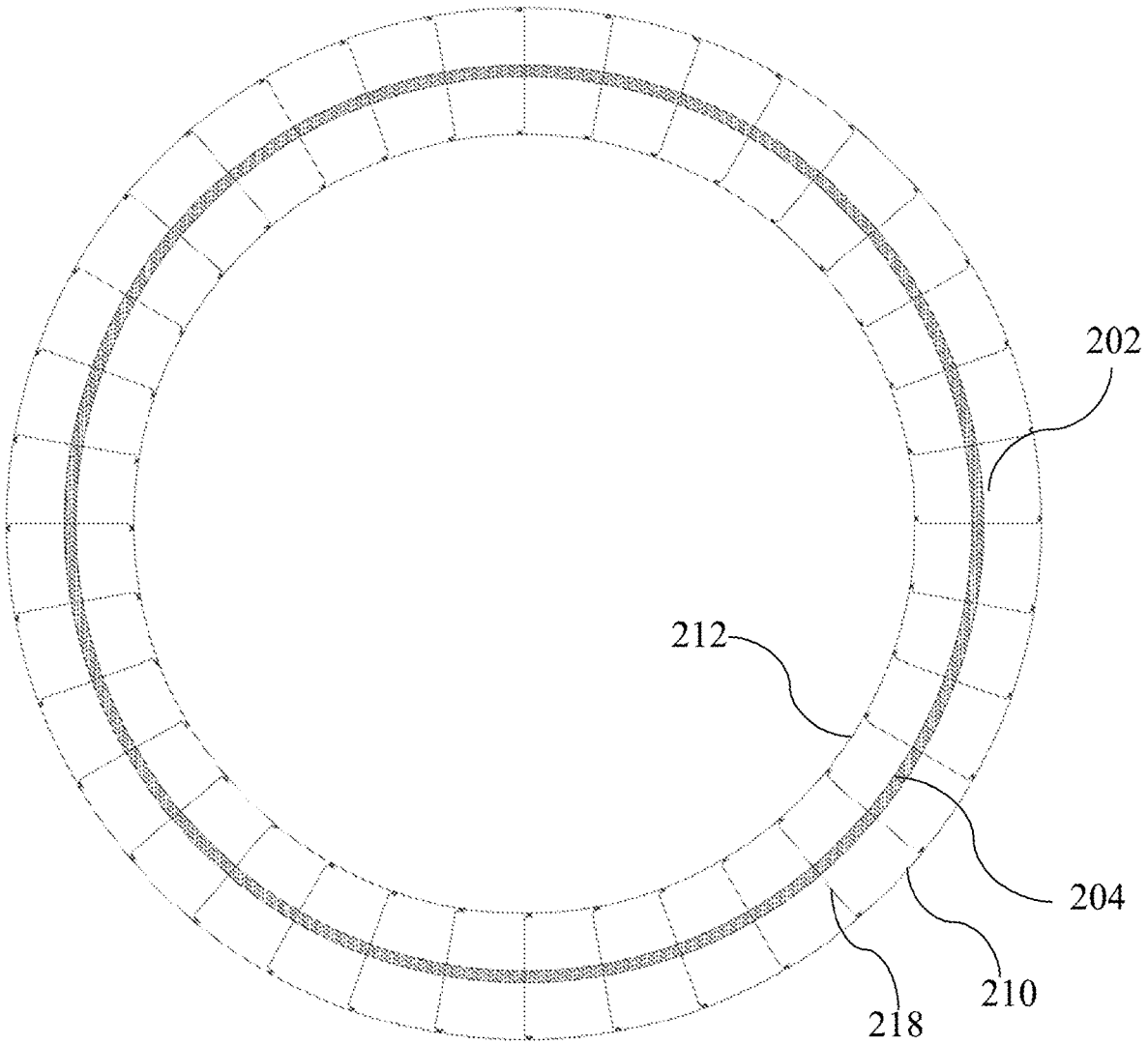
FIG. 7B is a schematic sectional top-view of the inflatable pool of FIG. 7A.
Figure 7C:
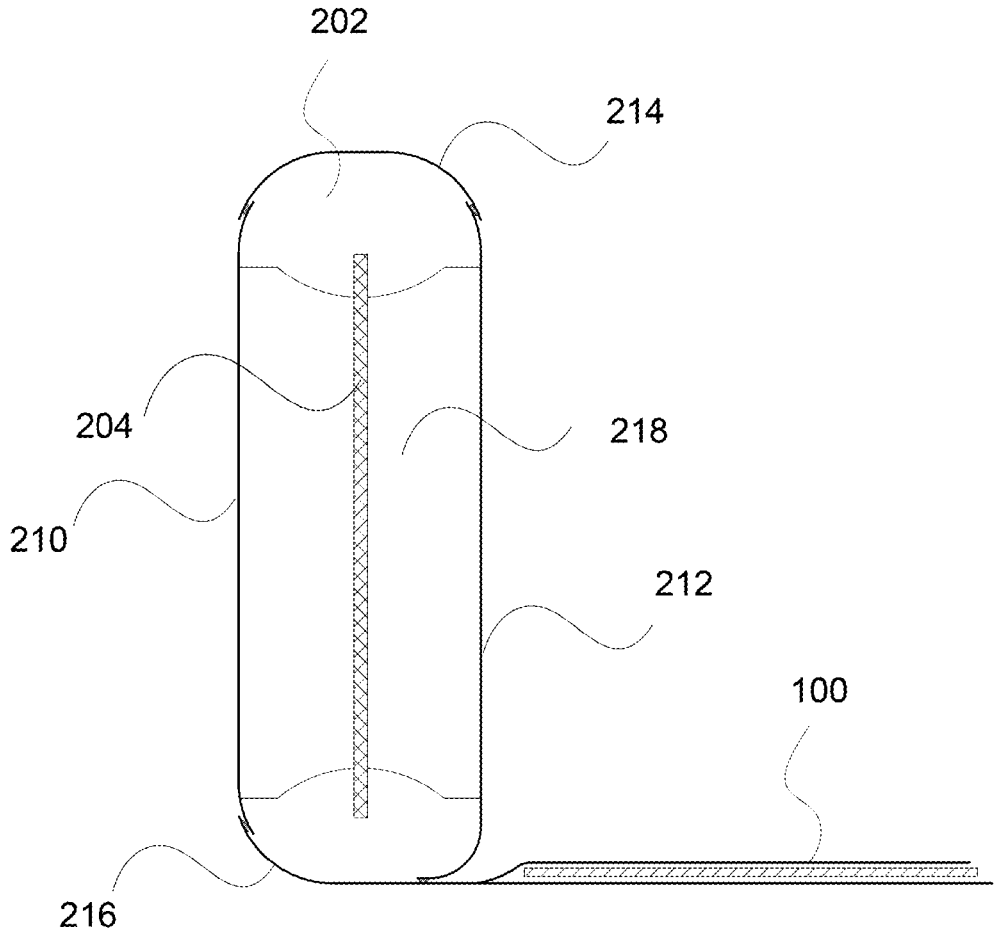
FIG. 7C is a schematic partial sectional side-view of the inflatable pool in FIG. 7A.

FIG. 7A is a schematic partial sectional view of an inflatable pool having a thermal insulation structure according to a ninth aspect of the first example embodiment. FIG. 7B is a schematic sectional top-view of the inflatable pool of FIG. 7A. FIG. 7C is a schematic partial sectional side-view of the inflatable pool in FIG. 7A. Referring to FIGS. 7A to 7C, in the ninth example aspect of the first example embodiment, the side wall thermal insulation pad 204 is an integral piece and extends in the circumferential direction of the inflatable side wall 200, and the side wall thermal insulation pad 204 comprises a plurality of elongated pad openings 222, each pad opening 222 being sized and otherwise configured to enable the corresponding side wall tensioning member 218 to pass therethrough. As visible from FIG. 7C, this aspect of the first example embodiment differs from the previous aspect in that the top edge and the bottom edge of each side wall thermal insulation pad 204 are respectively spaced apart from the upper side wall 214 and the lower side wall 216, but not connected to the upper side wall 214 and the lower side wall 216. Only the differences to the previous aspects are discussed while the disclosure for unchanged features of the other aspects remains valid and is not repeated here. The side wall thermal insulation pad 204 is provided hanging on the plurality of side wall tensioning members 218 and thereby held in the inflatable chamber 202 without attachment to the inner walls of the inflatable chamber 202. The pad openings 222 may have a shape such that parts of the side wall tensioning members 218 pass therethrough, for example a form-fit shape. The tensioning members 218 may be provided with a section of varying height with the shortest height being provided in the middle section of the tensioning members 218, as shown in FIG. 7C, such that the side wall thermal insulation pad 204 does not move within the inflatable chamber 202 after inflation. As shown in FIG. 7A, in the example embodiment as shown, each pad opening 222 may extend to the bottom edge of the side wall thermal insulation pad 204, such that one longitudinal end of the pad opening 222 is open to allow the side wall tensioning member 218 to pass through the pad opening 222.

Figure 8A:
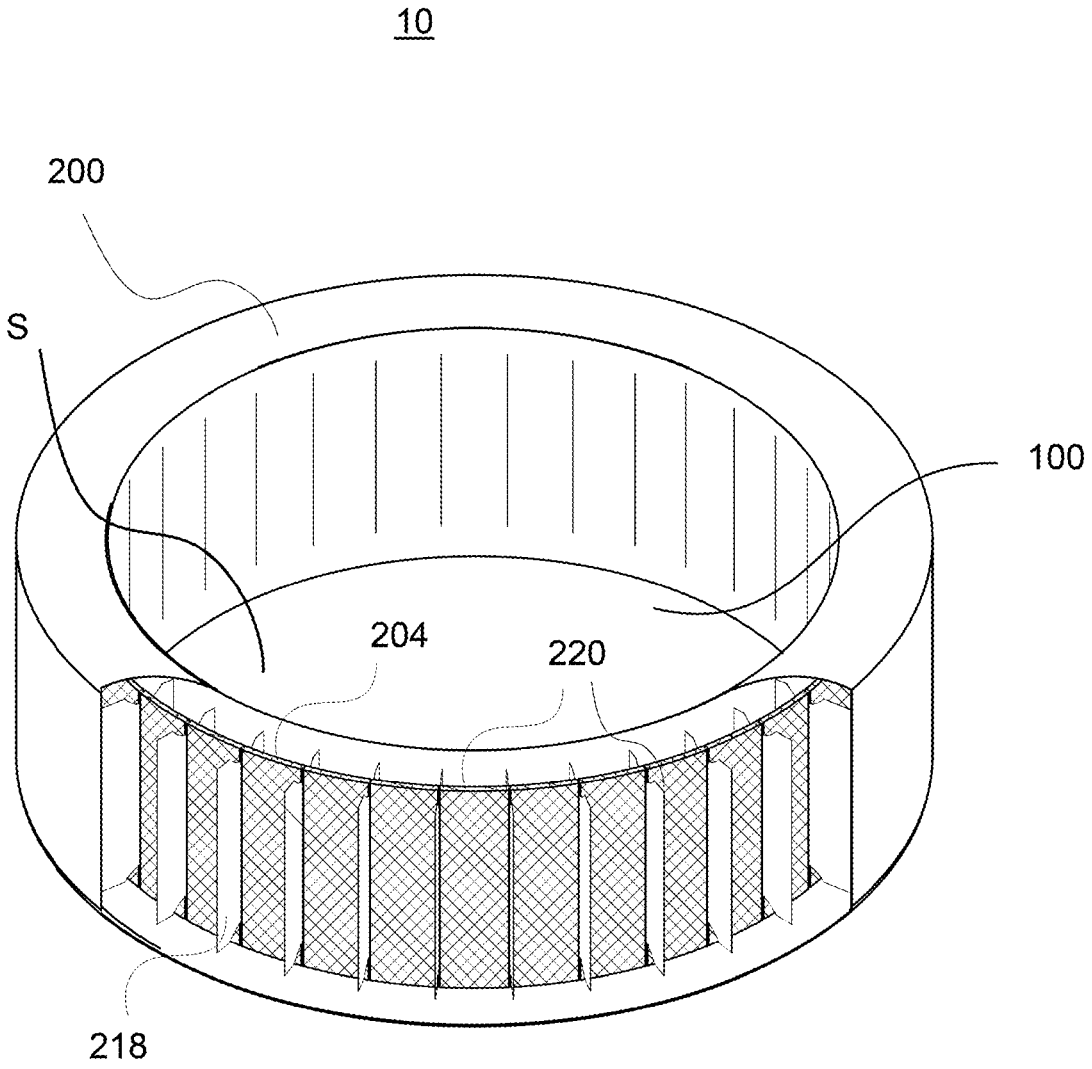
FIG. 8A is a schematic partial sectional view of an inflatable pool having a thermal insulation structure according to another aspect of the first example embodiment.
Figure 8B:
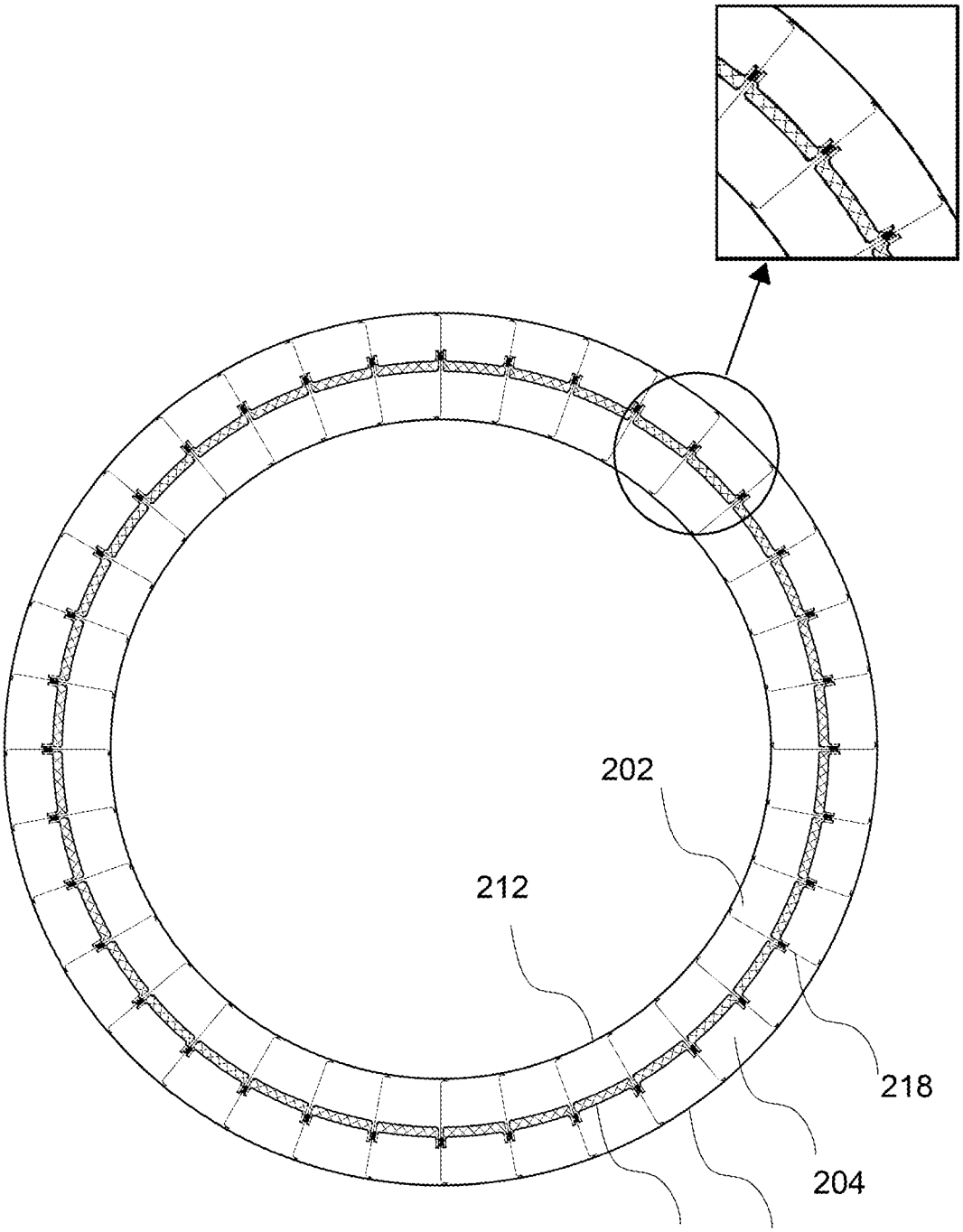
FIG. 8B is a schematic sectional top-view of the inflatable pool in FIG. 8.
Figure 8C:
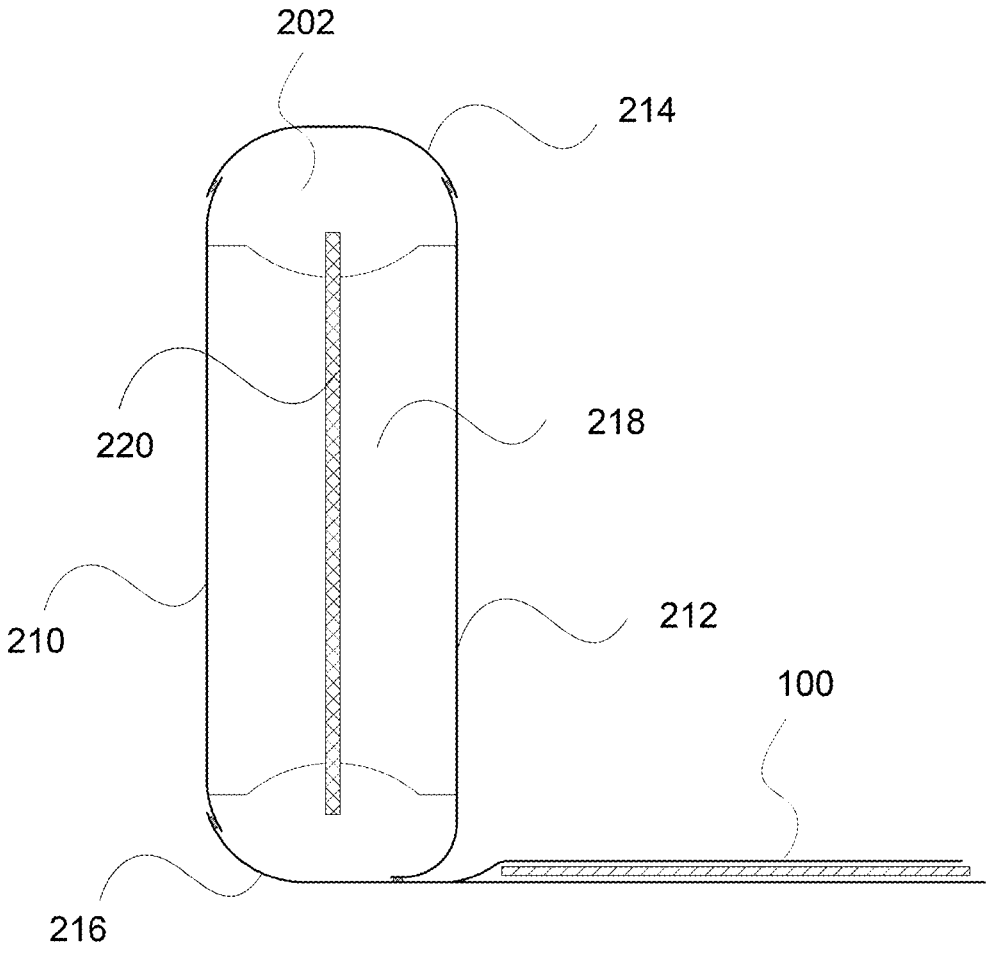
FIG. 8C is a schematic partial sectional side-view of the inflatable pool in FIG. 8.

FIG. 8A is a schematic partial sectional view of an inflatable pool having a thermal insulation structure according to a tenth aspect of the first example embodiment. FIG. 8B is a schematic sectional top-view of the inflatable pool in FIG. 8A. FIG. 8C is a schematic partial sectional side-view of the inflatable pool in FIG. 8A. Referring to FIGS. 8A to 8C, in difference to the previously described ninth aspect, in the tenth example aspect of the first example embodiment, the side wall thermal insulation pad 204 comprises a plurality of thermal insulation sections 220 arranged at intervals in the circumferential direction of the inflatable side wall 200. Only the differences to the previous aspects are discussed while the disclosure for unchanged features of the other aspects remains valid and is not repeated here. Each thermal insulation section 220 is arranged between the two adjacent side wall tensioning members 218, and two side edges of each thermal insulation section 220 may be respectively fixed to the two adjacent side wall tensioning members 218 by means of, for example, sewing, welding, or bonding. In the top right corner of FIG. 8B, details of the example embodiment are shown. For instance, each thermal insulation section 220 of the pad 204 may have two shorter sections extending parallel to a tensioning member 218 and a longer section interconnecting these two shorter sections and extending between the tensioning members 218. The two shorter sections are connected to the tensioning members 218. The thermal insulation sections may have a C-shape, a Z-shape, a bracket shape etc.

It can be understood that the side wall thermal insulation pad 204 may be arranged in a way and is not limited to those example arrangements as shown in FIGS. 1A to 8C. For example, the side wall thermal insulation pad 204 may be arranged on two or more of the outer enclosing side wall 210, the inner enclosing side wall 212, the upper side wall 214, the lower side wall 216, and the side wall tensioning member 218, and may thereby achieve a better thermal insulation effect. The side wall thermal insulation pad 204 in the previously-described figures is an element distinct from the inner wall of the inflation chamber 202 and attached to the respective inner wall of the inflation chamber 202.

It can be understood that, instead of providing the side wall thermal insulation pad, the inner surface of the inflatable chamber 202 may be coated with a side wall thermal insulation coating; or the side wall thermal insulation pad and the side wall thermal insulation coating may be used in combination. For example, the side wall thermal insulation pad may be arranged on the outer enclosing side wall 210, while the inner enclosing side wall 212 is coated with the side wall thermal insulation coating. The side wall thermal insulation coating may be a coating formed of a coating material composed of ingredients with low thermal conductivity and high thermal resistance. Any one or more of the outer enclosing side wall 210, the inner enclosing side wall 212, the upper side wall 214, and the lower side wall 216 may be coated with the side wall thermal insulation coating. Optionally and alternatively to the side wall thermal insulating coating, a thermal insulating sheet, in particular a thermally reflecting layer comprising a metal layer or foil, for instance an aluminum foil may be provided on an inner surface of the inflatable chamber 202.

Figure 9:
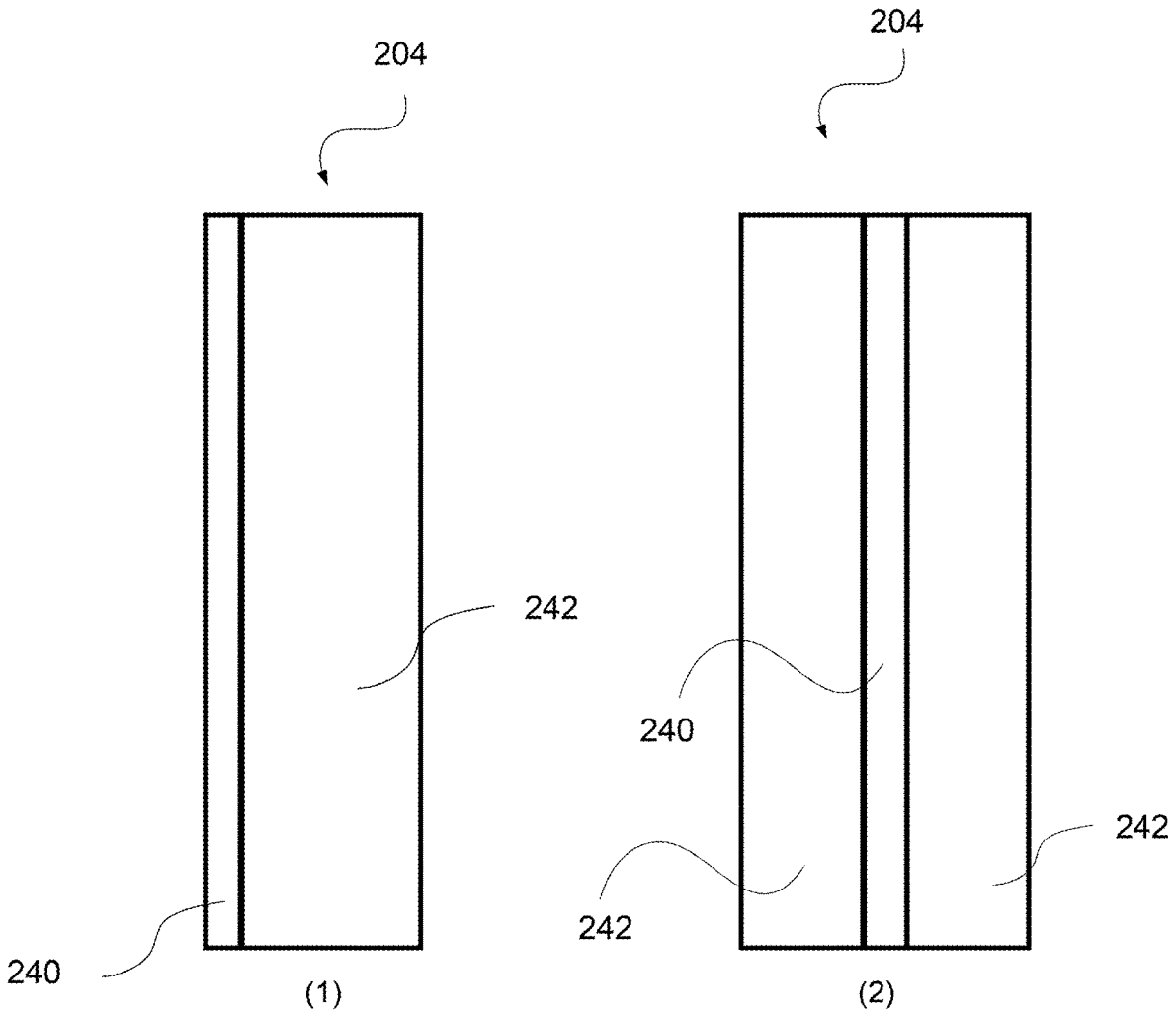
FIG. 9 is a schematic sections side-view of a thermal insulation pad according to one or more example embodiments.

Any side wall thermal insulation pad 204 described herein may have a layered structure as shown in FIG. 9. FIG. 9 is a schematic sections side-view of a thermal insulation pad 204 according to one or more example embodiments. One layer of a thermal insulation pad 204 may be formed of a thermal radiation reflecting layer 240, for instance comprising a metal foil such as an aluminum foil. The thermal radiation reflective layer 240 may include a polymer base layer coated with a metal coating layer such as an aluminum layer.

In at least one further layer 242, the thermal insulation pad 204 may comprises a weldable material, a thermal insulation material, fiber wadding (e.g., polyester wadding and acrylic wadding), foam (e.g., polyethylene foam and polyurethane foam), mineral wool, cellulose, fleece and/or aerogel or other insulating materials. The thermal radiation reflecting layer 240 may be formed as an outer layer of the side wall insulation pad 204 facing the water holding space S. In this configuration, the thermal radiation reflecting layer 240 reflects thermal radiation back into the inflatable chamber 202 and back to the water holding space S to thereby provide thermal insulation. By locating the thermal radiation reflecting layer 240 on a face of the thermal insulation pad 204 facing away from the face attached to the outer enclosing wall 210, the thermal insulation pad 204 may remain attachable to the outer enclosing side wall by bonding, e.g. gluing, welding, sewing, hanging, etc. Similarly, the thermal reflecting layer 240 may also be an inner layer of the layered structure, e.g. in FIG. 9 (2) a center layer, the side wall thermal insulation pad 204 being attached to an inner side wall of the thermal insulation chamber 202 by means of bonding, e.g. gluing, welding, sewing, hanging, etc. It may also be formed as an outer layer or a partial outer layer of the layered structure attached to an inner side wall of the thermal insulation chamber 202 by means of bonding, e.g. gluing, sewing, hanging, etc. If the thermal radiation insulation layer 240 is only provided on parts of the side wall thermal insulation pad 204, this part being not directly attached to an inner wall of the inflatable chamber 202, the attachment can be formed by means of bonding, e.g. gluing, welding, sewing, hanging, etc.

The first example embodiment was described with reference to FIG. 1-9. Features common to the aspects of this example embodiment are referenced with the same reference numbers. For the different aspects, only the difference of an aspect with respect to the other aspects where described, where all common elements and their disclosure remain valid for the different aspects, if applicable.

Figure 10:
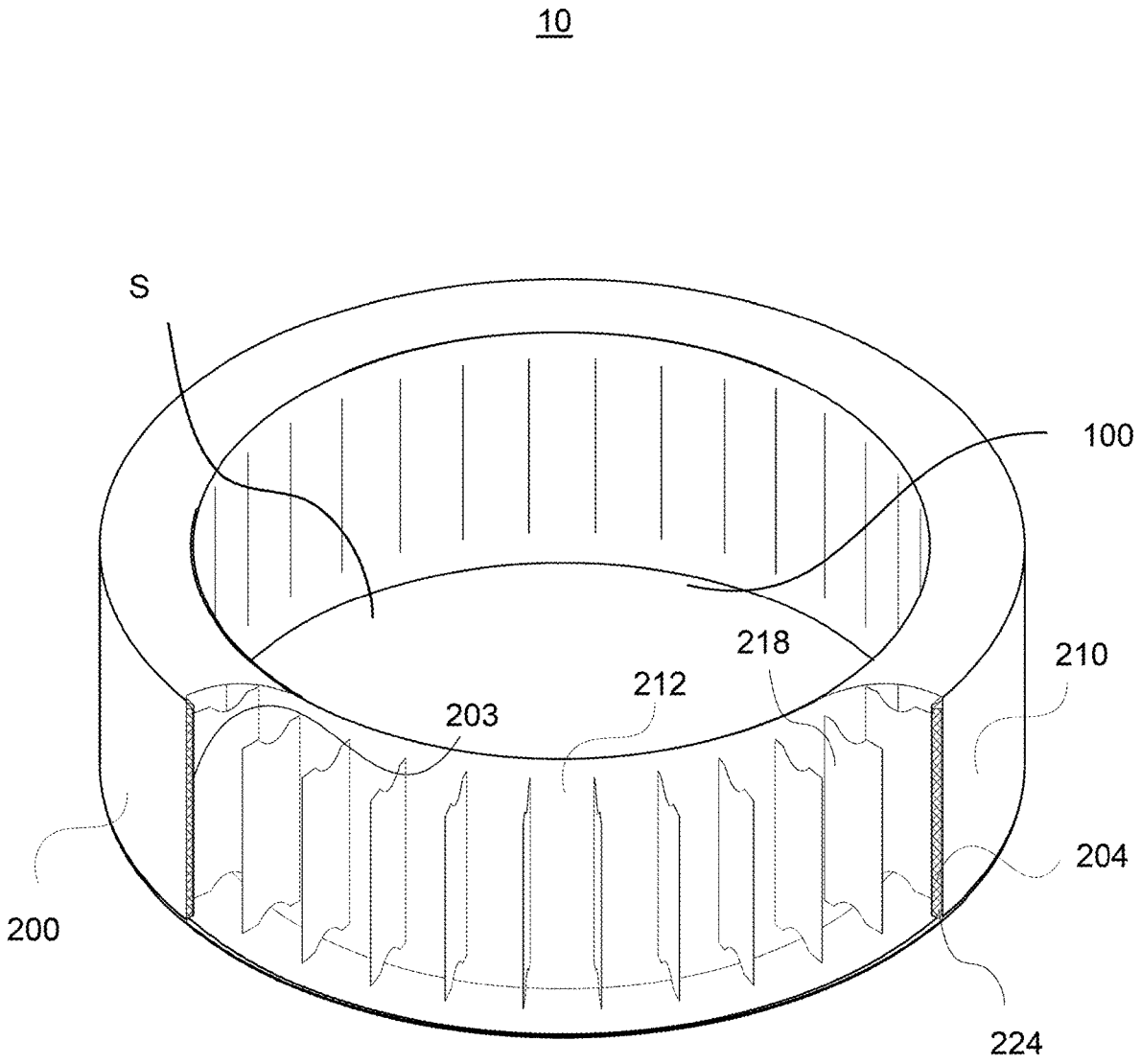
FIG. 10 is a schematic partial sectional view of an inflatable pool having a thermal insulation structure according to an aspect of a second example embodiment.
Figure 11A:
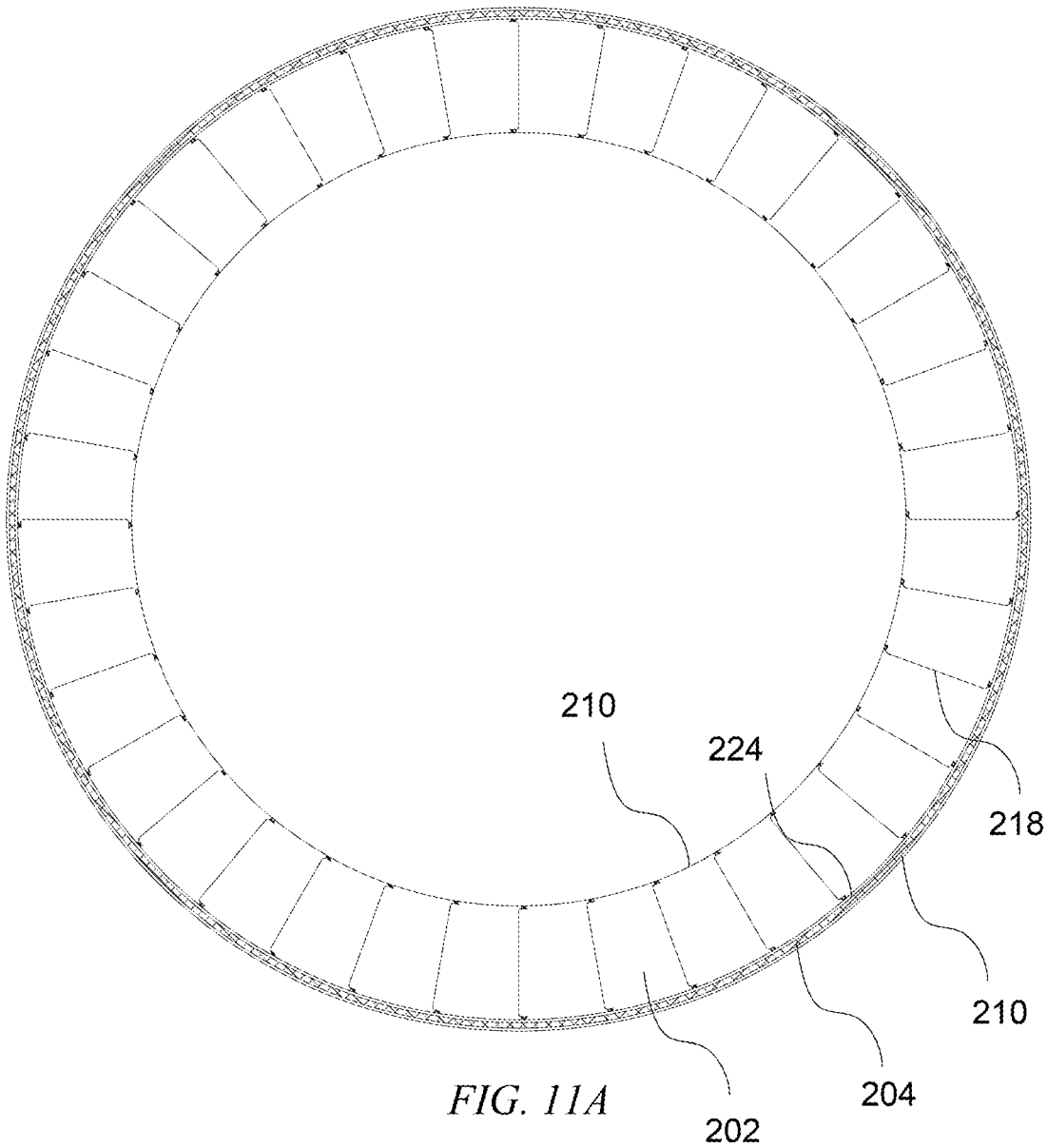
FIG. 11A is a schematic sectional top-view of the inflatable pool in FIG. 10.
Figure 11B:
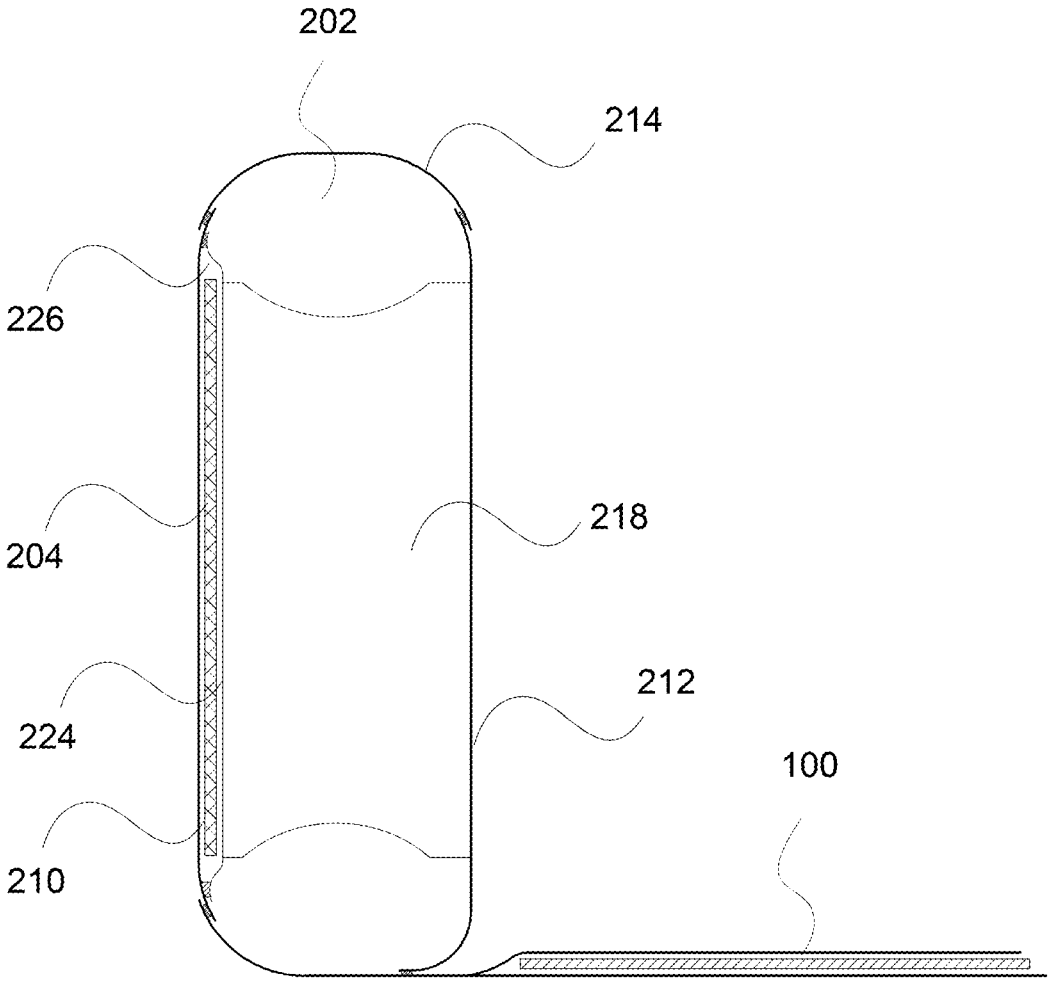
FIG. 11B is a schematic partial sectional side-view of the inflatable pool in FIG. 10.
Figure 12:
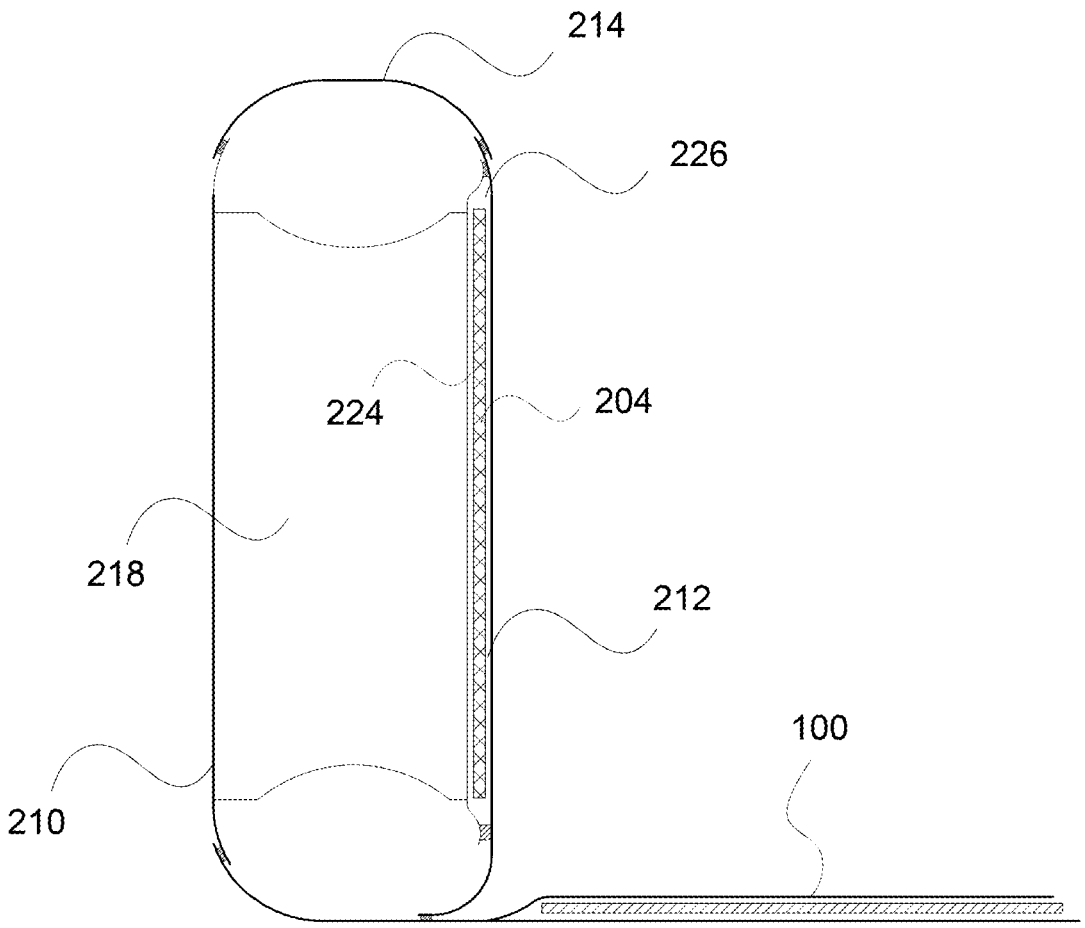
FIG. 12 is a schematic sectional view of an inflatable pool having a thermal insulation structure according to another aspect of the second example embodiment.

FIG. 10 is a schematic partial sectional view of an inflatable pool having a thermal insulation structure according to a first aspect of a second example embodiment. FIG. 11A is a schematic sectional top-view of the inflatable pool in FIG. 10. FIG. 11B is a schematic partial sectional side-view of the inflatable pool in FIG. 10. FIG. 12 is a schematic sectional view of an inflatable pool having a thermal insulation structure according to a second aspect of the second example embodiment. FIGS. 10 to 12 show an inflatable pool having a thermal insulation structure according to the second example embodiment. The difference between the inflatable pool according to the second example embodiment and the inflatable pool according to the first example embodiment lies in the attachment manner of the side wall thermal insulation pad 204. In the second example embodiment, the side wall thermal insulation pad 204 is attached to the inflatable side wall 200 by means of a wrapping sheet 224.

Referring to FIGS. 10 to 11B, in the first example aspect of the second example embodiment, the wrapping sheet 224 is arranged in the inflatable chamber 202 of the inflatable pool 10. As visible in FIG. 11B, the wrapping sheet 224 is connected to the outer enclosing side wall 210 to jointly define an accommodating chamber 226 for accommodating the side wall thermal insulation pad 204, and each side wall tensioning member 218 is connected, for example directly connected to the wrapping sheet 224 and the inner enclosing side wall 212.

In the example embodiment as shown, both, the side wall thermal insulation pad 204 and the wrapping sheet 224, extend in the circumferential direction of the inflatable side wall 200. The disclosure of the first example embodiment with respect to the dimensions of the thermal insulation pad 204, its structure and materials remain applicable. The narrow accommodating chamber 226 is formed between the wrapping sheet 224 and the outer enclosing side wall 210, such that the side wall thermal insulation pad 204 is attached to the inflatable side wall 200. The wrapping sheet 224 may further serve as a thermal barrier while fixing the thermal insulation pad 204. Optionally, the wrapping sheet 224 may form an inner surface of the inflatable chamber 202. Then, the pressure of the inflatable chamber acts on the wrapping sheet, and thereby onto the thermal insulation pad 204 to hold it into place.

In some example embodiments, the wrapping sheet 224 may be made of at least one of PVC, PU, a laminated PVC mesh material, a laminated PU mesh material, and a TPU composite material or other suitable materials; and the wrapping sheet 224 may be, for example, welded to the outer enclosing side wall 210. It can be understood that, in some example embodiments, in order to reinforce the fixation of the side wall thermal insulation pad 204 to the outer enclosing side wall 210, the side wall thermal insulation pad 204 may be further attached to the outer enclosing side wall 210 by means of welding or bonding. The face of the wrapping sheet 224 facing the interior of the inflatable chamber 202 may be formed or covered by a thermal radiation reflecting layer, e.g. comprising a metal layer such as an aluminum foil.

Referring to FIG. 12, in the second example aspect of the second example embodiment, the wrapping sheet 224 may be connected to the inner enclosing side wall 212 to jointly define an accommodating chamber 226 for accommodating the side wall thermal insulation pad 204, and each side wall tensioning member 218 is connected to the wrapping sheet 224 and the outer enclosing side wall 210.

In other example embodiments, first and second wrapping sheets and first and second side wall thermal insulation pads may be arranged in the inflatable chamber, the first wrapping sheet being connected to the outer enclosing side wall to jointly define a first accommodating chamber for accommodating the first side wall thermal insulation pad, the second wrapping sheet being connected to the inner enclosing side wall to jointly define a second accommodating chamber for accommodating the second side wall thermal insulation pad, and each side wall tensioning member being connected to the first wrapping sheet and the second wrapping sheet. In other words, the first example aspect and the second example aspect of the second example embodiment as described above are combined for this further example embodiment.

Figure 13:
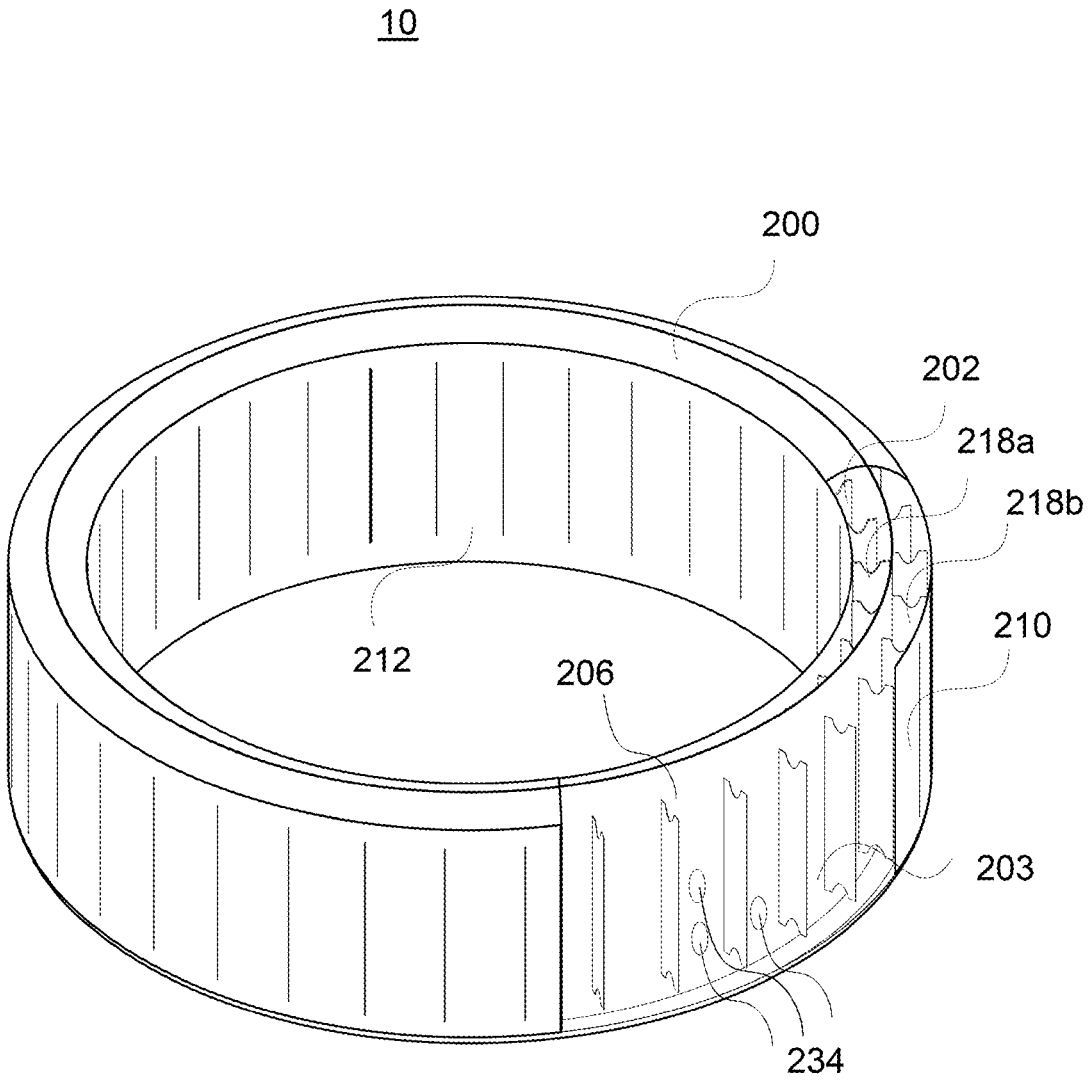
FIG. 13 is a schematic partial sectional view of an inflatable pool having a thermal insulation structure according to another example embodiment.

FIG. 13 is a schematic partial sectional view of an inflatable pool having a thermal insulation structure according to a third example embodiment. FIG. 14A is a schematic sectional top-view of the inflatable pool in FIG. 13. FIG. 14B is a schematic partial sectional side-view of the inflatable pool in FIG. 13. FIGS. 13 to 14B show an inflatable pool having a thermal insulation structure according to the third example embodiment. The difference between the inflatable pool according to the third example embodiment and the inflatable pool according to the first example embodiment lies in the configuration of the side wall thermal insulation structure. In the inflatable pool 10 according to the third example embodiment, the side wall thermal insulation structure 203 comprises a spacing sheet 206 which extends in the circumferential direction of the inflatable chamber 202 to divide the inflatable chamber 202 into at least two annular chambers. Providing the spacing sheet 206 to divide the inflatable chamber 202 into two or more annular chambers may limit air flow in the inflatable side wall 200 to reduce heat loss, thereby providing thermal insulation in the inflatable side wall 200. A temperature gradient may form along the two or more annular chambers 230, 232 and/or the spacing sheet 206, which may itself also be thermally insulating.

Referring to FIGS. 13 to 14B, in the inflatable pool 10 according to the third example embodiment, the inflatable side wall 200 comprises an outer enclosing side wall 210, an inner enclosing side wall 212, an upper side wall 214 and a lower side wall 216. In a non-limiting example, top edges of the outer enclosing side wall 210 and the inner enclosing side wall 212 are connected to the upper side wall 214, and bottom edges of the outer enclosing side wall 210 and the inner enclosing side wall 212 are connected to the lower side wall 216, so as to jointly define the inflatable chamber 202. The top edge and the bottom edge of the spacing sheet 206 are respectively connected to the upper side wall 214 and the lower side wall 216 to divide the inflatable chamber 202 into an inner annular chamber 230 and an outer annular chamber 232, thereby reducing heat loss of water in the inflatable pool.

The inflatable side wall 200 further comprises a plurality of first side wall tensioning members 218*a* and a plurality of second side wall tensioning members 218*b*. The plurality of first side wall tensioning members 218*a* are arranged in the inner annular chamber 230 and arranged at intervals in a circumferential direction of the inner annular chamber 230, and the plurality of second side wall tensioning members 218*b* are arranged in the outer annular chamber 232 and arranged at intervals in a circumferential direction of the outer annular chamber 232. Two side edges of each first side wall tensioning member 218*a* are respectively connected to the inner enclosing side wall 212 and the spacing sheet 206, and two side edges of each second side wall tensioning member 218*b* are respectively connected to the spacing sheet 206 and the outer enclosing side wall 210.

In some example embodiments, the connections between the outer enclosing side wall 210, the inner enclosing side wall 212, the upper side wall 214, the lower side wall 216, the spacing sheet 206, the plurality of first side wall tensioning members 218*a*, and the plurality of second side wall tensioning members 218*b* mentioned above may be achieved by means of sewing, welding or bonding. The outer enclosing side wall 210, the inner enclosing side wall 212, the upper side wall 214, the lower side wall 216, the spacing sheet 206, the plurality of first side wall tensioning members 218*a* and the plurality of second side wall tensioning members 218*b* may be made of at least one of PVC, PU, a laminated PVC mesh material, a laminated PU mesh material, and a TPU composite material, or any other suitable materials.

Referring to FIG. 14A, in some example embodiments, the first side wall tensioning member 218*a* and the second side wall tensioning member 218*b* may be welded to the spacing sheet 206, and a first weld seam between the first side wall tensioning member 218*a* and the spacing sheet 206 and a second weld seam between the second side wall tensioning member 218*b* and the spacing sheet 206 may be staggered from each other, thereby possible decreasing a chance of insufficient welding strength caused by repeated welding at a same position of the spacing sheet 206. In the non-limiting example shown, and even though the first weld seam of the first side wall tensioning member 218*a* and the second weld seam of the second side wall tensioning member 218*b*, together with the weld seam at the outer sides, respectively, are both arranged in a u-shape pointing into the same direction, one side wall tensioning member 218 may be flipped so that the u-shapes point into opposite directions. Thereby, the welding seams can also be separated, and welding strength and durability may be improved. Optionally, the welding seams may be arranged in a z-shape to achieve a similar effect.

Referring to FIG. 13, in some example embodiments, the spacing sheet 206 may comprises one or more apertures 234 to allow the adjacent annular chambers separated by the spacing sheet 206 to be in communication with each other. This example arrangement may facilitate simultaneous inflation of the plurality of annular chambers and also passage of fluid pipes (e.g., air pipes for creating bubbles in a SPA inflatable pool). For example, the one or more apertures 234 are arranged in the vicinity of the lower side wall of the inflatable side wall 200. As warm air rises, heat transfer of warm air between the annular chambers may be avoided or reduced to a minimum.

In the example embodiment as shown in FIG. 13, the inflatable side wall 200 comprises one spacing sheet 206 to divide the inflatable chamber 202 into two annular chambers. In other example embodiments, the inflatable side wall 200 may comprises two or more spacing sheets to divide the inflatable chamber 202 into three or more annular chambers. The one or more spacing sheets may be arranged at equal distances from each other and/or form inflatable chambers of equal or comparable volume. However, the sizes of the inflatable chambers may differ.

FIG. 15A is a schematic sectional top-view of an inflatable pool having a thermal insulation structure according to a fourth example embodiment. FIG. 15B is a schematic partial sectional side-view of the inflatable pool in FIG. 15A. FIGS. 15A and 15B show an inflatable pool having a thermal insulation structure according to the fourth example embodiment. Referring to FIGS. 15A and 15B, an example difference between the inflatable pool according to the fourth example embodiment and the inflatable pool according to the first example embodiment is that, in the inflatable pool 10 according to the fourth example embodiment, the side wall thermal insulation structure 203 is a side wall thermal insulation filler 208 filled in the inflatable chamber 202. The side wall thermal insulation filler 208 may comprises down, floc fiber (e.g., floc polyester and floc acrylic fiber), foam (e.g., polyethylene foam and polyurethane foam), sponge, mineral wool, cellulose, fleece and/or aerogel or any other suitable insulation material. The side wall thermal insulation filler 208 may be in the shape of floc, granule, block, etc., which is convenient for substantially uniformly filling the inflatable chamber 202. In the example embodiment as shown, the entire inflatable chamber 202 may be uniformly filled with the side wall thermal insulation filler 208.

Figure 16A:
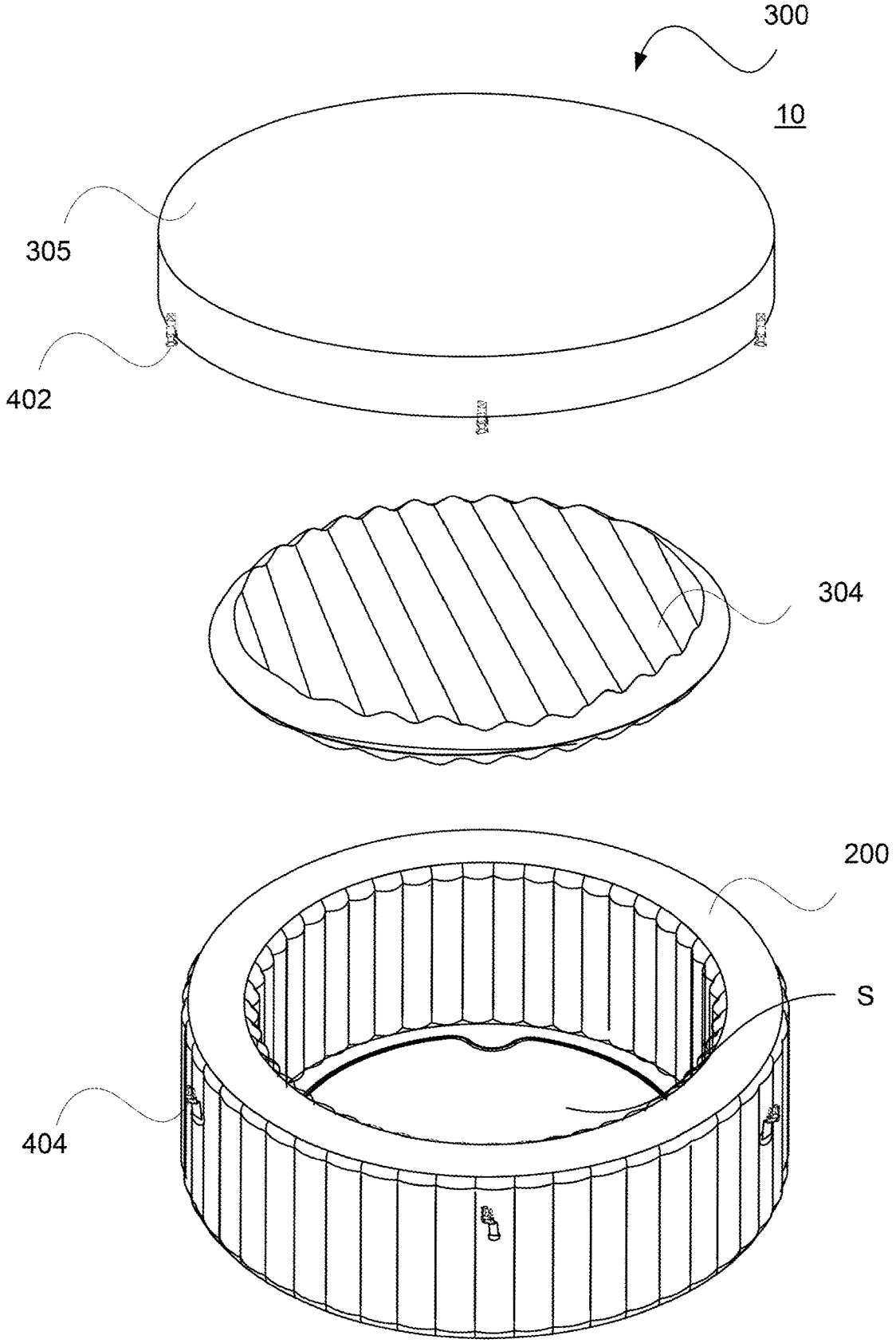
FIG. 16A is a schematic exploded view of an inflatable pool having a thermal insulation structure according to an example of a fifth example embodiment.
Figure 16B:
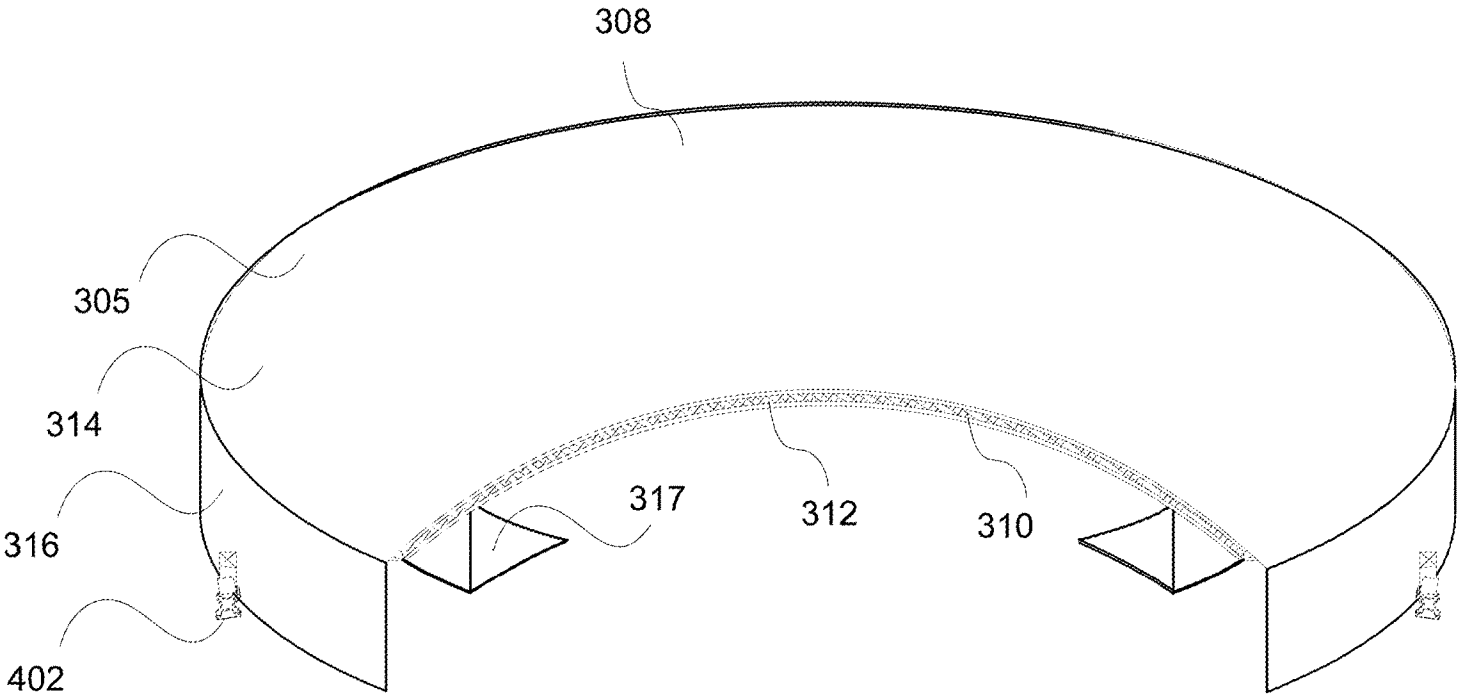
FIG. 16B is a schematic partial sectional view of a pool cover of the inflatable pool of FIG. 16A.
Figure 16C:
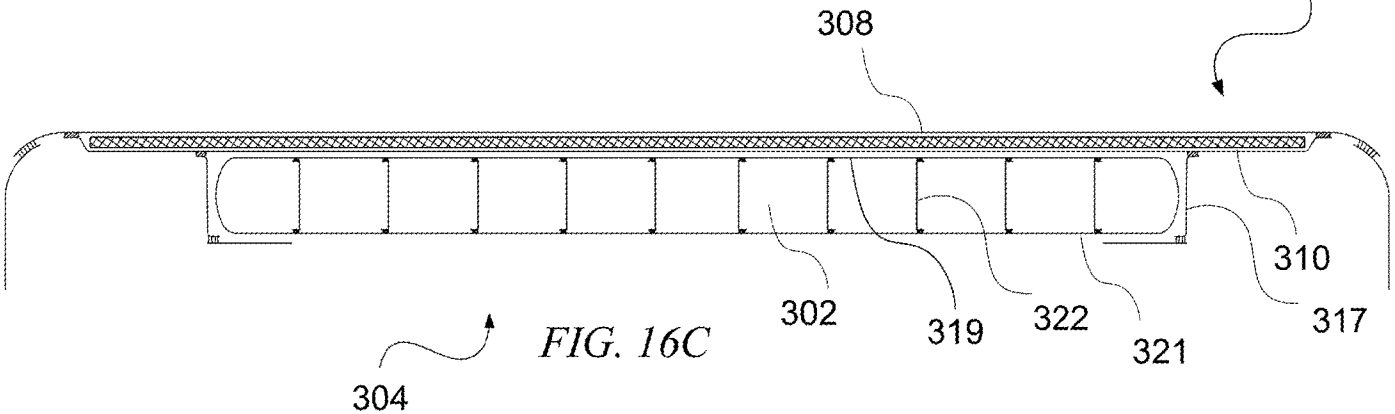
FIG. 16C is a schematic sectional view of the pool cover of the inflatable pool of FIG. 16A.

FIG. 16A is a schematic exploded view of an inflatable pool having a thermal insulation structure according to a first example of a fifth example embodiment. FIG. 16B is a schematic partial sectional view of a pool cover of the inflatable pool of FIG. 16A. FIG. 16C is a schematic sectional view of the pool cover of the inflatable pool of FIG. 16A. FIG. 16A shows an inflatable pool having a thermal insulation structure according to the fifth example embodiment. An example difference between the inflatable pool according to the fifth example embodiment and the inflatable pool according to the first example embodiment is that the inflatable pool 10 according to the fifth example embodiment further comprises a pool cover 300. The pool cover 300 is shown separately from the pool in FIGS. 16B to 21D. The pool cover 300 may be detachably connected to the inflatable side wall 200 and comprises an inflatable liner 304 having an inflatable cavity 302, so as to reduce heat loss of water in the inflatable pool 10 owing to the low thermal conductivity of air in the inflatable liner 304. In the inflatable pool 10 according to the fifth example embodiment, the pool cover 300 may be applied to the inflatable pools in the forgoing example embodiments, or may be applied to an inflatable pool in which no side wall thermal insulation structure is provided in the inflatable side wall.

The inflatable liner 304 is similar to the inflatable side wall 200 as discussed in the previous embodiments. The inflatable cavity 302 of the inflatable liner 304 is similar to the inflatable chamber 202 of the inflatable side wall 200. A difference is the orientation of the inflatable liner 304 with respect to the inflatable side wall 200 and consequently the orientation of the inflatable cavity 302 with respect to the inflatable chamber 200. The inflatable side wall is arranged around the circumference, i.e. the full circumference (360°) of the water holding space S and tensioning members inside the inflatable side wall extending in the radial direction. The pool cover 300 is placed on top of the pool 10 and on top of the water holding space S, the inflatable liner 304 extends in the z-direction and tensioning members inside the inflatable cavity extend in the z-direction, perpendicular to the radial direction. However, otherwise the inflatable chamber 200 and the inflatable liner 304 may have corresponding structures Referring to FIGS. 16A to 16C, in the first example aspect of the fifth example embodiment, the pool cover 300 may be detachably connected to the inflatable side wall 200 by means of a snap-fitting assembly which may comprise a first clamping member 402 fixed to the pool cover 300 and a second clamping member 404 fixed to the inflatable side wall 200, the first clamping member 402 and the second clamping member 404 being connected to each other in a clamping manner so as to connect the pool cover 300 to the inflatable side wall 200. In other example embodiments, the pool cover 300 may be detachably connected to the inflatable side wall 200 by means of other components/assemblies, such as a hook-and-loop fastener, a fastening strap, a snap-fastener, a magnetic suction assembly, and/or any of various other attachments.

Referring to FIG. 16A, the pool cover 300 may comprises an inflatable liner 304 and a cover body 305. As visible in FIG. 16C, the cover body 305 may comprises an outer layer 308, an inner layer 310, and a thermal insulation interlayer 312 arranged between the outer layer 308 and the inner layer 310. The combined use of the inflatable liner 304 and the thermal insulation interlayer 312 may further improve the thermal insulation effect of the pool cover 300. The outer layer 308 and the inner layer 310 may be made of at least one of PVC, PU, a laminated PVC mesh material, a laminated PU mesh material, and a TPU composite material, or any of various other suitable materials. The thermal insulation interlayer 312 may comprises fiber wadding (e.g., polyester wadding and acrylic wadding), foam (e.g., polyethylene foam and polyurethane foam), sponge, mineral wool, cellulose, fleece and/or aerogel or any other thermal insulation material. A face of thermal insulation interlayer 312 facing the water holding space S of the inflatable pool may be covered by a thermal radiation reflection layer or foil such that thermal radiation is reflected back towards the water holding space S. The thermal radiation reflection layer may comprise a metal layer or foil such as an aluminum layer or foil.

As the inflatable chamber, the inflatable liner comprises a thermal insulation structure arranged in the inflatable cavity, the thermal insulation structure comprising at least one of a thermal insulation pad; a thermal insulation coating; and a thermal insulation filler filled within the inflatable cavity. Thus, everything mentioned before with respect to the thermal insulation pad, the thermal insulation coating or the thermal insulation filler of the inflatable side wall also applies to the thermal insulation pad, the thermal insulation coating or the thermal insulation filler of the inflatable liner, except of the orientation of the elements with respect to the water holding space S of the pool 10. In the following, although the elements of the inflatable liner are referred to as a liner thermal insulation pad, a liner thermal insulation coating, and a liner thermal insulation filler, it should be understood that the elements to not differ from the corresponding elements of the inflatable side wall. The liner thermal insulation pad, liner thermal coating and liner thermal insulation filler will be briefly discussed below. But is should be understood the that disclosure of the previously-described example embodiments apply for the corresponding elements of the inflatable side wall and the inflatable liner.

In the example embodiment as shown, the outer layer 308 comprises a central portion 314, generally circular, and a side enclosing portion 316 which surrounds and is connected to the periphery of the central portion 314. The first clamping member 402 of the snap-fitting assembly is arranged on the side enclosing portion 316. It can be understood that, in other example embodiments, the first clamping member may additionally or alternately be arranged on the central portion of the outer layer. In the example embodiment as shown, the inner layer 310 is in a shape matching the central portion 314 of the outer layer 308 and is connected to the inner side of the outer layer 308 so as to sandwich the thermal insulation interlayer 312 between the outer layer 308 and the inner layer 310, thereby attaching the thermal insulation interlayer 312 to the outer layer 308. The inner side of the outer layer 308 refers to the side of the outer layer 308 that faces the water holding space S of the inflatable pool 10. Specifically, the outer edge of the inner layer 310 is welded to the outer layer 308 at a position close to the periphery, but does not overlap with the position where the central portion 314 is connected to the side enclosing portion 316.

Referring to FIG. 16C, in the first example aspect of the fifth example embodiment, the inflatable liner 304 is detachably arranged on the inner layer 310 side of the cover body, for example by means of woven fabric 317. The inflatable liner 304 comprises a top wall or sheet 319, a bottom wall or sheet 320, and a plurality of liner tensioning members 322. The top wall or sheet 319 and the bottom wall or sheet 320 are connected to each other to jointly define the inflatable cavity 302, and the plurality of liner tensioning members 322 are arranged at intervals in the inflatable cavity 302. Each liner tensioning member 322 may be substantially sheet-shaped, and the top edge and the bottom edge of each liner tensioning member 322 may be respectively connected to the top wall 319 and bottom wall 320. The connections between the top wall 319, the bottom wall 321 and the liner tensioning member 322 mentioned above may be achieved by means of welding or bonding. The top wall 319, the bottom wall 321 and the liner tensioning member 322 may be made of at least one of PVC, PU, a laminated PVC mesh material, a laminated PU mesh material, and a TPU composite material, or any of various other suitable materials.

In other example embodiments, as shown in FIGS. 17A to 21D, similar to the inflatable side wall 200, the inflatable liner 304 may be provided with a liner thermal insulation structure 303 located in the inflatable cavity 302 so as to further improve the thermal insulation effect of the pool cover 300.

The liner thermal insulation structure 303 may comprises at least one of: a) a liner thermal insulation pad 324 arranged in the inflatable cavity 302 and/or comprising at least one of fiber wadding, foam, sponge, mineral wool, cellulose, fleece, and/or an aerogel or any other insulation material; b) a liner thermal insulation coating, with which an inner surface of the inflatable cavity 302 is coated; and c) a liner thermal insulation filler filled in the inflatable cavity 302. In other words, the liner thermal insulation structure 303 may comprise any one of the liner thermal insulation pad 324, the liner thermal insulation coating and the liner thermal insulation filler and a combination thereof. Thus, the liner thermal insulation structure 303 is similar to the thermal insulation structure 203 as previously described. An example of the liner thermal insulation structure 303 comprising the liner thermal insulation pad 324 is illustrated in FIGS. 17B to 17E, 18B, 18C, 19B to 19D and 20. The liner thermal insulation pad 324 may comprises fiber wadding (e.g., polyester wadding and acrylic wadding), foam (e.g., polyethylene foam and polyurethane foam), sponge, mineral wool, cellulose, fleece and/or aerogel or any other insulation material. The liner thermal insulation filler may comprises down, floc fiber (e.g., floc polyester and floc acrylic fiber), foam (e.g., polyethylene foam and polyurethane foam), sponge, mineral wool, cellulose, fleece and/or aerogel; and the liner thermal insulation filler may be in the shape of floc, granule, block, etc., which may be convenient for substantially uniformly filling the inflatable cavity 302.

Figure 17A:
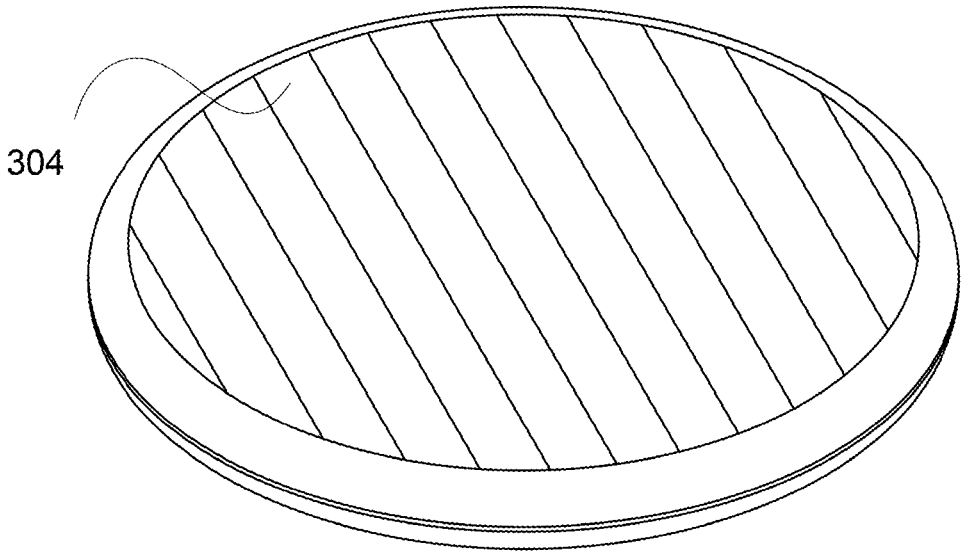
FIG. 17A is a schematic perspective view of an inflatable liner of a pool cover of an inflatable pool having a thermal insulation structure according to another aspect of the fifth example embodiment.
Figure 17B:
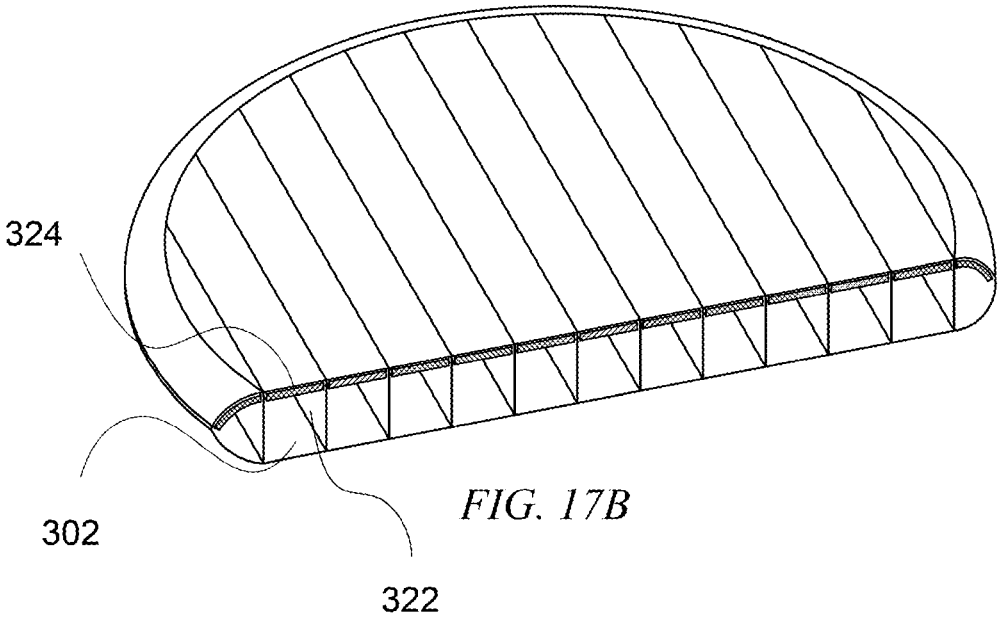
FIG. 17B is a schematic perspective sectional view of the inflatable liner in FIG. 17A.

Referring to FIGS. 17A and 17B, in the second example aspect of the fifth example embodiment, the liner thermal insulation structure 303 in the inflatable cavity 302 comprises the liner thermal insulation pad 324 attached to the inner surface of the inflatable cavity 302. The liner thermal insulation pad 324 may be attached to the inner surface of the inflatable cavity 302 by means of, for example, bonding or welding or any other suitable method.

In the example embodiment as shown, the liner thermal insulation pad 324 is an integral piece, extends along the top wall 319, and comprises a plurality of pad openings 325, each pad opening 325 being configured for the corresponding liner tensioning member 322 to pass through. The top edge and the bottom edge of each liner tensioning member 322 may be respectively connected to the top wall 319 and the bottom wall 321. In the example embodiment as shown, the liner thermal insulation pad 324 is attached to the inner surface of the top wall 319. In other example embodiments, the liner thermal insulation pad may be arranged at, and attached to the inner surface of the bottom wall 321.

However, the pad openings 325 can also be omitted and the tensioning members 322 can be directly attached to the thermal insulation pad 324.

Figure 17C:
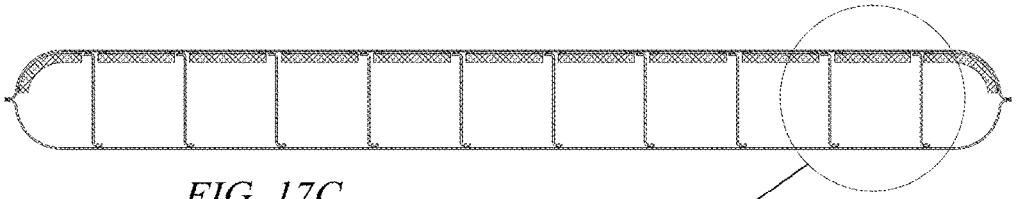
FIG. 17C is a schematic sectional side-view of the inflatable liner in FIG. 17A.
Figure 17D:
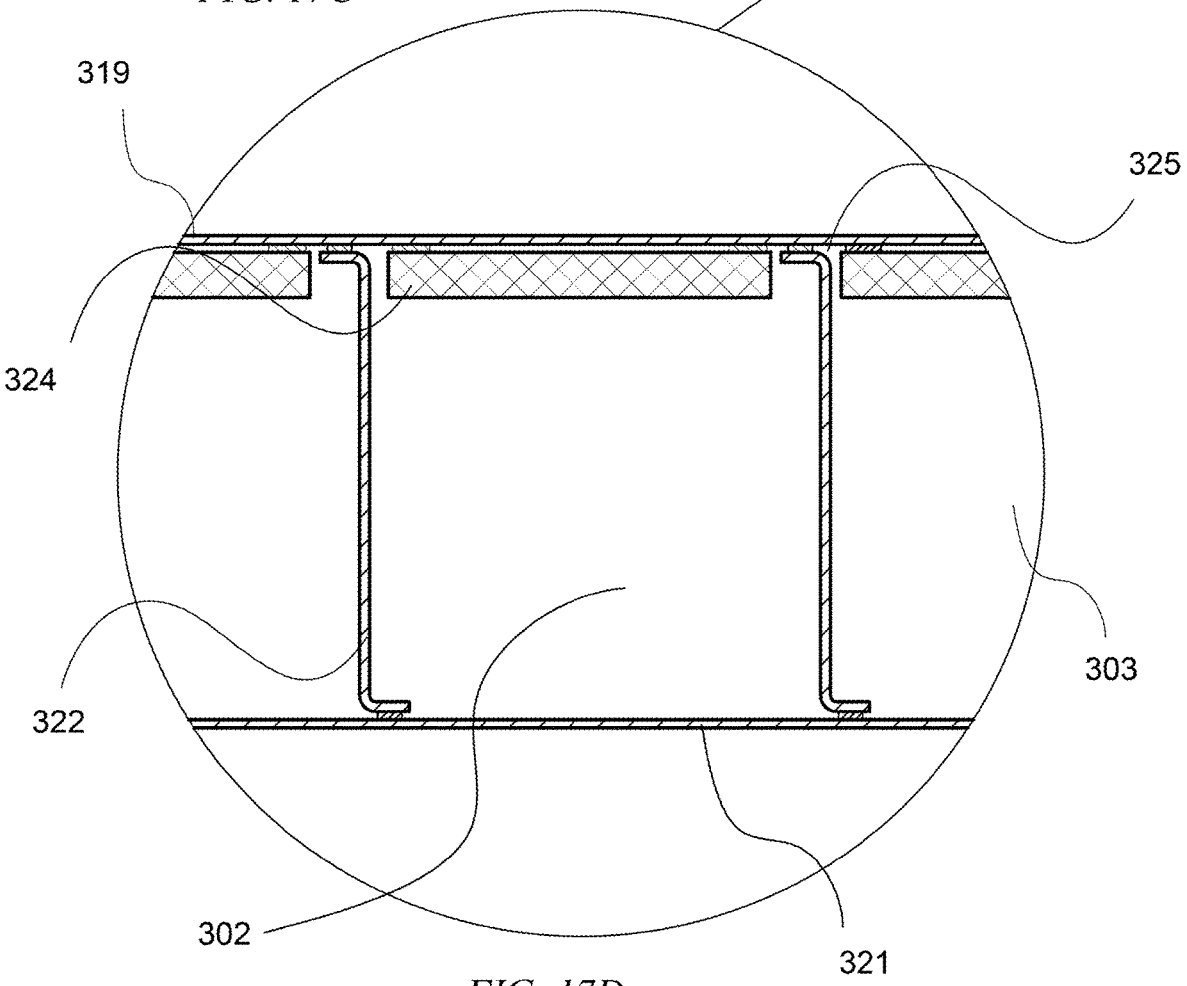
FIG. 17D is a schematic partial enlarged detailed view of the encircled portion of FIG. 17C.
Figure 17E:
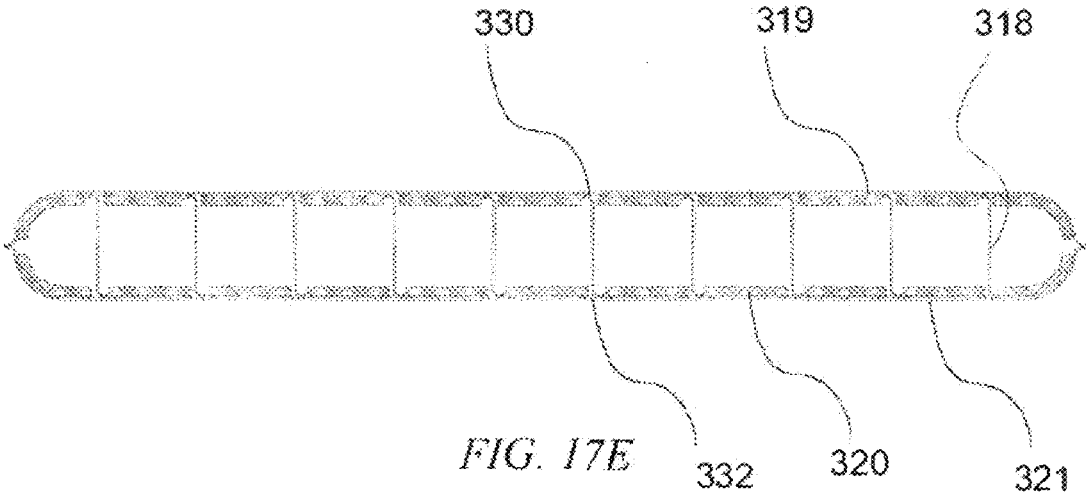
FIG. 17E is a schematic sectional view of an inflatable liner of a pool cover of an inflatable pool having a thermal insulation structure according to another aspect of the fifth example embodiment.

FIGS. 17C and 17D show the arrangement of the tensioning members 318 and the pad openings 325 in more detail. The liner tensioning members 318 are provided in the opening 325 of the thermal insulation pad 324. The gap openings 325 may be as small as possible. The smaller the gap, the better the insulation of the liner is. According to one or more example embodiments, the thermal insulation pad 324 is in direct contact with the tensioning members 318. The width of the pad opening 325 may be equal to the width of a tensioning member 318. The pad openings 325 may be formed uniformly spaced apart from each other along the circumference of the top wall 319. The size of the pad opening 325 may be as small as possible in order to provide optimal thermal insulation properties. The length of the pad opening 325 may be equal to the length of the tensioning member 318. The width of the pad opening 325 may range from 1.5 to 0.5 of the width or thickness of a tensioning member 318, for example between 1.2 and 0.8 times the width or thickness of a tensioning member 318, or between 1.1 and 0.9 times the width or thickness of a tensioning member 318. The width of the pad opening 325 may range from 0.1-1 mm, for example from 0.2-0.5 mm. FIG. 17D depicts an enlarged view of the gap between the thermal insulation pad 324 and the arrangement of the tensioning members 318 in the openings 325. The tensioning members 318 in this embodiment have a C-shape such that the tensioning members 318 have sections extending along a parallel to the top wall 319 to allow attachment, for example welding of these sections to the top wall 319. However, the shape of the tensioning members 318 is not limited thereto. The gap 325 shown in FIG. 17D is exaggerated to show the structure of the tensioning member 318 more clearly. According to one or more example embodiments, the thermal insulation pad 324 may overlap with the sections of the tensioning member 318 attached to the top wall 319 and may be in direct contact with the part of a tensioning member 318 extending between the walls. This may aid in insulation.

Compared to the second example aspect shown in FIGS. 17, the liner thermal insulation pad 324 of a third example aspect (not shown) may comprises a plurality of thermal insulation segments 320 arranged at intervals (similar as described with respect to the first example embodiment), instead of being an integral piece. The liner tensioning members 322 are provided in gaps between two neighboring thermal insulation segments 320. The gaps between thermal insulation sections 320 may be as small as possible. The smaller the gap, the better the insulation of the liner is. According to one or more example embodiments, the thermal insulation segments 320 may be in direct contact with the tensioning members 318. The gap between the thermal insulation segments 320 may be equal to the width of a tensioning member 318. The gap may also be smaller than the width of a tensioning member 318 such that the tensioning member is compressed between the thermal insulation sections 320. The width of the gap may be 1.5 to 0.5 times the width or thickness of a tensioning member 318, for example between 1.2 and 0.8 times the width or thickness of a tensioning member 318, or between 1.1 and 0.9 times the width or thickness of a tensioning member 318. In a non-limiting example, the width or thickness of the tensioning members 318 may range from 0.1-1 mm, for example between 0.2-0.5 mm. During manufacturing, first the tensioning members 318 may be attached to the top wall 319 before the thermal insulation sections 320 are attached to the top wall 319.

Additionally, the liner thermal insulation pad 324 may be arranged at both, the top wall 319 and the bottom wall 321 as shown in FIG. 197E. Except for the two outer thermal insulation segment 320, a thermal insulation segment 320 is arranged between two adjacent liner tensioning members 318. A first weld seam 330 is formed between a liner tensioning member 318 and the top wall 319 connecting them, and a second weld seam 332 is formed between said liner tensioning member 318 and the bottom wall 321, also forming a connection between them. Here, the first weld seam 330 and the second weld seam 332 are on opposite sides of the liner tensioning member 318. However, they may lie on the same side of the liner tensioning member 318.

Figure 18A:
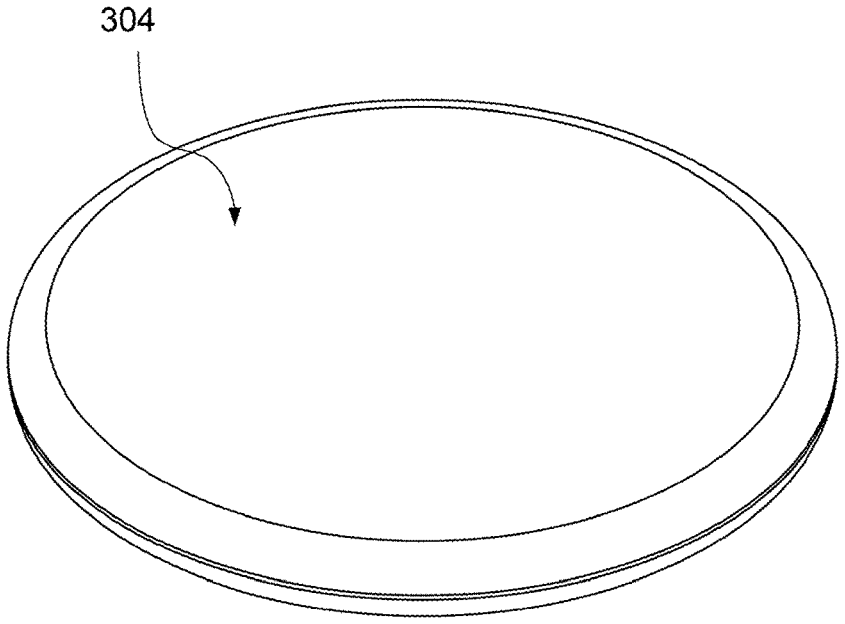
FIG. 18A is a schematic perspective view of an inflatable liner of a pool cover having a thermal insulation structure according to another aspect of the fifth example embodiment.
Figure 18B:
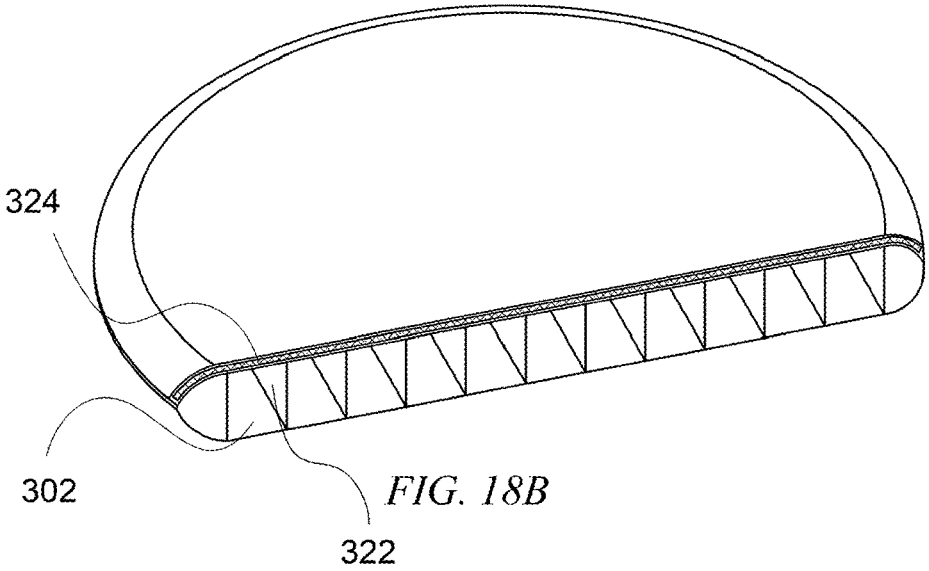
FIG. 18B is a schematic perspective sectional view of the inflatable liner in FIG. 18A.
Figure 18C:
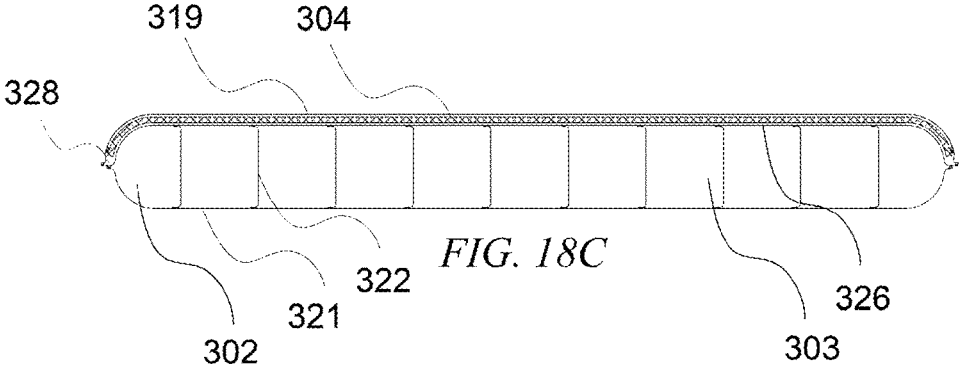
FIG. 18C is a schematic sectional side-view of the inflatable liner in FIG. 18A.
Figure 19A:
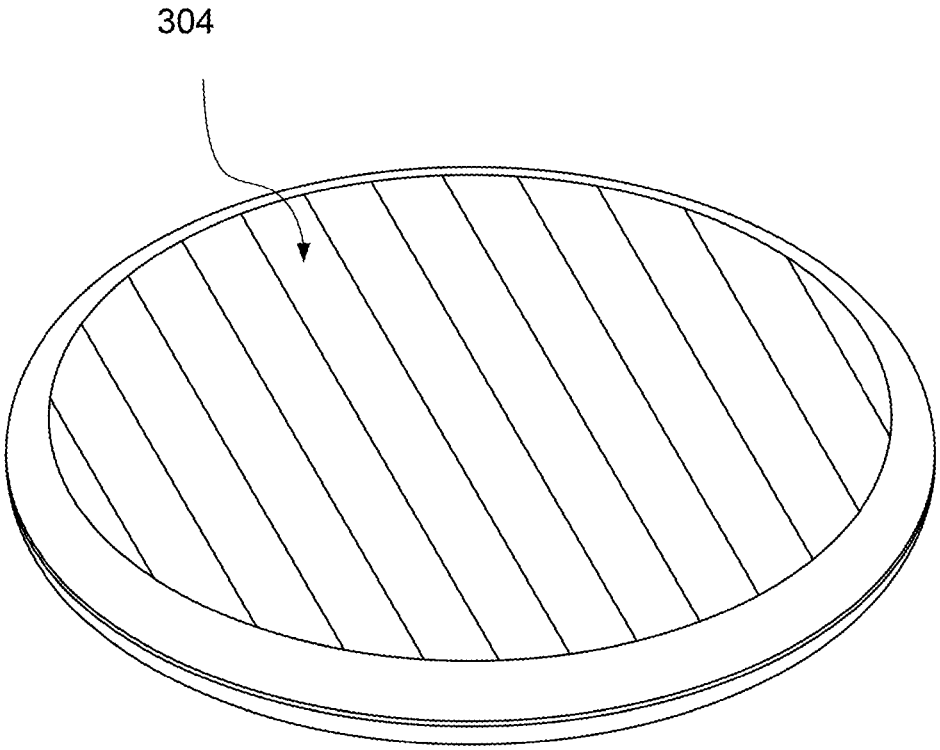
FIG. 19A is a schematic sectional view of an inflatable liner of a pool cover having a thermal insulation structure according to another aspect of the fifth example embodiment.
Figure 19B:
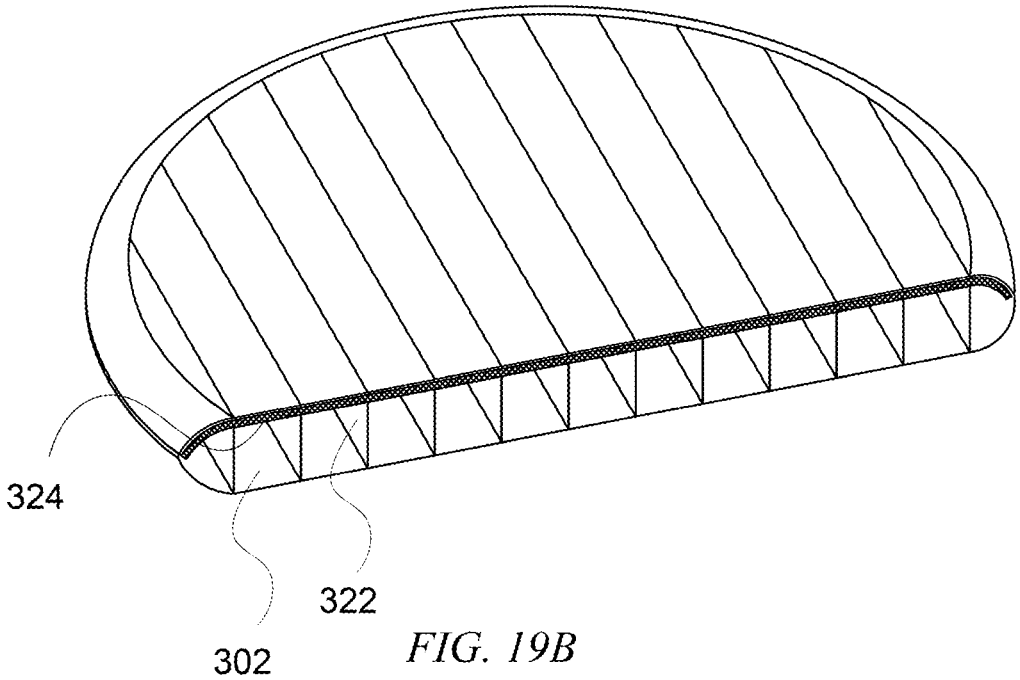
FIG. 19B is a schematic perspective sectional view of the inflatable liner in FIG. 19A.
Figure 19C:
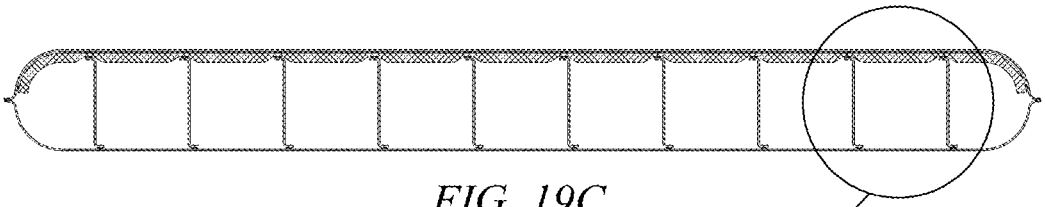
FIG. 19C is a schematic sectional side-view of the inflatable liner in FIG. 19A.
Figure 19D:
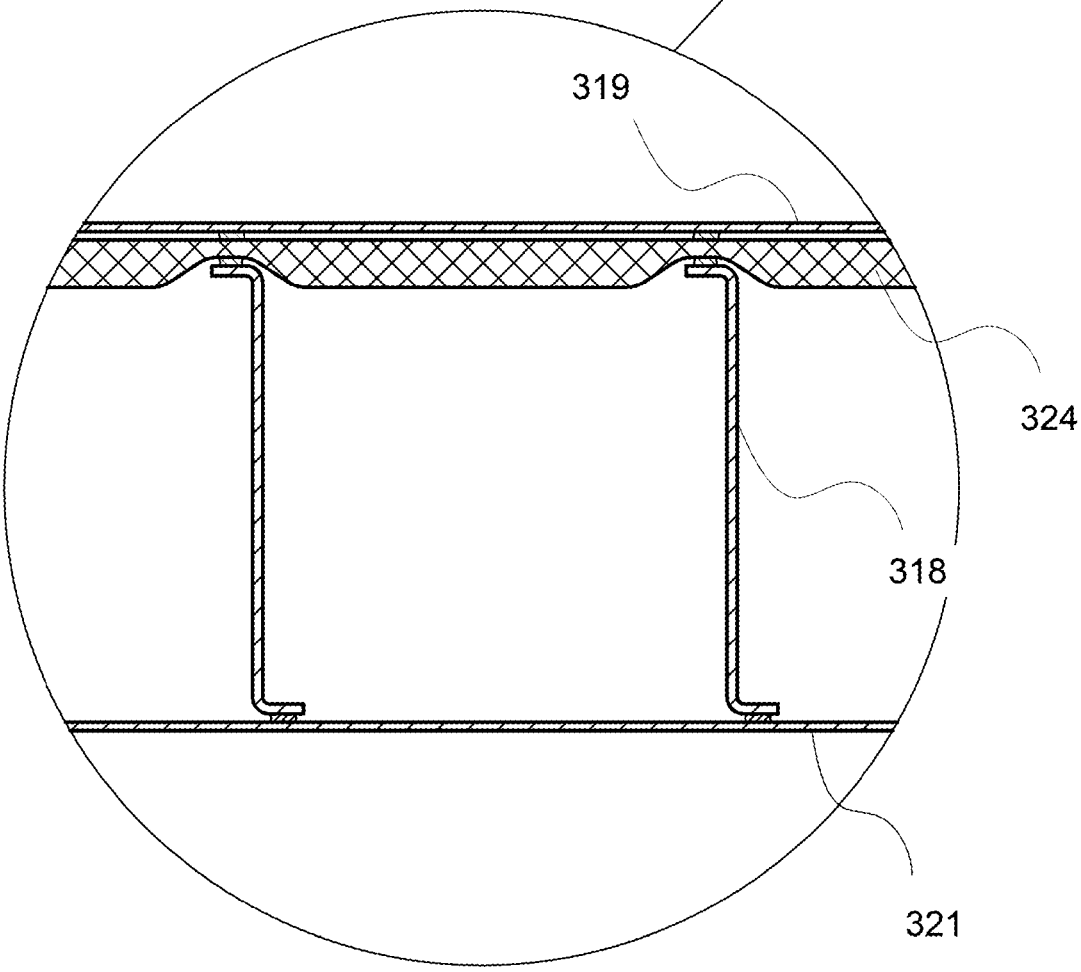
FIG. 19D is a schematic partial enlarged detailed view of the encircled portion of FIG. 19C.

FIG. 18A is a schematic perspective view of an inflatable liner of a pool cover having a thermal insulation structure according to a fourth aspect of the fifth example embodiment. FIG. 18B is a schematic perspective sectional view of the inflatable liner in FIG. 18A. FIG. 18C is a schematic sectional side-view of the inflatable liner in FIG. 18A. Referring to FIGS. 18A and 18B, in the fourth example aspect of the fifth example embodiment, an attachment sheet 326 is arranged in the inflatable cavity 302. The attachment sheet 326 is connected to the top wall 319 to jointly define an accommodating cavity 328 for accommodating the liner thermal insulation pad 324. The top edge and the bottom edge of each liner tensioning member 322 are respectively connected to the attachment sheet 326 and the bottom wall 321. In some example embodiments, the attachment sheet 326 may be welded to the top wall 319. The attachment sheet 326 may be made of at least one of PVC, PU, a laminated PVC mesh material, a laminated PU mesh material and a TPU composite material, or any of a variety of other suitable materials.

In other example embodiments, the attachment sheet may be connected to the bottom wall to jointly define an accommodating cavity for accommodating the liner thermal insulation pad, and the top edge and the bottom edge of each liner tensioning member are respectively connected to the top wall and the attachment sheet. In further example embodiments, first and second attachment sheets and first and second liner thermal insulation pads may be arranged in the inflatable cavity, the first attachment sheet being connected to the top wall to jointly define a first accommodating cavity for accommodating the first liner thermal insulation pad, the second attachment sheet being connected to the bottom wall to jointly define a second accommodating cavity for accommodating the second liner thermal insulation pad, and the top edge and the bottom edge of each liner tensioning member being respectively connected to the first attachment sheet and the second attachment sheet.

Referring to FIGS. 19A to 19D, in the fifth example aspect of the fifth example embodiment, the attachment sheet 326 of the preceding fourth example aspect is omitted and the liner thermal insulation pad 324 is formed as an integral piece and is directly connected to the top wall 319. Additionally, the liner tensioning members 318 are directly connected to the liner thermal insulation pad 324. For procedural economy, the top wall 319, the liner thermal insulation pad 324 and the liner tensioning members 318 may be welded together in this order at the same position. Alternatively, they may be welded to the liner thermal insulation pad 324 at different locations for optimizing strength and durability.

this example is essentially in line with the disclosure regarding FIGS. 5A to 5D.

Figure 20:
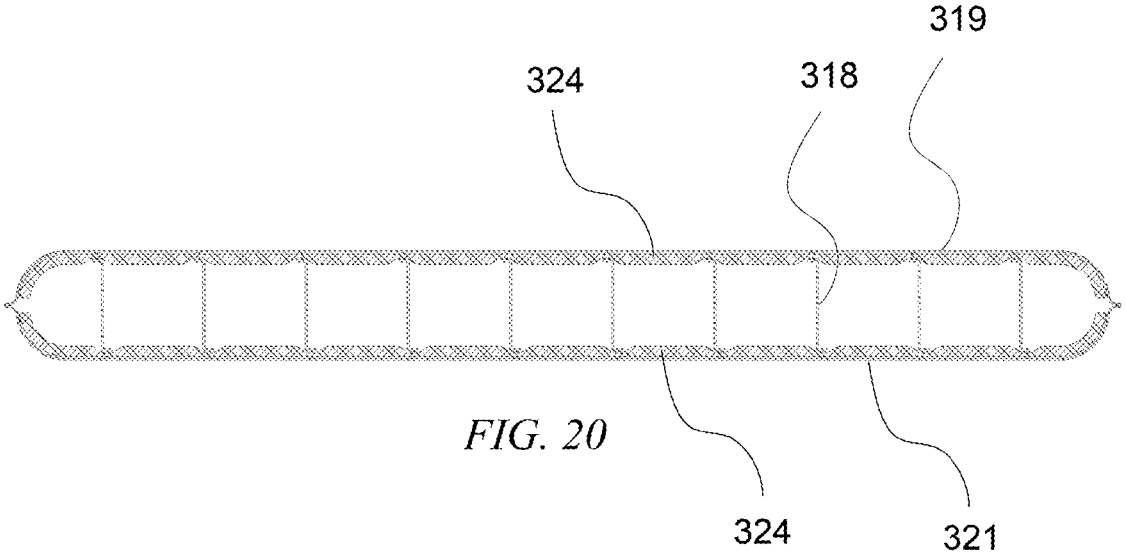
FIG. 20 is a schematic sectional view of an inflatable liner of a pool cover having a thermal insulation structure according to another aspect of the fifth example embodiment.
Figure 21A:
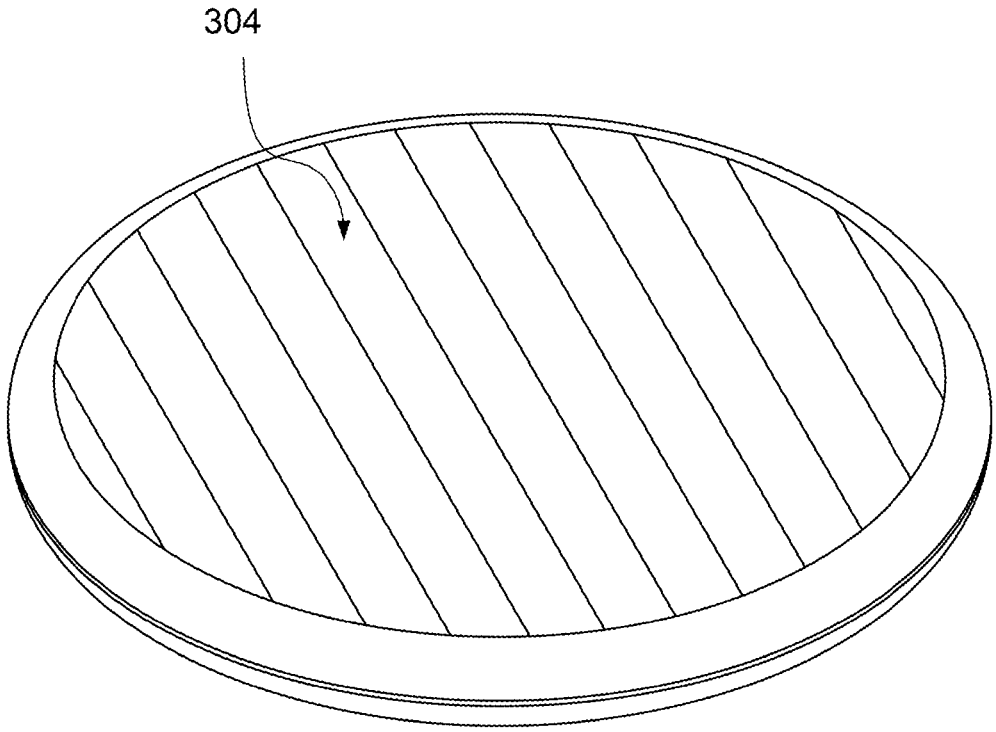
FIG. 21A is a schematic sectional view of an inflatable liner of a pool cover having a thermal insulation structure according to another aspect of the fifth example embodiment.
Figure 21B:
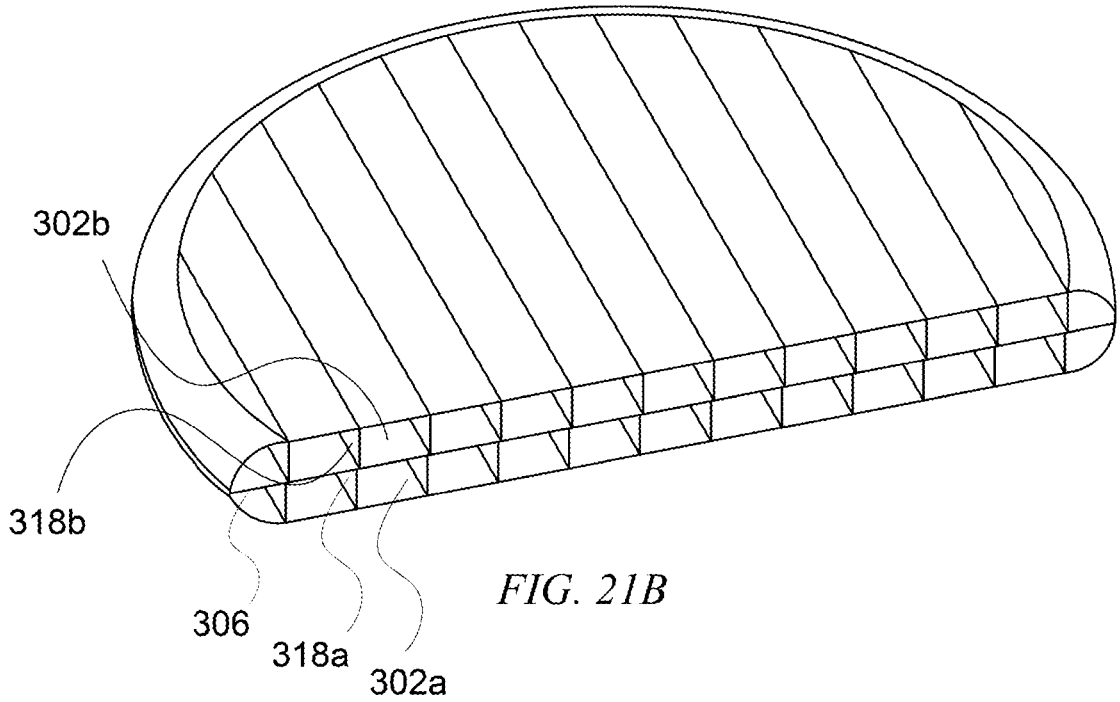
FIG. 21B is a schematic perspective sectional view of the inflatable liner in FIG. 21A.
Figure 21C:
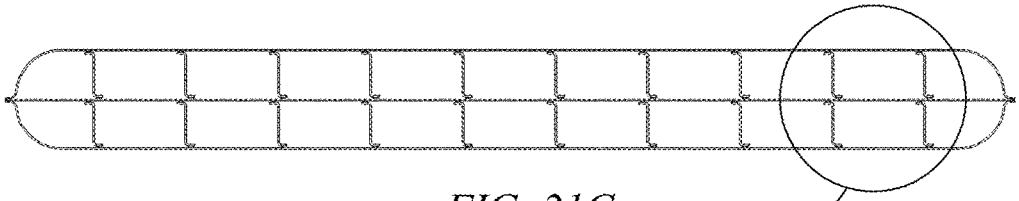
FIG. 21C is a schematic sectional side-view of the inflatable liner in FIG. 21A.
Figure 21D:
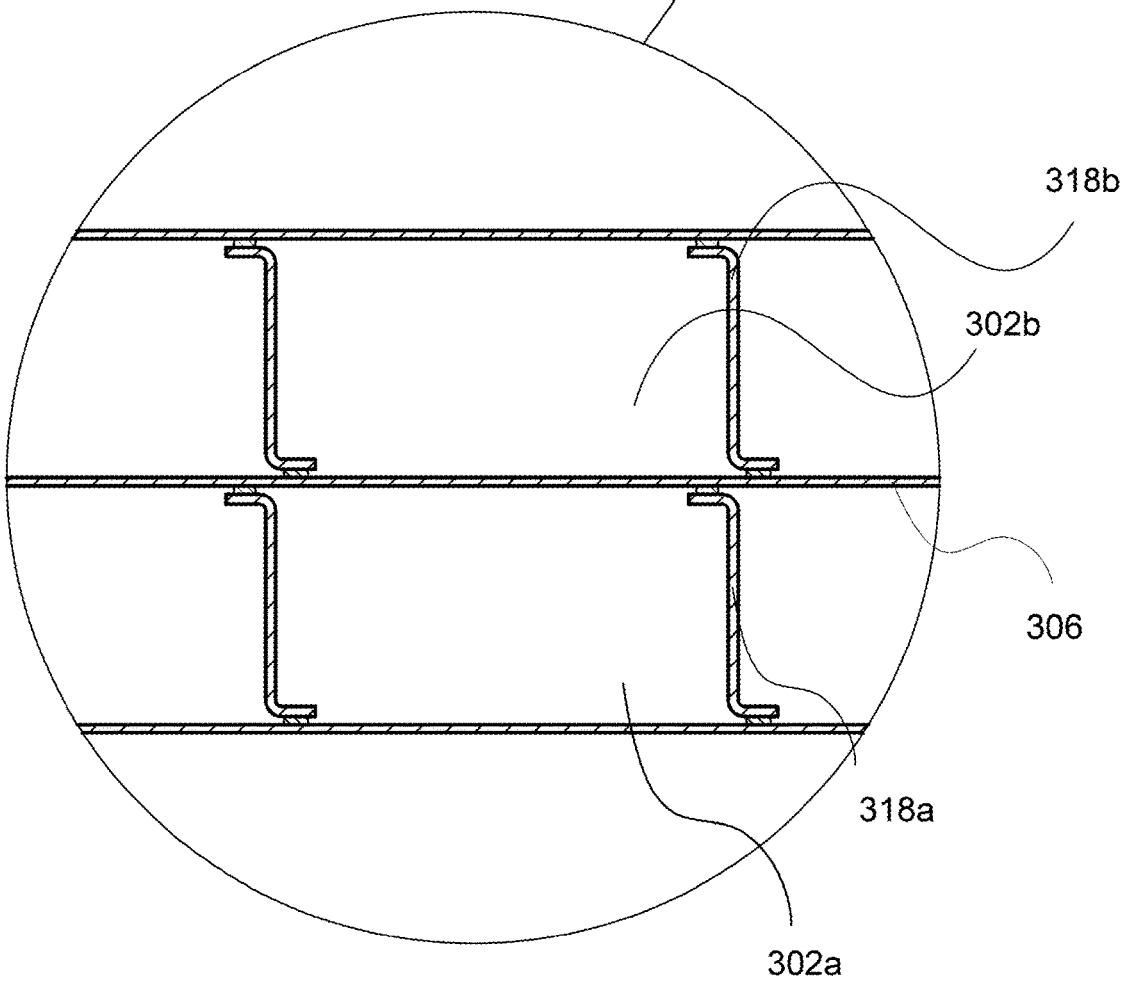
FIG. 21D is a schematic partial enlarged detailed view of the encircled portion of FIG. 21C.

Referring to FIG. 20, in the sixth example aspect of the fifth example embodiment, the structure as described in the preceding example of the fifth example aspect is extended to the bottom wall 321. Accordingly, this example comprises two integrally formed liner thermal insulation pads 324 for thermal insulation.

Alternatively or additionally to the liner thermal insulation pad 324, a liner thermal insulation coating may be applied. When the coating is applied instead of the liner thermal insulation pad 324, the coating may be applied uniformly resulting in a shape similar to the one shown in FIG. 19C. When the coating is applied additionally to the thermal insulation pad 324, the coating may be applied onto the liner thermal insulation pad and/or the top wall 319 and/or the bottom wall 321.

Referring to FIGS. 21A to 21D, in the seventh example aspect of the fifth example embodiment, the inflatable liner 304 comprises a liner spacing sheet 306, dividing the inflatable cavity 302 into an inner inflatable cavity 302*a* and an outer inflatable cavity 302*b*. Accordingly, compared to the other examples of the fifth embodiment, the liner tensioning members 318 are divided into first liner tensioning members 318*a* connecting the bottom wall 321 with the liner spacing sheet 306 and second liner tensioning members 318*b* connecting the liner spacing sheet 306 with the top wall 319. Here, the weld seams of the liner tensioning members 318*a*, 318*b* with the spacing sheet 306 are at a distance from each other. However, the liner tensioning members 318*a*, 318*b* may still be aligned with each other, respectively. Even though the shape of the liner 302 and the inflatable side wall 200 are different, features between this example and the third example embodiment are interchangeable.

It should also be understood that the components and features described herein can be made of a variety of materials including, but not limited to, polymer, rubber, metal, and other suitable materials well known to those skilled in the art or a combination thereof. The example embodiments shown in FIGS. 1 to 21D only show the shapes, sizes, and arrangements of various optional components of the inflatable pool having a thermal insulation structure, but they are merely illustrative rather than restrictive, and other shapes, sizes, and arrangements can also be used.

It may be understood that the example embodiments described herein may be considered in a descriptive sense only and not for purposes of limitation. Descriptions of features or aspects within each example embodiment may be considered as available for other same or similar features or aspects in aspects of other example embodiments or other example embodiments.

While example embodiments have been described with reference to the figures, it will be understood by those of ordinary skill in the art that various changes in form and details may be made therein without departing from the spirit and scope as defined by the following claims.

What is claimed is:

1. An inflatable pool comprising:
an upper wall;
a lower wall;
an outer wall connected to the upper wall and the lower wall;
an inner wall connected to the upper wall and the lower wall and defining a water cavity together with the lower wall;
an inflatable chamber defined by the upper wall, the lower wall, the outer wall and the inner wall;
a plurality of tensioning members arranged at intervals within the inflatable chamber in a circumferential direction of the inflatable chamber;
a thermal insulation structure disposed within the inflatable chamber; and
a wrapping sheet arranged in the inflatable chamber and connected to at least one of the outer wall and the inner wall to jointly define an accommodating chamber between the wrapping sheet and the one of the outer wall and the inner wall;
wherein the thermal insulation structure includes a thermal insulation pad disposed within the accommodating chamber, and each of the plurality of tensioning members is connected to the wrapping sheet and another one of the outer wall and the inner wall.

2. The inflatable pool according to claim 1, wherein the thermal insulation structure further comprises at least one of:
a thermal insulation coating on an inner surface of the inflatable chamber;
a spacing sheet extending in a circumferential direction of the inflatable chamber and positioned to divide the inflatable chamber into a plurality of annular chambers; and
a thermal insulation filler filled within the inflatable chamber.

3. The inflatable pool according to claim 2, wherein the spacing sheet comprises at least one aperture, through which the plurality of annular chambers are in communication with each other.

4. The inflatable pool according to claim 2,
wherein the spacing sheet comprises a top edge connected to the upper wall and a bottom edge connected to the lower wall.

5. The inflatable pool according to claim 1, wherein the thermal insulation structure further comprises:
a thermal insulation filler comprising at least one of down, floc fiber, foam, sponge, and an aerogel.

6. The inflatable pool according to claim 1, wherein the thermal insulation pad is fixed within the accommodating chamber by one of bonding, sewing, and welding.

7. The inflatable pool according to claim 1, wherein the thermal insulation pad comprises at least one of fiber wadding, foam, sponge, mineral wool, cellulose, fleece and an aerogel.

8. An inflatable pool comprising:
an upper wall;
a lower wall;
an outer wall connected to the upper wall and the lower wall;
an inner wall connected to the upper wall and the lower wall and defining a water cavity together with the lower wall;
an inflatable chamber defined by the upper wall, the lower wall, the outer wall and the inner wall; and
a plurality of tensioning members arranged at intervals within the inflatable chamber in the circumferential direction of the inflatable chamber;
a thermal insulation structure disposed within the inflatable chamber;
an inflatable liner defining an inflatable cavity; and
a cover body comprising an outer layer, an inner layer, and a thermal insulation interlayer arranged between the outer layer and the inner layer,
wherein the inflatable liner is arranged adjacent to the inner layer of the cover body.

9. An inflatable pool comprising:

an upper wall;

a lower wall;

an outer wall connected to the upper wall and the lower wall;

an inner wall connected to the upper wall and the lower wall and defining a water cavity together with the lower wall;

an inflatable chamber defined by the upper wall, the lower wall, the outer wall and the inner wall; and a plurality of tensioning members arranged at intervals within the inflatable chamber in the circumferential direction of the inflatable chamber;

a thermal insulation structure disposed within the inflatable chamber;

a cover body comprising a top surface and a bottom surface; and an inflatable liner disposed on the bottom surface of the cover body and including:

a top wall;

a bottom wall connected to the top wall such that an inflatable cavity is defined between the top wall and the bottom wall;

a plurality of liner tensioning members arranged at intervals in the inflatable cavity; and a liner thermal insulation structure arranged in the inflatable cavity of the inflatable liner, the liner thermal insulation structure comprising at least one of:

a liner thermal insulation pad;

a liner thermal insulation coating on an inner surface of the inflatable cavity of the inflatable liner; and a liner thermal insulation filler filled within the inflatable cavity of the inflatable liner.

10. The inflatable pool according to claim 9, wherein the liner thermal insulation structure comprises the liner thermal insulation pad, and the liner thermal insulation pad is attached to the inner surface of the inflatable cavity of the inflatable liner by means of one of bonding and welding.

11. The inflatable pool according to claim 9, wherein each of the liner tensioning members is connected to the top wall of the inflatable liner and the bottom wall of the inflatable liner;

wherein the liner thermal insulation structure comprises the liner thermal insulation pad arranged on at least one of the top wall and the bottom wall of the inflatable liner; and the liner thermal insulation pad comprises:

a plurality of thermal insulation segments arranged at intervals, each of the thermal insulation segments arranged between two adjacent ones of the liner tensioning members; or an integral piece comprising a plurality of liner pad openings, each of the plurality of liner pad openings configured for a corresponding one of the plurality of liner tensioning members to pass through.

12. The inflatable pool according to claim 9, wherein the inflatable liner further comprises:

an attachment sheet connected to one of the top wall and the bottom wall of the inflatable liner thereby defining an accommodating cavity between the attachment sheet and the one of the top wall and the bottom wall of the inflatable liner; and the liner thermal insulation pad disposed in the accommodating cavity;

wherein each of the plurality of liner tensioning members is connected to the attachment sheet and another one of the top wall and the bottom wall of the inflatable liner.

* * * * *